US009516713B2

(12) United States Patent
Matsukura

(10) Patent No.: US 9,516,713 B2
(45) Date of Patent: Dec. 6, 2016

(54) LIGHT-EMITTING DEVICE

(75) Inventor: Hideki Matsukura, Isehara (JP)

(73) Assignee: SEMICONDUCTOR ENERGY LABORATORY CO., LTD., Kanagawa-ken (JP)

( * ) Notice: Subject to any disclaimer, the term of this patent is extended or adjusted under 35 U.S.C. 154(b) by 585 days.

(21) Appl. No.: 13/354,829

(22) Filed: Jan. 20, 2012

(65) Prior Publication Data

US 2012/0187854 A1 Jul. 26, 2012

(30) Foreign Application Priority Data

Jan. 25, 2011 (JP) ..... 2011-012554

(51) Int. Cl.
*H05B 37/00* (2006.01)
*H05B 33/08* (2006.01)
*G09G 3/32* (2016.01)

(52) U.S. Cl.
CPC ..... *H05B 33/0824* (2013.01); *G09G 3/32* (2013.01); *G09G 2300/0426* (2013.01); *G09G 2330/045* (2013.01)

(58) Field of Classification Search
CPC ..... H05B 37/00
USPC ..... 315/192; 257/40, 43, 59, 72, 88, 98, 99
See application file for complete search history.

(56) References Cited

U.S. PATENT DOCUMENTS 2,972,692 A 2/1961 William et al.
3,833,833 A 9/1974 Nelson
4,298,869 A 11/1981 Okuno
5,162,931 A 11/1992 Holmberg
5,939,839 A 8/1999 Robel et al.
6,004,685 A 12/1999 Antoniadis
6,069,452 A * 5/2000 Rossner ..... 315/192
6,133,581 A * 10/2000 Terao ..... H05B 33/26 257/40

(Continued)

FOREIGN PATENT DOCUMENTS

EP 0 597 226 5/1994
EP 0 895 219 2/1999

(Continued)

OTHER PUBLICATIONS

Tokito et al., J. Phys. D: Appl. Phys. (Journal of Physics D: Applied Physics), "Metal Oxides As a Hole-Injecting Layer for an Organic Electroluminescent Device," 1996, vol. 29, pp. 2750-2753.

*Primary Examiner* — Crystal L Hammond
*Assistant Examiner* — David Lotter
(74) *Attorney, Agent, or Firm* — Robinson Intellectual Property Law Office; Eric J. Robinson

(57) ABSTRACT

An object is to solve a problem in that, in a light-emitting device including a plurality of units including a light-emitting element group connected in series, when disconnection is caused, a current does not flow to the whole of the unit and the whole of the unit is in a non-light emitting state. A light-emitting device has a circuit in which a plurality of units each including a light-emitting element group connected in series using a connection wiring group is provided and the plurality of units is connected in parallel. Further, the circuit includes a subsidiary wiring for electrically connecting one of the connection wirings included in one of the units and one of the connection wirings included in another of the units, whereby a countermeasure against disconnection can be taken.

16 Claims, 44 Drawing Sheets

(56) References Cited

U.S. PATENT DOCUMENTS 6,157,127 A * 12/2000 Hosokawa ..... H01L 27/3288 313/506
6,335,713 B1 1/2002 Imai
6,462,722 B1 10/2002 Kimura et al.
6,522,315 B2 2/2003 Ozawa et al.
6,580,223 B2 * 6/2003 Konishi et al. ..... 315/169.3
6,693,296 B1 2/2004 Tyan
6,717,358 B1 4/2004 Liao et al.
6,747,639 B2 6/2004 So
6,803,120 B2 10/2004 Fukuoka et al.
6,839,045 B2 1/2005 Ozawa et al.
6,866,947 B1 3/2005 Fukuoka et al.
6,870,196 B2 3/2005 Strip
6,872,472 B2 3/2005 Liao et al.
7,005,196 B1 2/2006 Carter et al.
7,012,585 B2 3/2006 Agostinelli et al.
7,034,470 B2 4/2006 Cok et al.
7,067,392 B2 6/2006 Yamazaki et al.
7,068,418 B2 6/2006 Kawase
7,109,663 B2 * 9/2006 Fujiwara et al. ..... 315/169.4
7,148,632 B2 12/2006 Berman et al.
7,180,483 B2 2/2007 Kimura et al.
7,199,516 B2 4/2007 Seo et al.
7,202,608 B2 4/2007 Robinson et al.
7,220,997 B2 * 5/2007 Nakata ..... H01L 25/0753 257/81
7,221,339 B2 5/2007 Ozawa et al.
7,253,793 B2 8/2007 Ozawa et al.
7,255,939 B2 8/2007 Carter et al.
7,271,785 B2 9/2007 Jang
7,285,801 B2 10/2007 Eliashevich et al.
7,317,287 B2 1/2008 Blumel
7,322,718 B2 1/2008 Setomoto et al.
7,358,681 B2 4/2008 Robinson et al.
7,420,203 B2 9/2008 Tsutsui et al.
7,420,335 B2 9/2008 Robinson et al.
7,468,580 B2 12/2008 Kawase
7,473,923 B2 1/2009 Tsutsui et al.
7,495,256 B2 2/2009 Yamazaki et al.
7,518,148 B2 4/2009 Liu et al.
7,710,364 B2 5/2010 Ozawa et al.
7,888,864 B2 2/2011 Young
7,956,349 B2 6/2011 Tsutsui et al.
7,956,353 B2 6/2011 Tsutsui et al.
7,999,463 B2 8/2011 Nomura
8,013,335 B2 9/2011 Yamazaki et al.
8,134,153 B2 3/2012 Yamazaki et al.
8,139,005 B2 3/2012 Kawase
8,754,408 B2 6/2014 Sakaguchi
2001/0051207 A1 12/2001 Yamagata et al.
2001/0053462 A1 12/2001 Mishima
2003/0048072 A1 * 3/2003 Ishihara ..... H01L 51/5262 313/506
2003/0113581 A1 6/2003 Gotou
2003/0117348 A1 6/2003 Knapp et al.
2003/0141807 A1 * 7/2003 Kawase ..... H01L 27/3262 313/498
2003/0151360 A1 8/2003 Fukunaga et al.
2003/0170491 A1 9/2003 Liao et al.
2003/0189401 A1 10/2003 Kido et al.
2003/0227253 A1 * 12/2003 Seo ..... H01L 27/3246 313/504
2003/0231273 A1 12/2003 Kimura et al.
2004/0021413 A1 2/2004 Ito et al.
2004/0021425 A1 2/2004 Foust et al.
2004/0031957 A1 2/2004 Tyan
2004/0032220 A1 2/2004 Cok et al.
2004/0042205 A1 3/2004 Tanabe et al.
2004/0149984 A1 8/2004 Tyan et al.
2005/0019606 A1 1/2005 Fukuoka et al.
2005/0029933 A1 2/2005 Liao et al.
2005/0077838 A1 4/2005 Blumel
2005/0129982 A1 6/2005 Fukuoka et al.
2005/0218791 A1 10/2005 Kawase
2005/0225973 A1 * 10/2005 Eliashevich ..... H01L 27/153 362/217.1
2005/0248267 A1 11/2005 Gyoutoku et al.
2005/0253151 A1 * 11/2005 Sakai ..... H01L 33/38 257/79
2006/0273995 A1 12/2006 Ozawa et al.
2006/0273996 A1 12/2006 Ozawa et al.
2007/0134515 A1 6/2007 Fukuoka et al.
2007/0182317 A1 8/2007 Kido et al.
2007/0184302 A1 * 8/2007 Iwawaki ..... C09K 11/06 428/690
2008/0001512 A1 * 1/2008 Nomura ..... 313/307
2008/0224606 A1 * 9/2008 Kawai ..... H01L 27/3204 313/504
2008/0246704 A1 10/2008 Kawase
2009/0179561 A1 7/2009 Fukuoka et al.
2010/0207849 A1 * 8/2010 Cok ..... G09G 3/2088 345/76
2011/0037054 A1 * 2/2011 Shieh ..... H01L 27/3204 257/40
2011/0089814 A1 4/2011 Nomura
2011/0089823 A1 4/2011 Nomura
2011/0101388 A1 5/2011 Nomura
2011/0140617 A1 6/2011 Nomura
2011/0227119 A1 9/2011 Tsutsui et al.
2011/0227125 A1 9/2011 Tsutsui et al.
2012/0126234 A1 5/2012 Yamazaki et al.
2013/0292672 A1 11/2013 Nomura

FOREIGN PATENT DOCUMENTS

EP 0 917 127 5/1999
EP 1 255 240 11/2002
EP 1 336 953 8/2003
EP 1 337 131 8/2003
EP 1 359 789 11/2003
EP 1 363 265 11/2003
EP 1 388 894 2/2004
EP 1 408 563 4/2004
EP 1460884 A 9/2004
EP 1 619 654 1/2006
EP 2 299 779 3/2011
EP 2 299 780 3/2011
EP 2 299 781 3/2011
EP 2 299 782 3/2011
EP 2535959 A 12/2012
FR 2058160 5/1971
JP 06-207170 7/1994
JP 07-142169 6/1995
JP 11-307261 11/1999
JP 11-329734 11/1999
JP 2000-029404 1/2000
JP 2002-132218 5/2002
JP 2003-297573 10/2003
JP 2004-069774 3/2004
JP 2004-090858 A 3/2004
JP 2004-234868 8/2004
JP 2004-288632 A 10/2004
JP 2006-108651 4/2006
JP 2008-504654 2/2008
JP 2008-535240 8/2008
JP 2010-140644 A 6/2010
WO WO 00/36662 6/2000
WO WO 03/037040 5/2003
WO WO-2006/002519 1/2006
WO WO 2006/030719 A1 3/2006
WO WO-2006/104544 10/2006
WO WO-2011/142248 11/2011

* cited by examiner

Prior Art

LIGHT-EMITTING DEVICE

BACKGROUND OF THE INVENTION

1. Field of the Invention

The technical field of the present invention relates to a light-emitting device (particularly, a lighting device).

2. Description of the Related Art

Patent Document 1 discloses a light-emitting device including a circuit in which light-emitting element groups connected in series are connected in parallel.

REFERENCE

[Patent Document 1] Japanese Published Patent Application No. 2006-108651

SUMMARY OF THE INVENTION

FIGS. 44A and 44B illustrate an example of a conventional technique.

In the circuit in FIGS. 44A and 44B, a first unit in which a light-emitting element 10011, a light-emitting element 10021, and a light-emitting element 10031 are connected in series, a second unit in which a light-emitting element 10012, a light-emitting element 10022, and a light-emitting element 10032 are connected in series, and a third unit in which a light-emitting element 10013, a light-emitting element 10023, and a light-emitting element 10033 are connected in series are provided, and the first unit, the second unit, and the third unit are connected in parallel.

Then, the first unit, the second unit, and the third unit are electrically connected to a power source 11000.

Here, as illustrated in FIG. 44B, when disconnection is caused at a portion shown by a dashed line 18000, a first object arises in that a current does not flow to the first unit and the whole of the first unit (the light-emitting elements 10011, 10021, and 10031) is in a non-light emitting state.

Further, when factors that cause a disconnection of a lower electrode (a lower wiring) and factors that cause a disconnection of an upper electrode (an upper wiring) are considered, since many steps exist under the upper electrode (the upper wiring), there is a second object in that the upper electrode (the upper wiring) is likely to be disconnected due to the steps.

In view of the above, structures for solving the above objects are disclosed below.

Note that the invention to be disclosed below achieves at least one of the first object and the second object.

A light-emitting device has a circuit in which a plurality of units each including a light-emitting element group connected in series using a connection wiring group is provided and the plurality of units are connected in parallel. Further, the light-emitting device includes a subsidiary wiring for electrically connecting one of the connection wirings included in one of the units and one of the connection wirings included in another of the units, whereby a countermeasure against disconnection can be taken and the first object can be achieved.

Further, a light-emitting device has a circuit in which a plurality of units each including a light-emitting element group connected in series in a row direction using a connection wiring group is provided and the plurality of units is connected in parallel in a column direction. Further, when a subsidiary wiring group for electrically connecting one of the connection wirings included in one of the units and one of the connection wirings included in each of the others of the units in every column is provided, an effect of countermeasures against disconnection can be improved.

Further, a conductive layer formed by a wet method may be provided over the upper electrode of the light-emitting element, whereby the second object can be achieved.

In this specification, the adjective, a "plurality of" is synonymous with the noun, "group".

For example, a "plurality of light-emitting elements" is synonymous with a "light-emitting element group".

That is, an example of the invention to be disclosed is a light-emitting device having a circuit in which a plurality of units each including a light-emitting element group connected in series using a first wiring group is provided and the plurality of units is connected in parallel. Further, the circuit includes a second wiring for electrically connecting one of the first wirings included in one of the units and one of the first wirings included in another of the units.

Another example of the invention to be disclosed is a light-emitting device having a circuit in which a plurality of units each including a light-emitting element group connected in series in a row direction using a first wiring group is provided and the plurality of units is connected in parallel in a column direction. Further, the circuit includes a second wiring group for electrically connecting one of the first wirings included in one of the units and one of the first wirings included in each of the others of the units in every column.

Another example of the invention to be disclosed is a light-emitting device having a circuit in which a plurality of units each including a light-emitting element group connected in series using a first wiring group is provided and the plurality of units is connected in parallel. Further, the circuit includes a second wiring and a third wiring for electrically connecting one of the first wirings included in one of the units and one of the first wirings included in another of the units.

Another example of the invention to be disclosed is a light-emitting device having a circuit in which a plurality of units each including a light-emitting element group connected in series in a row direction using a first wiring group is provided and the plurality of units is connected in parallel in a column direction. Further, the circuit includes a second wiring group and a third wiring group for electrically connecting one of the first wirings included in one of the units and one of the first wirings included in each of the others of the units in every column.

In addition, it is preferable that the light-emitting element include a lower electrode, a light-emitting body layer provided over the lower electrode, and an upper electrode provided over the light-emitting body layer. Further, it is preferable that the second wiring be formed in the same layer as the lower electrode and the third wiring be formed in the same layer as the upper electrode.

In addition, it is preferable that a fourth wiring be provided over the upper electrode.

In addition, it is preferable that the fourth wiring include a conductive layer formed by a wet method.

In addition, it is preferable that the fourth wiring have a stack structure of a conductive layer formed by a wet method and an auxiliary wiring over the conductive layer.

In a light-emitting device having a circuit in which a plurality of units each including a light-emitting element group connected in series using a connection wiring group is provided and the plurality of units are connected in parallel, a subsidiary wiring for connecting one of the units and another of the units electrically is provided, whereby a current path can be secured at a portion other than one of the units.

Then, a current path is secured at a portion other than one of the units, whereby even a problem in that when disconnection is caused in one of the units, the whole of one of the units is in a non-light emitting state, can be solved.

Further, a conductive layer formed by a wet method may be provided over the upper electrode of a light-emitting element, whereby when the upper electrode is disconnected or a pinhole is generated in the upper electrode, the disconnected portion or the portion where the pinhole is generated can be filled.

DETAILED DESCRIPTION OF THE INVENTION

Figure 1A:
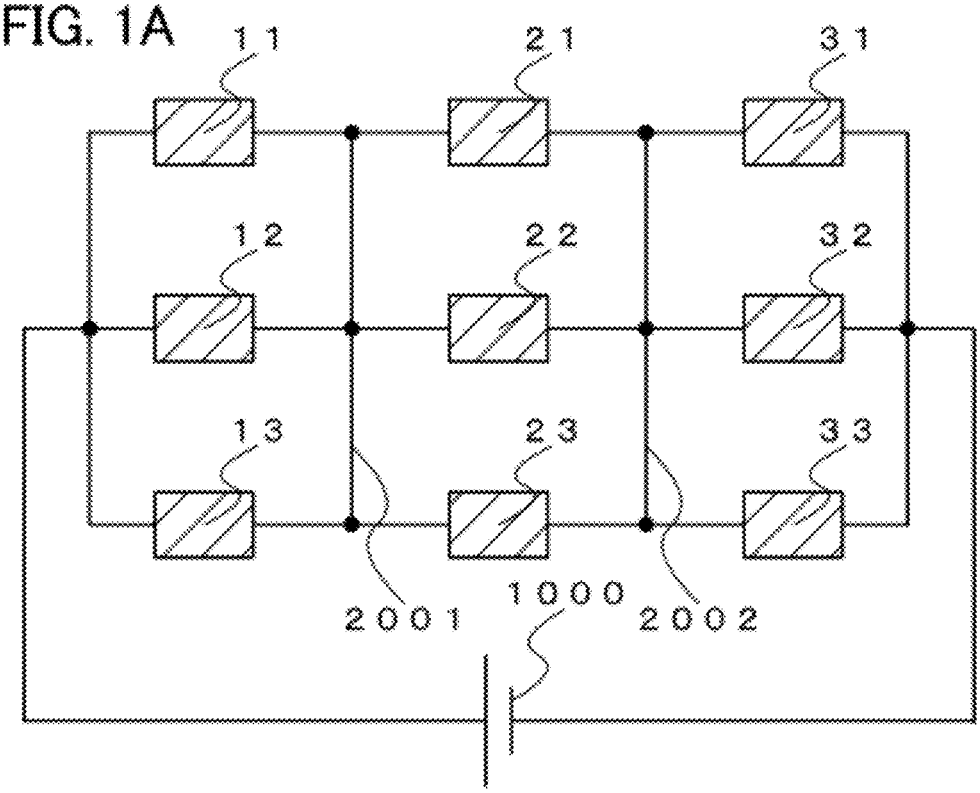
FIGS. 1A and 1B illustrate an example of a circuit provided in a light-emitting device.

Embodiments will be described in detail with reference to the drawings.

It is easily understood by those skilled in the art that modes and details thereof can be modified in various ways without departing from the spirit and scope of the present invention.

Therefore, the present invention should not be interpreted as being limited to what is described in the embodiments described below.

In the structures to be given below, the same portions or portions having similar functions are denoted by the same reference numerals in different drawings, and explanation thereof will not be repeated.

The following embodiments can be combined with each other, as appropriate.

(Embodiment 1)

A circuit in which n units each including m light-emitting elements connected in series in a row direction using a connection wiring group are provided and the n units are connected in parallel in a column direction will be described. Note that a connection wiring is a wiring for connecting two adjacent light-emitting elements electrically.

In addition, m and n are each a natural number of 2 or more.

FIG. 1A illustrates an example of a circuit provided in a light-emitting device.

Note that FIG. 1A shows an example in which m and n are each 3.

In the circuit in FIG. 1A, a first unit in which a light-emitting element 11, a light-emitting element 21, and a light-emitting element 31 are connected in series using a first connection wiring group, a second unit in which a light-emitting element 12, a light-emitting element 22, and a light-emitting element 32 are connected in series using a second connection wiring group, and a third unit in which a light-emitting element 13, a light-emitting element 23, and a light-emitting element 33 are connected in series using a third connection wiring group, are provided, and the first unit, the second unit, and the third unit are connected in parallel.

Then, the first unit, the second unit, and the third unit are electrically connected to a power source 1000.

Furthermore, the circuit in FIG. 1A includes a plurality of subsidiary wirings (a wiring 2001, a wiring 2002, and the like) for connecting the first connection wiring group, the second connection wiring group, and the third connection wiring group electrically in every column.

Here, a terminal of the light-emitting element connected on the positive side of the power source 1000 is referred to as a first terminal and a terminal of the light-emitting element connected on the negative side of the power source 1000 is referred to as a second terminal.

Note that in a structure which a plurality of units is connected in parallel, input portions of the units (one of a first terminal located at one end on the positive side of a light-emitting element group or a second terminal located at one end on the negative side of the light-emitting element group) are all electrically connected and output portions of the units (the other of the first terminal located at one end on the positive side of the light-emitting element group or the second terminal located at one end on the negative side of the light-emitting element group) are all connected electrically.

Then, the wiring 2001 connects electrically the second terminal of the light-emitting element 11, the second terminal of the light-emitting element 12, and the second terminal of the light-emitting element 13, which are arranged in the column direction.

In addition, the wiring 2001 connects electrically the first terminal of the light-emitting element 21, the first terminal of the light-emitting element 22, and the first terminal of the light-emitting element 23, which are provided in the column direction.

Further, the wiring 2002 connects electrically the second terminal of the light-emitting element 21, the second terminal of the light-emitting element 22, and the second terminal of the light-emitting element 23, which are provided in the column direction.

In addition, the wiring 2002 connects electrically the first terminal of the light-emitting element 31, the first terminal of the light-emitting element 32, and the first terminal of the light-emitting element 33, which are provided in the column direction.

In other words, it can be also said that, the second terminal of the light-emitting element 11, the second terminal of the light-emitting element 12, and the second terminal of the light-emitting element 13 are electrically connected to the first terminal of the light-emitting element 21, the first terminal of the light-emitting element 22, and the first terminal of the light-emitting element 23, through the wiring 2001.

Further, it can be also said that the second terminal of the light-emitting element 21, the second terminal of the light-emitting element 22, and the second terminal of the light-emitting element 23 are electrically connected to the first terminal of the light-emitting element 31, the first terminal of the light-emitting element 32, and the first terminal of the light-emitting element 33, through the wiring 2002.

Figure 1B:
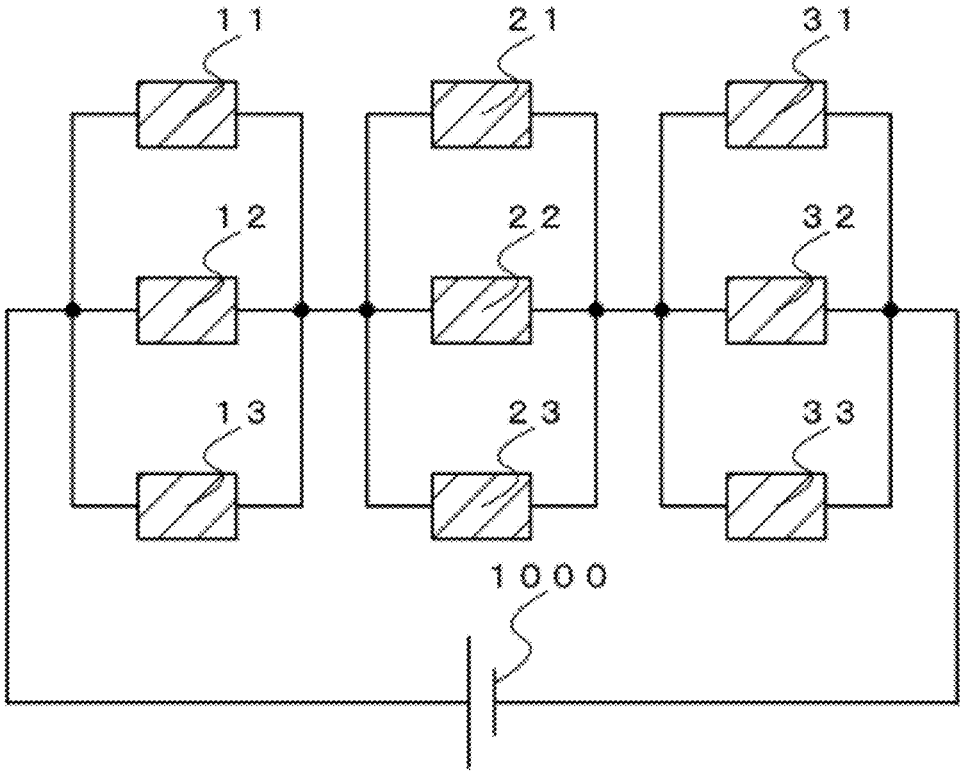

Furthermore, FIG. 1B illustrates an equivalent circuit of FIG. 1A.

In the circuit in FIG. 1B, a fourth unit in which a light-emitting element 11, a light-emitting element 12, and a light-emitting element 13 are connected in parallel, a fifth unit in which a light-emitting element 21, a light-emitting element 22, and a light-emitting element 23 are connected in parallel, and a sixth unit in which a light-emitting element 31, a light-emitting element 32, and a light-emitting element 33 are connected in parallel, are provided, and the fourth unit, the fifth unit, and the sixth unit are connected in series.

Here, in FIG. 1B, when the number of wirings by which the fourth unit and the fifth unit are connected in series is increased (subsidiary wirings are provided) and the number of wirings by which the fifth unit and the sixth unit are connected in series is increased (subsidiary wirings are provided), FIG. 1B becomes an equivalent of FIG. 1A.

Therefore, it can be also said that, in the circuit in FIG. 1A, the plurality of units each including the light-emitting element group connected in parallel is connected in series.

Figure 44A:
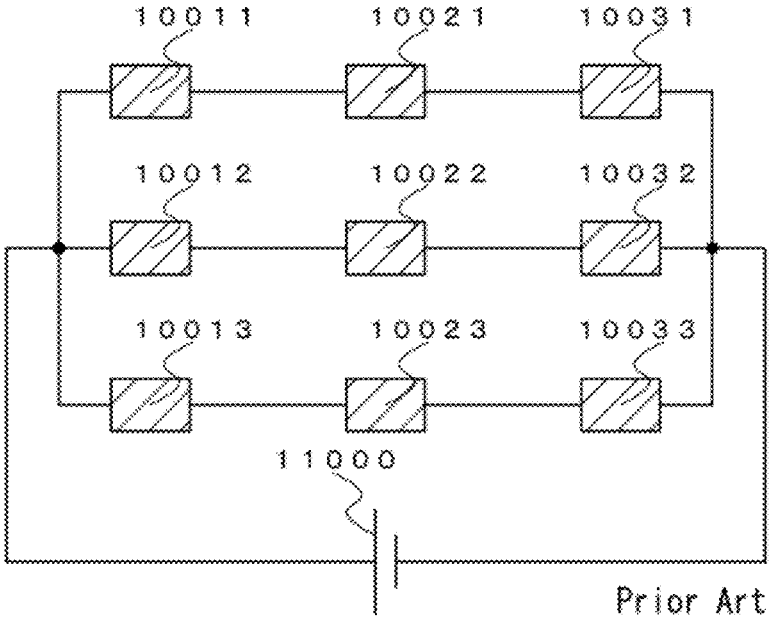
FIGS. 44A and 44B illustrate an example of a conventional technique.

Here, a conventional circuit in FIG. 44A and the circuit in FIG. 1B are compared.

In the circuit in FIG. 44A, a first unit in which a light-emitting element 10011, a light-emitting element 10021, and a light-emitting element 10031 are connected in series, a second unit in which a light-emitting element 10012, a light-emitting element 10022, and a light-emitting element 10032 are connected in series, and a third unit in which a light-emitting element 10013, a light-emitting element 10023, and a light-emitting element 10033 are connected in series, are provided, and the first unit, the second unit, and the third unit are connected in parallel.

In the circuit in FIG. 1B, a fourth unit in which a light-emitting element 11, a light-emitting element 12, and a light-emitting element 13 are connected in parallel, a fifth unit in which a light-emitting element 21, a light-emitting element 22, and a light-emitting element 23 are connected in parallel, and a sixth unit in which a light-emitting element 31, a light-emitting element 32, and a light-emitting element 33 are connected in parallel, are provided, and the fourth unit, the fifth unit, and the sixth unit are connected in series.

In FIG. 44A, when a value of current supplied from a power source 11000 is I, since the first unit, the second unit, and the third unit are connected in parallel, the value of current flowing through each of the first unit, the second unit, and the third unit is I/3.

Then, in FIG. 44A, since the light-emitting element groups in the first unit, the second unit, and the third unit are connected in series, the value of current flowing through each of the light-emitting elements is also I/3.

On the other hand, in FIG. 1B, when a value of current supplied from a power source 1000 is I, since the fourth unit, the fifth unit, and the sixth unit are connected in series, the value of current flowing through each of the fourth unit, the fifth unit, and the sixth unit is I.

Then, in FIG. 1B, since the light-emitting element groups in the fourth unit, the fifth unit, and the sixth unit are connected in parallel, the value of current flowing through each of the light-emitting elements is I/3.

Here, in the circuits of FIG. 44A and FIG. 1B, since three light-emitting elements are provided in the row direction and three light-emitting elements are provided in the column direction, the value of current flowing through each of the light-emitting elements is I/3; however, in a circuit where m light-emitting elements are provided in the row direction and n light-emitting elements are provided in the column direction (m and n are each a natural number of 2 or more), the value of current flowing through each of the light-emitting elements is I/n.

Then, when a resistance value of the light-emitting element is R, since a value of current flowing through the light-emitting element is I/n regardless of whether or not a subsidiary wiring is provided, a value of voltage applied to each of the light-emitting elements is IR/n.

That is, a value of current flowing through each of the light-emitting elements and a value of voltage applied to each of the light-emitting elements are not changed by adding a subsidiary wiring.

Accordingly, luminance of the light-emitting element is substantially not changed by adding a subsidiary wiring.

Figure 2A:
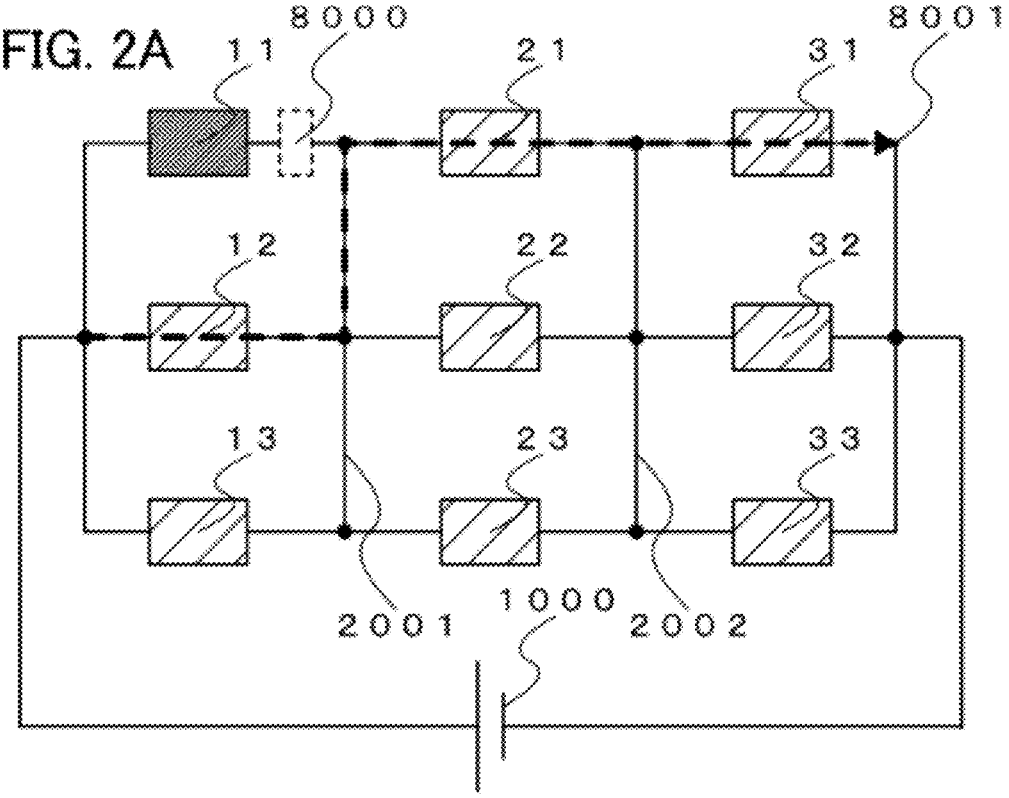
FIGS. 2A and 2B illustrate an example of a circuit provided in a light-emitting device.
Figure 2B:
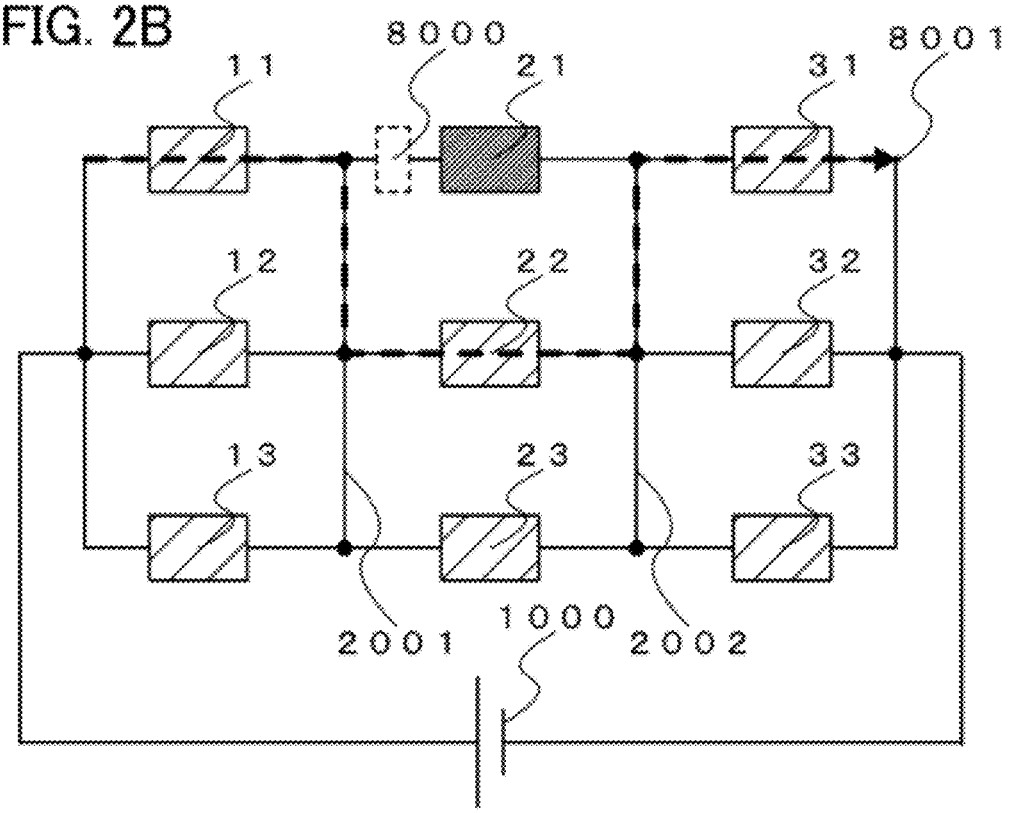

Next, FIGS. 2A and 2B illustrate an effect in the case where a subsidiary wiring is provided.

FIG. 2A illustrates an example in which disconnection is caused between the wiring 2001 and the light-emitting element 11 in FIG. 1A as shown by a dashed line 8000.

In FIG. 2A, when a portion shown by the dashed line 8000 is disconnected, since a current flows through a current path 8001 via the first unit and the second unit, the light-emitting element 21 and the light-emitting element 31 in the first unit emit light.

That is, a non-light emitting element can be limited to only the light-emitting element 11.

FIG. 2B illustrates an example in which disconnection is caused between the wiring 2001 and the light-emitting element 21 in FIG. 1A as shown by a dashed line 8000.

In FIG. 2B, when a portion shown by the dashed line 8000 is disconnected, since a current flows through a current path 8001 via the first unit and the second unit, the light-emitting element 11 and the light-emitting element 31 in the first unit emit light.

That is, a non-light emitting element can be limited to only the light-emitting element 21.

As described above, although a light-emitting element which is in a non-light emitting state is different by a disconnected portion, by providing a subsidiary wiring, a problem in that the whole of a unit including a light-emitting element group connected in series is in a non-light emitting state does not occur.

This embodiment can be implemented in combination with any of the other embodiments as appropriate.

(Embodiment 2)

A subsidiary wiring may be formed using part of the materials of a light-emitting element, whereby the materials and the number of steps can be reduced, which is preferable.

FIGS. 3A and 3B, FIGS. 4A and 4B, and FIGS. 5A and 5B are conceptual diagrams of the case where the subsidiary wirings in FIG. 1A are formed using part of the materials of the light-emitting elements.

Here, an electrode of the light-emitting element connected on the positive side of a power source 1000 is referred to as a first electrode and an electrode of the light-emitting element connected on the negative side of the power source 1000 is referred to as a second electrode.

Figure 3A:
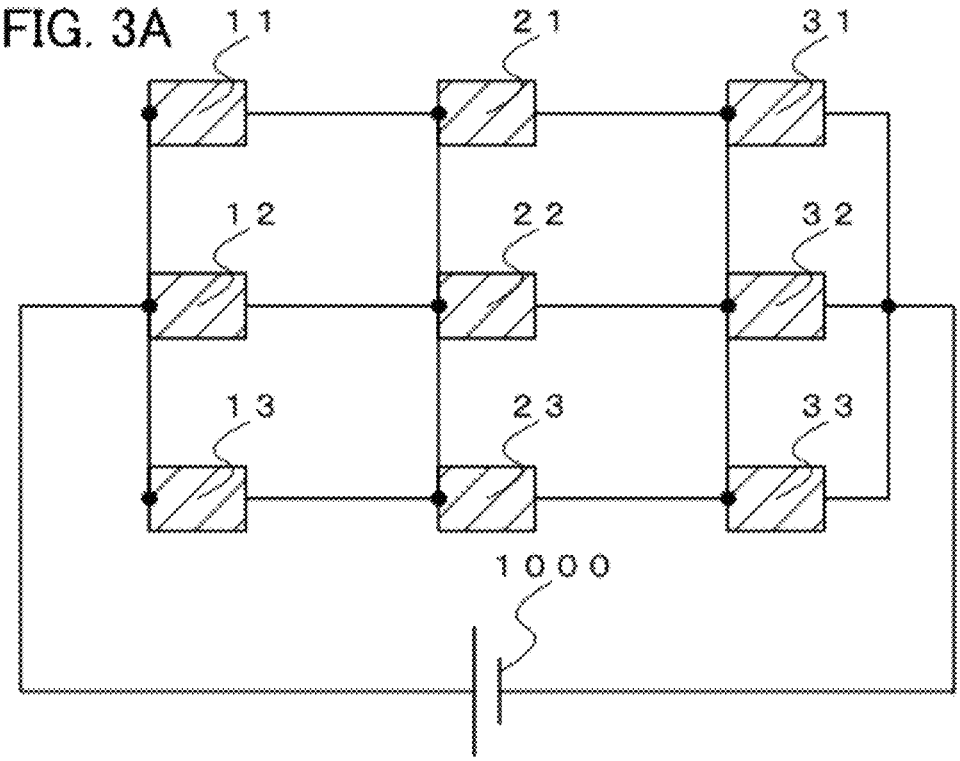
FIGS. 3A and 3B illustrate an example of a circuit provided in a light-emitting device.
Figure 3B:
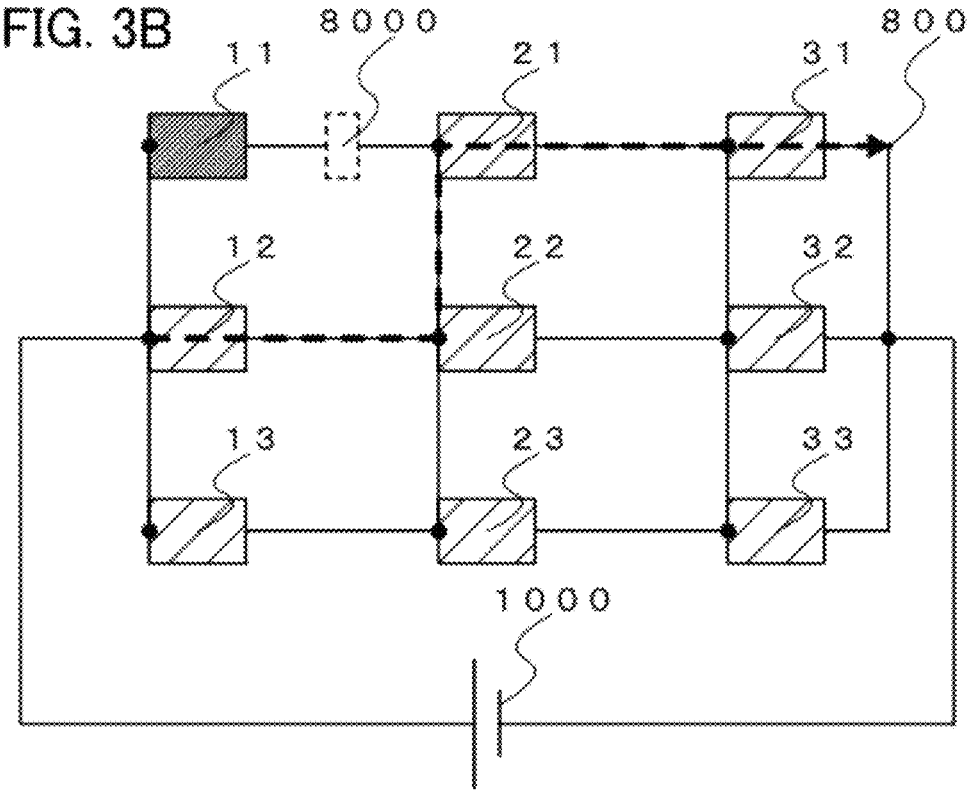

FIGS. 3A and 3B are conceptual diagrams of the case where a first electrode is used in common among a light-emitting element group provided in the column direction.

That is, a first electrode group provided in the column direction is electrically connected by using a subsidiary wiring which is the same layer as the first electrodes.

Note that the expression "two layers (one layer and another layer, one electrode and another electrode, one wiring and another wiring, one electrode and one layer, one electrode and one wiring, one wiring and one layer, or the like) are the same layer" means that the two layers (one layer and another layer, one electrode and another electrode, one wiring and another wiring, one electrode and one layer, one electrode and one wiring, one wiring and one layer, or the like) are formed through the same process.

Further, the expression "two layers (one layer and another layer, one electrode and another electrode, one wiring and another wiring, one electrode and one layer, one electrode and one wiring, one wiring and one layer, or the like) are different layers" means that the two layers (one layer and another layer, one electrode and another electrode, one wiring and another wiring, one electrode and one layer, one electrode and one wiring, one wiring and one layer, or the like) are formed through different processes.

As illustrated in FIG. 3B, when a portion shown by a dashed line 8000 is disconnected, since a current flows through a current path 8001 via a first unit and a second unit, a light-emitting element 21 and a light-emitting element 31 in the first unit emit light.

That is, a non-light emitting element can be limited to only a light-emitting element 11.

Figure 4A:
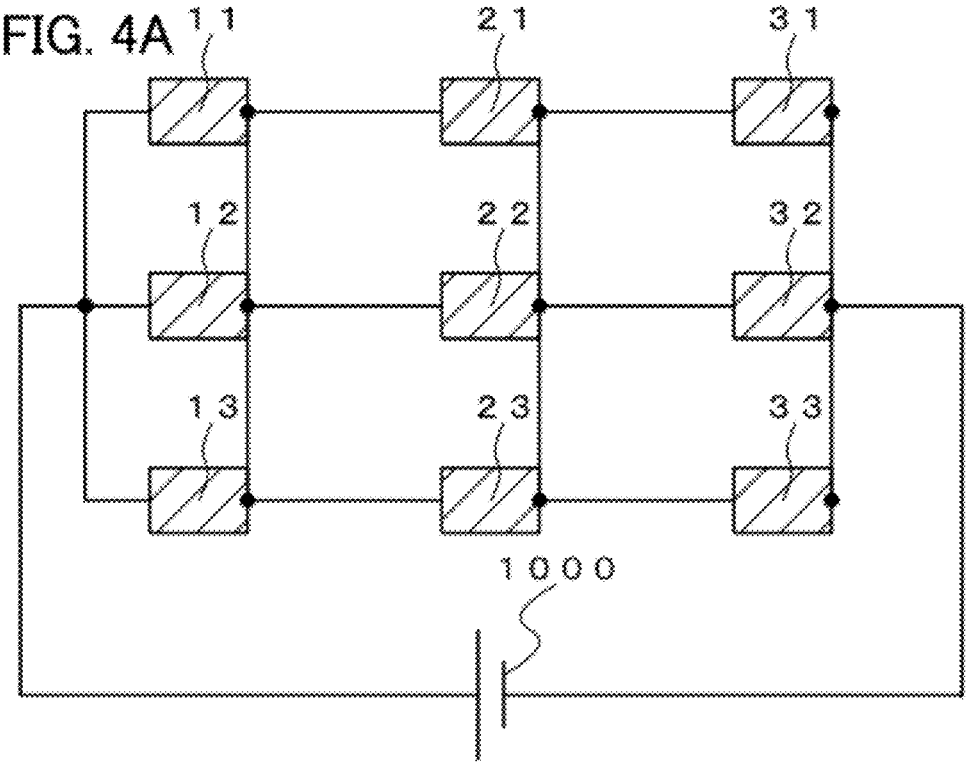
FIGS. 4A and 4B illustrate an example of a circuit provided in a light-emitting device.
Figure 4B:
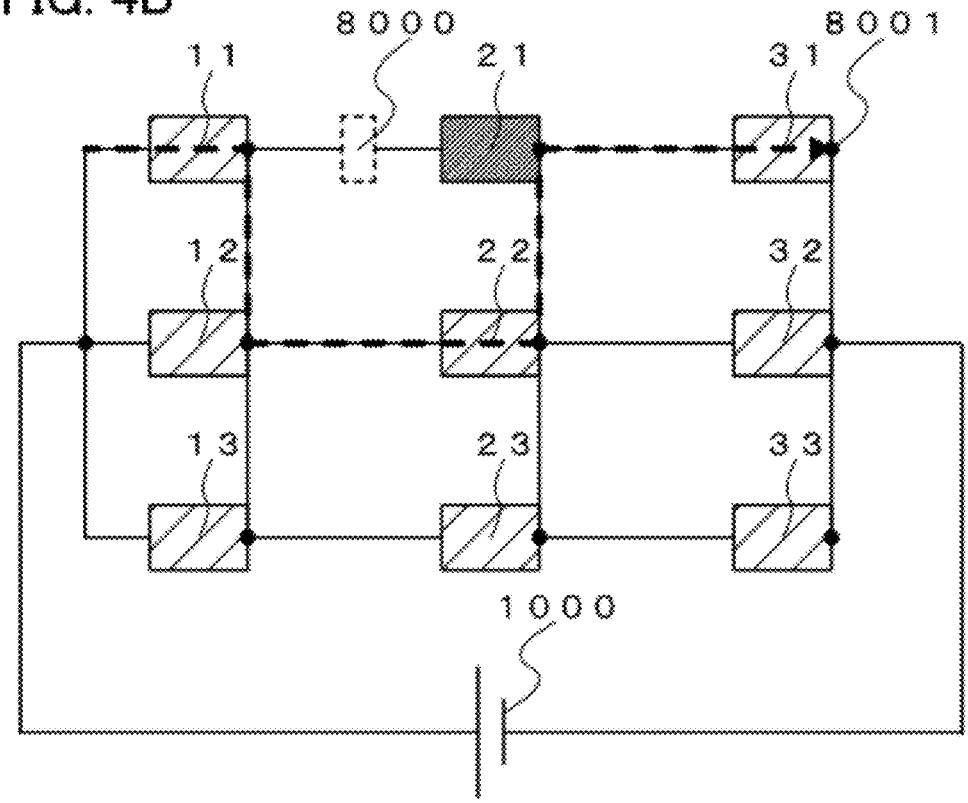

FIGS. 4A and 4B are conceptual diagrams of the case where a second electrode is used in common among a light-emitting element group provided in the column direction.

That is, a second electrode group provided in the column direction is electrically connected by using a subsidiary wiring which is the same layer as the second electrodes.

As illustrated in FIG. 4B, when a portion shown by the dashed line 8000 is disconnected, since a current flows through a current path 8001 via a first unit and a second unit, a light-emitting element 11 and a light-emitting element 31 in the first unit emit light.

That is, a non-light emitting element can be limited to only a light-emitting element 21.

Figure 5A:
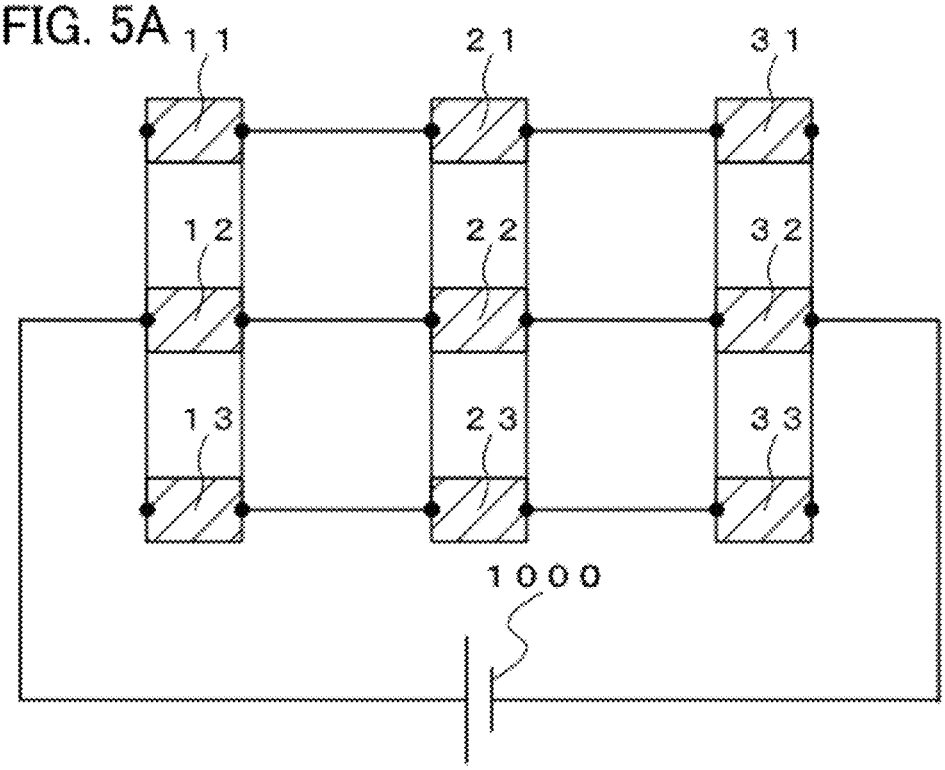
FIGS. 5A and 5B illustrate an example of a circuit provided in a light-emitting device.
Figure 5B:
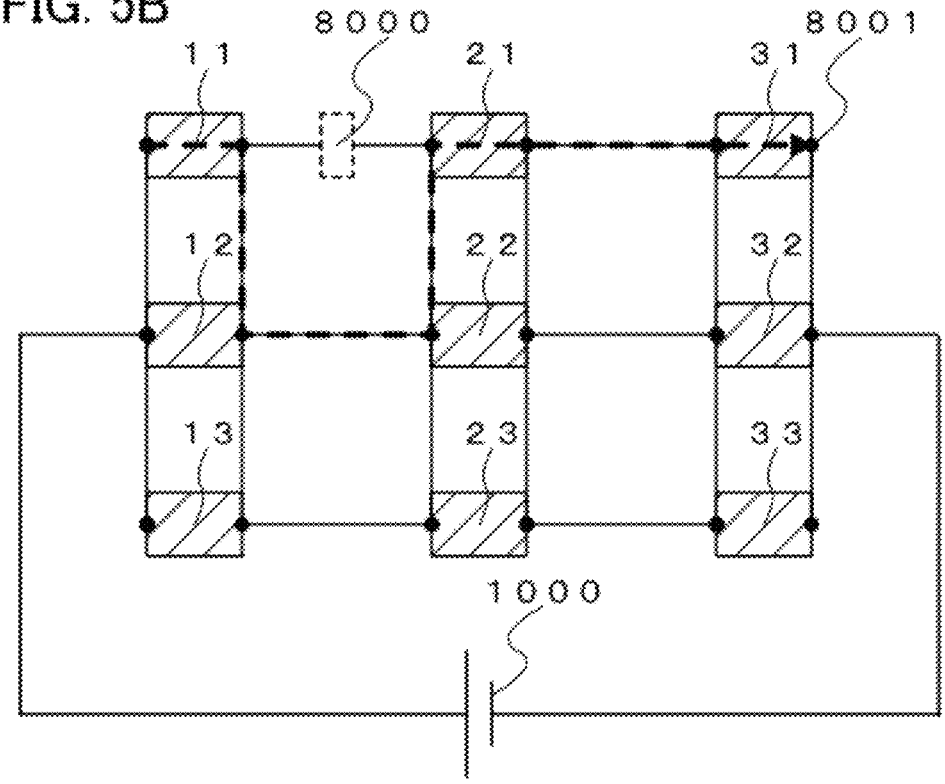

FIGS. 5A and 5B are conceptual diagrams of the case where a first electrode is used in common among a light-emitting element group provided in the column direction and a second electrode is used in common among the light-emitting element group provided in the column direction.

That is, a first electrode group provided in the column direction is electrically connected by using a subsidiary wiring which is the same layer as the first electrodes and a second electrode group provided in the column direction is electrically connected by using a subsidiary wiring which is the same layer as the second electrodes.

As illustrated in FIG. 5B, when a portion shown by a dashed line 8000 is disconnected, since a current flows through a current path 8001 via a first unit and a second unit, a light-emitting element 11, a light-emitting element 21, and a light-emitting element 31 in the first unit emit light.

That is, by providing subsidiary wirings in different layers (the same layer as the first electrode and the same layer as the second electrode), even when disconnection is caused between two light-emitting elements provided in the row direction, the light-emitting elements can be prevented from being in a non-light emitting state.

That is, by providing subsidiary wirings in different layers, an effect of countermeasures against disconnection is further improved.

Figure 6:
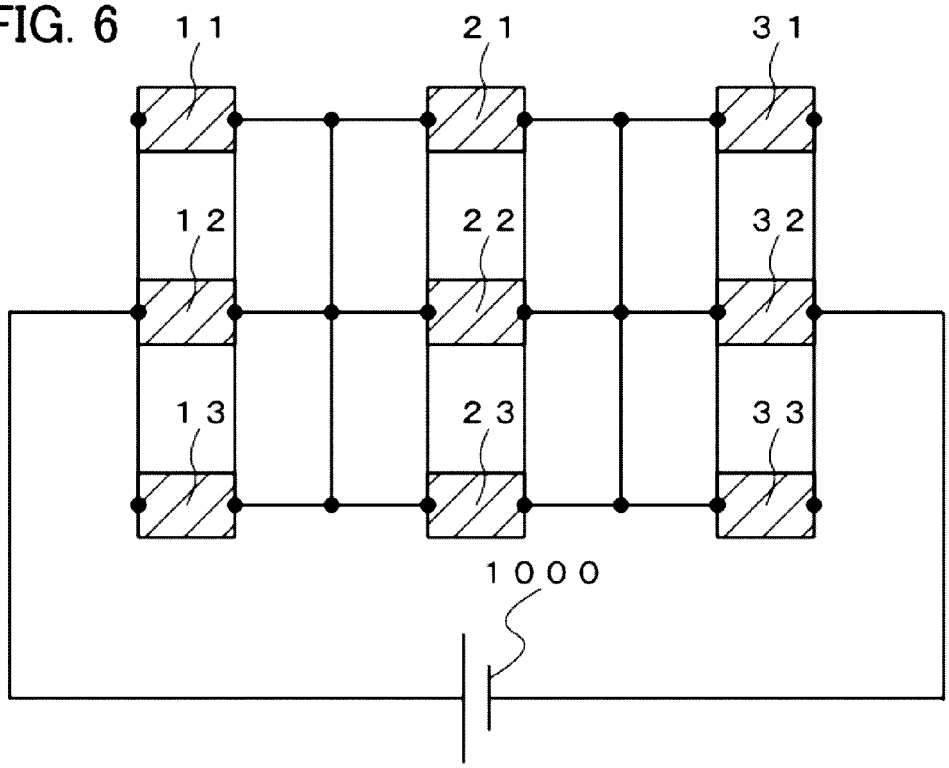
FIG. 6 illustrates an example of a circuit provided in a light-emitting device.

In addition, although the number of steps increases, as illustrated in FIG. 6, when subsidiary wirings in a different layer from both a first electrode and a second electrode are provided, an effect of countermeasures against disconnection is further improved.

That is, the subsidiary wirings may be provided in three or more kinds of different layers.

Examples of a layer different from the first electrode and the second electrode can be given as below.

When one of the first electrode and the second electrode is a lower electrode, for example, an interlayer insulating film may be provided under the lower electrode and a subsidiary wiring may be provided under the interlayer insulating film, so that the subsidiary wiring and the lower electrode are connected in parallel.

When one of the first electrode and the second electrode is an upper electrode, for example, a subsidiary wiring in which a conductive layer formed by a wet method and an auxiliary wiring are sequentially stacked may be provided over the upper electrode.

This embodiment can be implemented in combination with any of the other embodiments as appropriate.

(Embodiment 3)

FIG. 1A illustrates an example in which subsidiary wirings are provided so that each of a first light-emitting element group provided in the column direction is electrically connected to an adjacent second light-emitting element group provided in the column direction.

However, one embodiment of the present invention is not limited to the structure in FIG. 1A and an effect of countermeasures against disconnection can be obtained as long as at least one subsidiary wiring for connecting one unit and another unit electrically is provided.

Figure 7A:
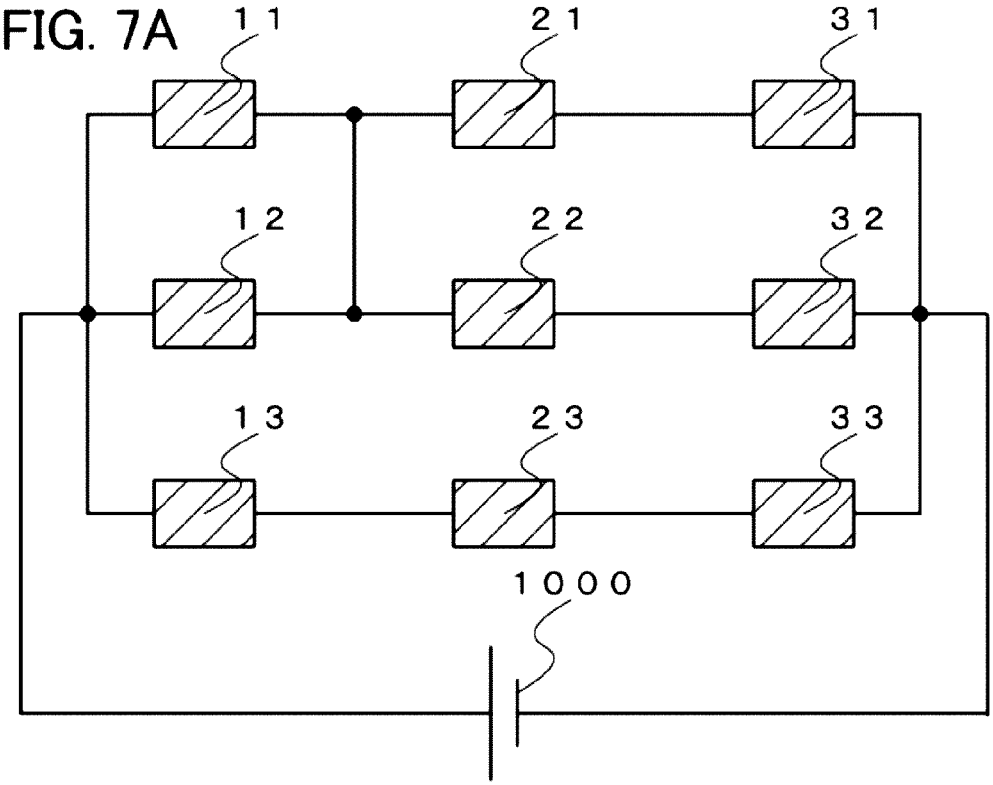
FIGS. 7A and 7B illustrate an example of a circuit provided in a light-emitting device.

Specifically, as illustrated in FIG. 7A, one subsidiary wiring for connecting a second terminal of a light-emitting element 11 and a first terminal of a light-emitting element 22 electrically may be provided.

In the case of FIG. 7A, for example, even when disconnection is caused in a first unit (a structure in which the light-emitting element 11, a light-emitting element 21, and a light-emitting element 31 are connected in series), any of the light-emitting elements in the first unit emits light; therefore, a problem in that the whole of the first unit is in a non-light emitting state can be avoided.

Figure 7B:
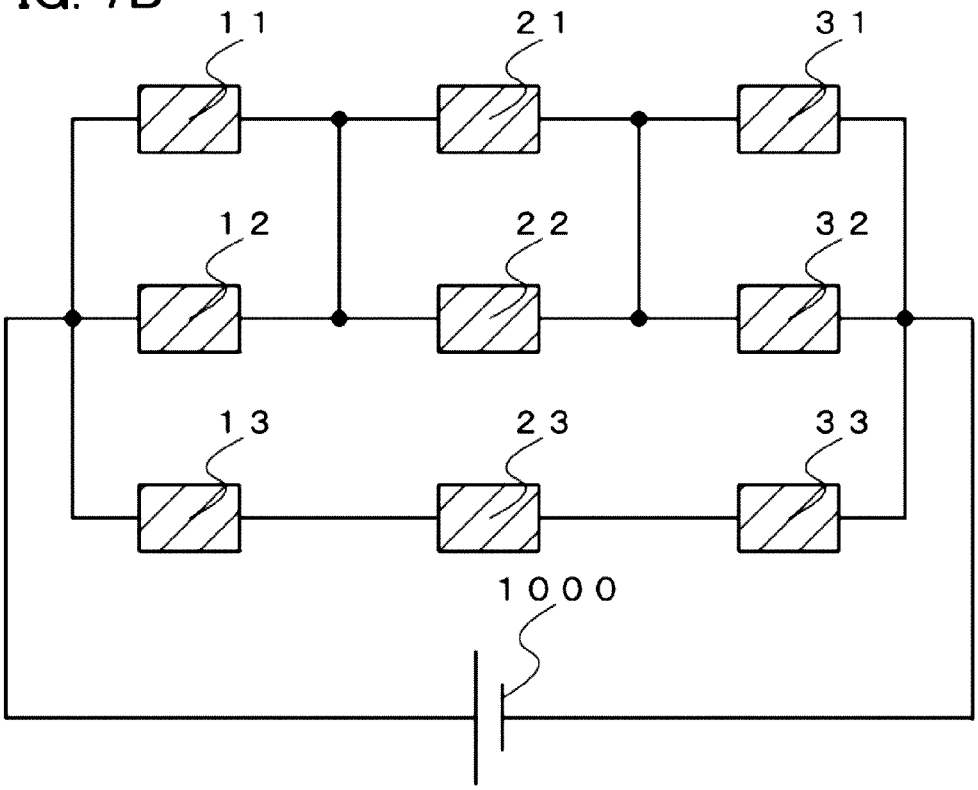

Further, in FIG. 7B, one subsidiary wiring is added to the structure in FIG. 7A, and a subsidiary wiring between a light-emitting element 11 and a light-emitting element 21 and a subsidiary wiring between the light-emitting element 21 and a light-emitting element 31 are provided.

In FIG. 7B, a first unit and a second unit are electrically connected using two subsidiary wirings; therefore, a current path where the current flows in the order of the first unit, the second unit, and the first unit is secured.

On the other hand, in FIG. 7A, a current path where the current flows only in the order of the first unit and the second unit is secured.

Accordingly, in the structure in FIG. 7B, in which the current flowing through the second unit returns to the first unit, the number of current paths can be increased as compared to the structure in FIG. 7A; therefore, a higher effect of countermeasures against disconnection is obtained.

As described above, an effect of countermeasures against disconnection can be obtained as long as at least one subsidiary wiring is provided.

Further, as the number of subsidiary wirings increases, the number of current paths can be increased; therefore, an effect of countermeasures against disconnection can be improved.

This embodiment can be implemented in combination with any of the other embodiments as appropriate.

(Embodiment 4)

In FIG. 1A, FIG. 7A, and the like, examples in which a subsidiary wiring is provided in the same column are illustrated.

Figure 8A:
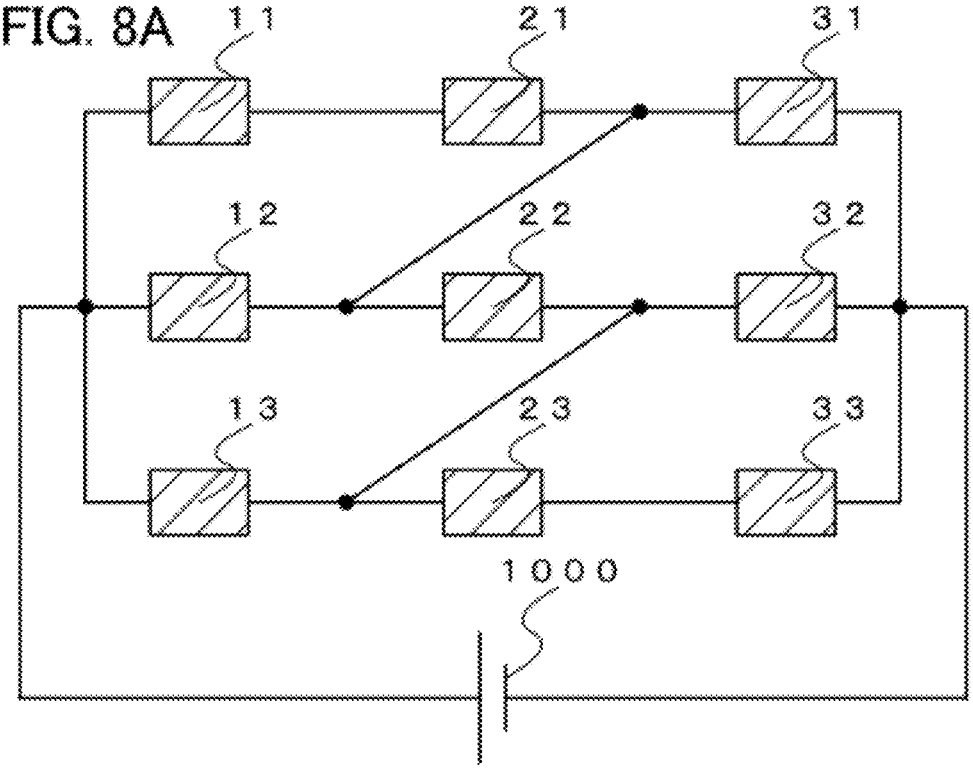
FIGS. 8A and 8B illustrate an example of a circuit provided in a light-emitting device.

On the other hand, as illustrated in FIG. 8A, a subsidiary wiring may be provided in different columns.

Further, in FIG. 1A, FIG. 7A, and the like, examples in which the number of light-emitting elements provided in each row is the same are illustrated.

Figure 8B:
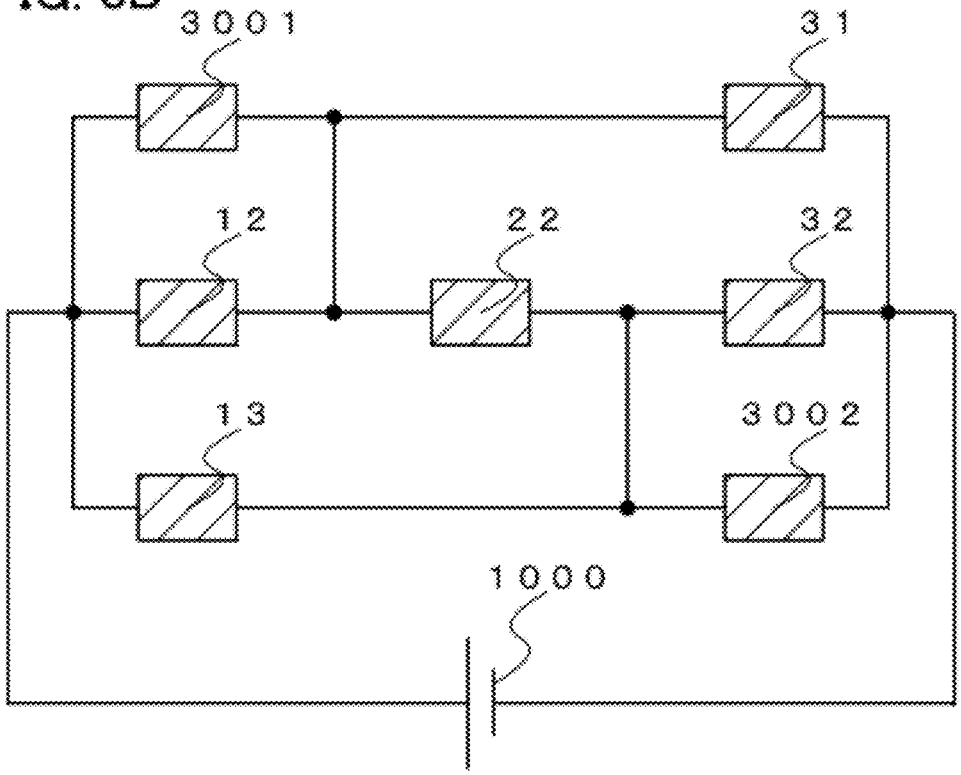

On the other hand, as illustrated in FIG. 8B, the number of light-emitting elements provided in each row may be different.

In FIG. 8B, a light-emitting element 3001 and a light-emitting element 31 are provided in a first row (a first unit) and a light-emitting element 12, a light-emitting element 22, and a light-emitting element 32 are provided in a second row (a second unit). Further, a light-emitting element 13 and a light-emitting element 3002 are provided in a third row (a third unit).

Note that when the light-emitting element 3001 in FIG. 8B is replaced with the structure in which a light-emitting element 11 and a light-emitting element 21 in FIG. 8A are connected in series and the light-emitting element 3002 in FIG. 8B is replaced with the structure in which a light-emitting element 23 and a light-emitting element 33 in FIG. 8A are connected in series, FIG. 8B is the same circuit as FIG. 8A.

This embodiment can be implemented in combination with any of the other embodiments as appropriate.

(Embodiment 5)

Figure 9:
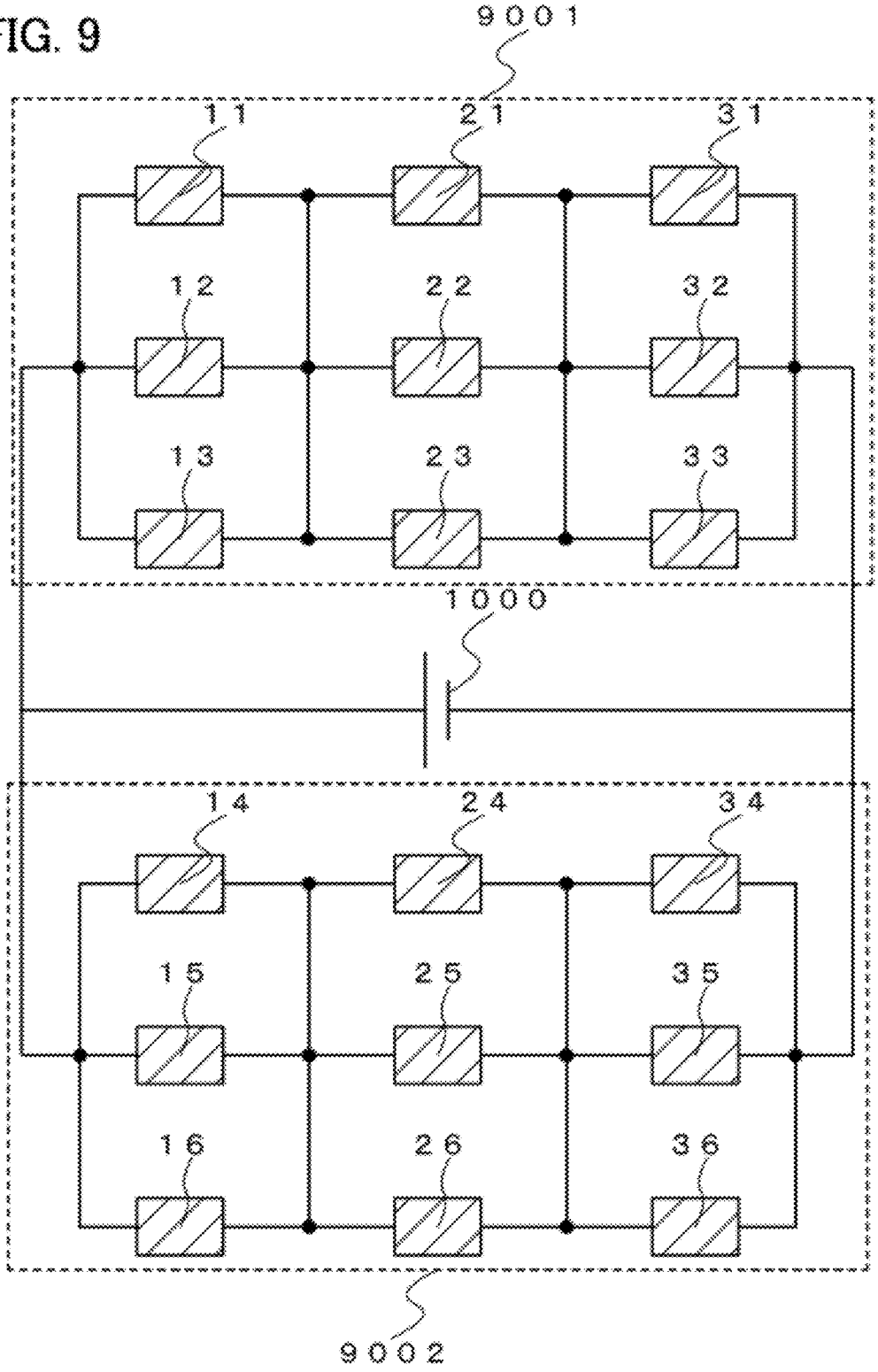
FIG. 9 illustrates an example of a circuit provided in a light-emitting device.

A circuit 9001 in FIG. 9 is the same as the circuit in FIG. 1A.

A circuit 9002 in FIG. 9 is similar to the circuit in FIG. 1A and includes light-emitting elements 14, 15, 16, 24, 25, 26, 34, 35, and 36.

Further, the circuit 9001 and the circuit 9002 are connected in parallel.

Figure 10:
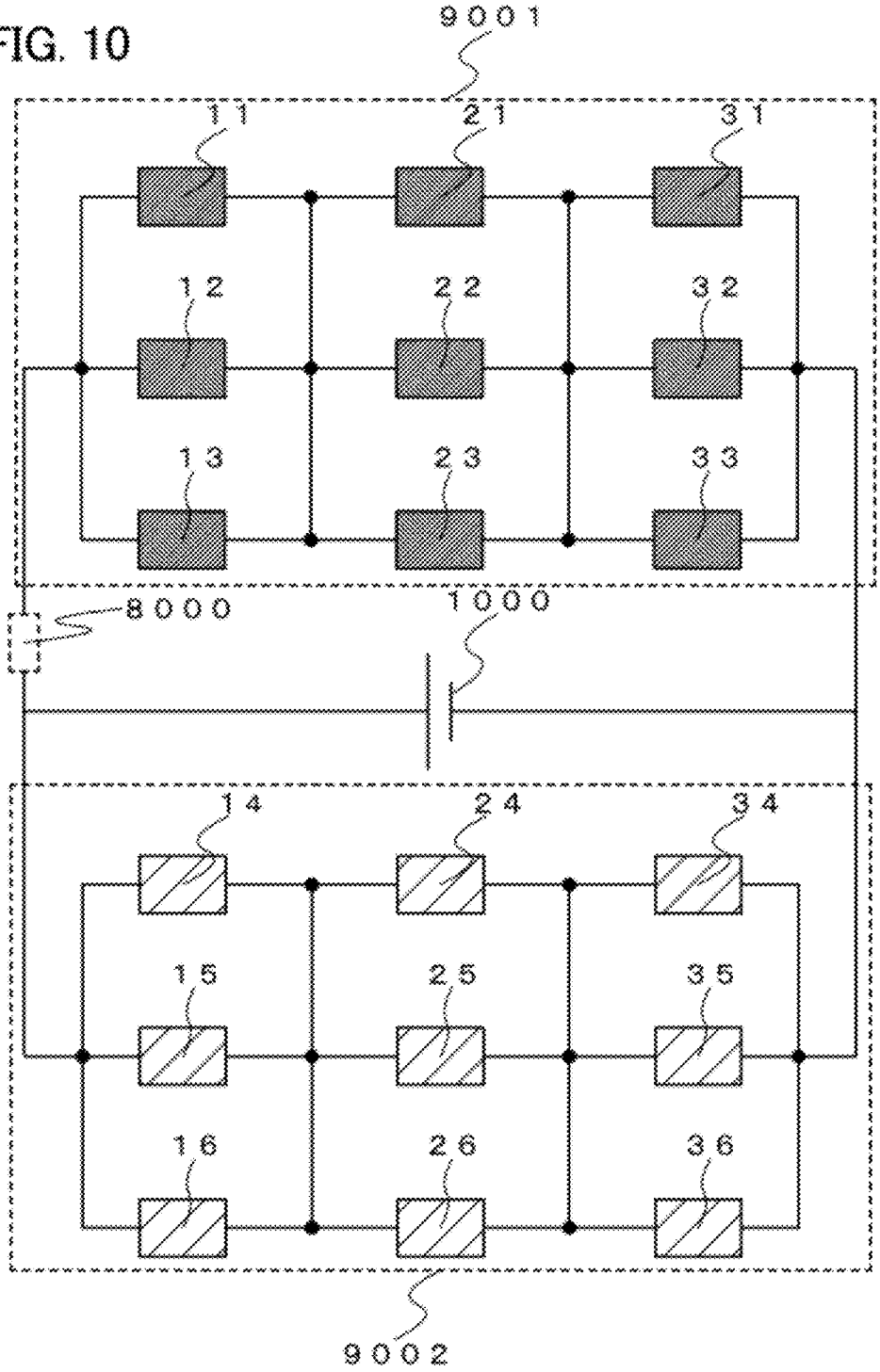
FIG. 10 illustrates an example of a circuit provided in a light-emitting device.

Here, as illustrated by a dashed line 8000 in FIG. 10, when disconnection is caused between the circuit 9001 and a power source 1000, all of the light-emitting elements in the circuit 9001 are in a non-light emitting state; however, all of the light-emitting elements in the circuit 9002 emit light.

As describe above, a plurality of circuits each including a light-emitting element group is provided and the plurality of circuits is connected in parallel, whereby even when disconnection is caused between a circuit and a power source, a problem in that the whole of the light-emitting device is in a non-light emitting state can be solved.

Figure 44B:
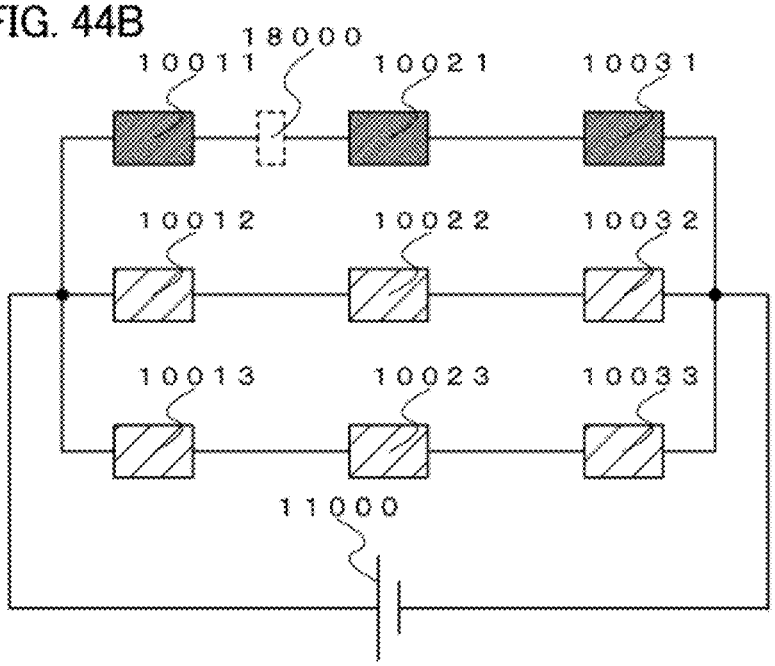
Prior Art FIG. 44B

This embodiment may be applied to a conventional circuit in FIGS. 44A and 44B.

That is, the circuit in FIG. 44A may be applied to both of the circuit 9001 and the circuit 9002.

Alternatively, for example, one of the circuit 9001 and the circuit 9002 can be any one circuit selected from FIG. 1A, FIG. 3A, FIG. 4A, FIG. 5A, FIG. 6, FIGS. 7A and 7B, FIGS. 8A and 8B, FIG. 43, and FIG. 44A and the other of the circuit 9001 and the circuit 9002 can be any one circuit selected from FIG. 1A, FIG. 3A, FIG. 4A, FIG. 5A, FIG. 6, FIGS. 7A and 7B, FIGS. 8A and 8B, FIG. 43, and FIG. 44A.

In any case, in this embodiment, there is no limitation on a combination of the plurality of circuits connected in parallel.

This embodiment can be implemented in combination with any of the other embodiments as appropriate.

(Embodiment 6)

For a light-emitting element, an organic electroluminescent element (an organic EL element), an inorganic electroluminescent element (an inorganic EL element), a light-emitting diode element (an LED element), or the like can be used; however, the present invention is not limited thereto as long as the light-emitting element emits light by being supplied with a current or a voltage.

Further, a circuit including a light-emitting element group is used for a light-emitting unit circuit and one or more of the light-emitting unit circuit is connected to a power source, whereby a lighting device can be formed.

Further, the circuit including a light-emitting element group is used for a pixel circuit of one pixel and the plurality of pixel circuits is separately controlled, whereby a display device can be formed.

That is, with the use of the circuit including a light-emitting element group, a light-emitting device (a lighting device, a display device, or the like) can be formed.

This embodiment can be implemented in combination with any of the other embodiments as appropriate.

(Embodiment 7)

An example of a method for manufacturing a circuit provided in a light-emitting device will be described.

In this embodiment, an example in which part of an upper electrode (an upper wiring) is used as a subsidiary wiring is shown.

Figure 11A:
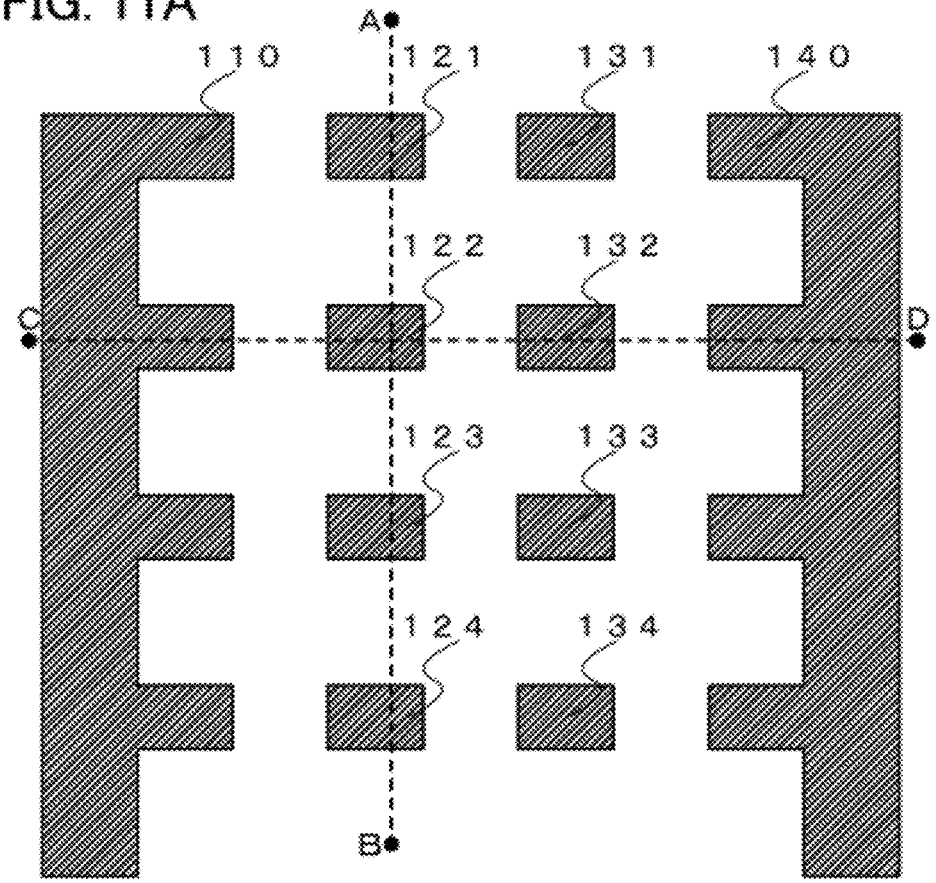
FIGS. 11A, 11B, and 11C illustrate an example of a method for manufacturing a circuit provided in a light-emitting device.
Figure 11B:
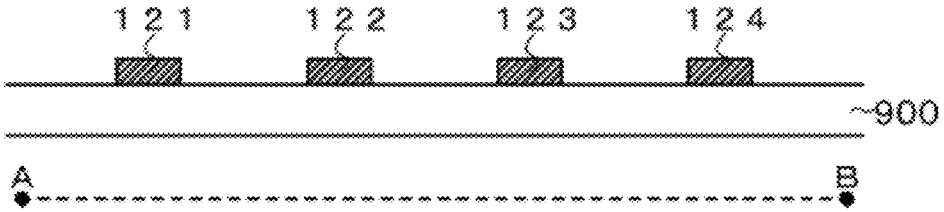
Figure 11C:
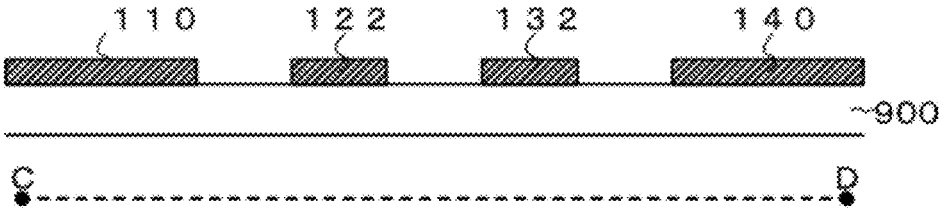
Figure 12A:
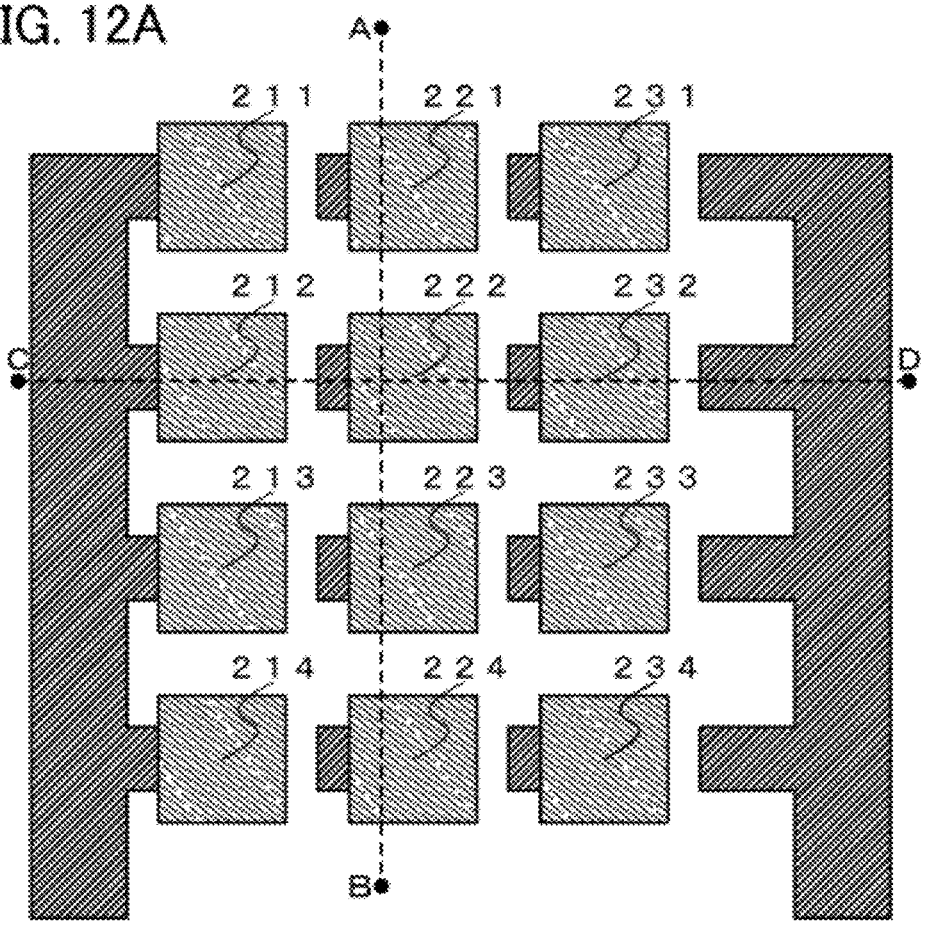
FIGS. 12A, 12B, and 12C illustrate an example of a method for manufacturing a circuit provided in a light-emitting device.
Figure 12B:
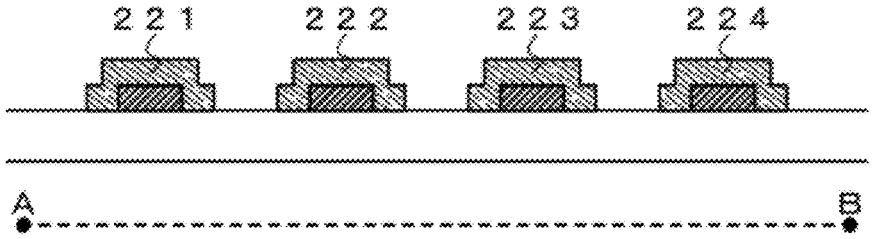
Figure 12C:
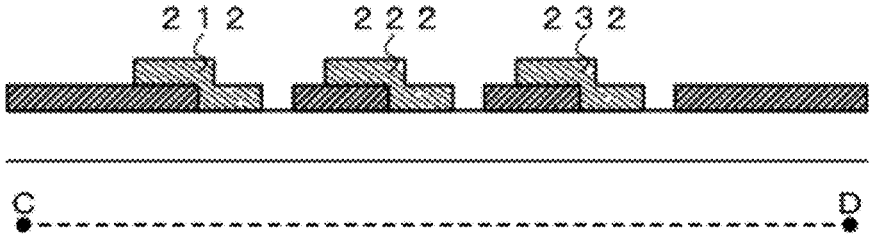
Figure 13A:
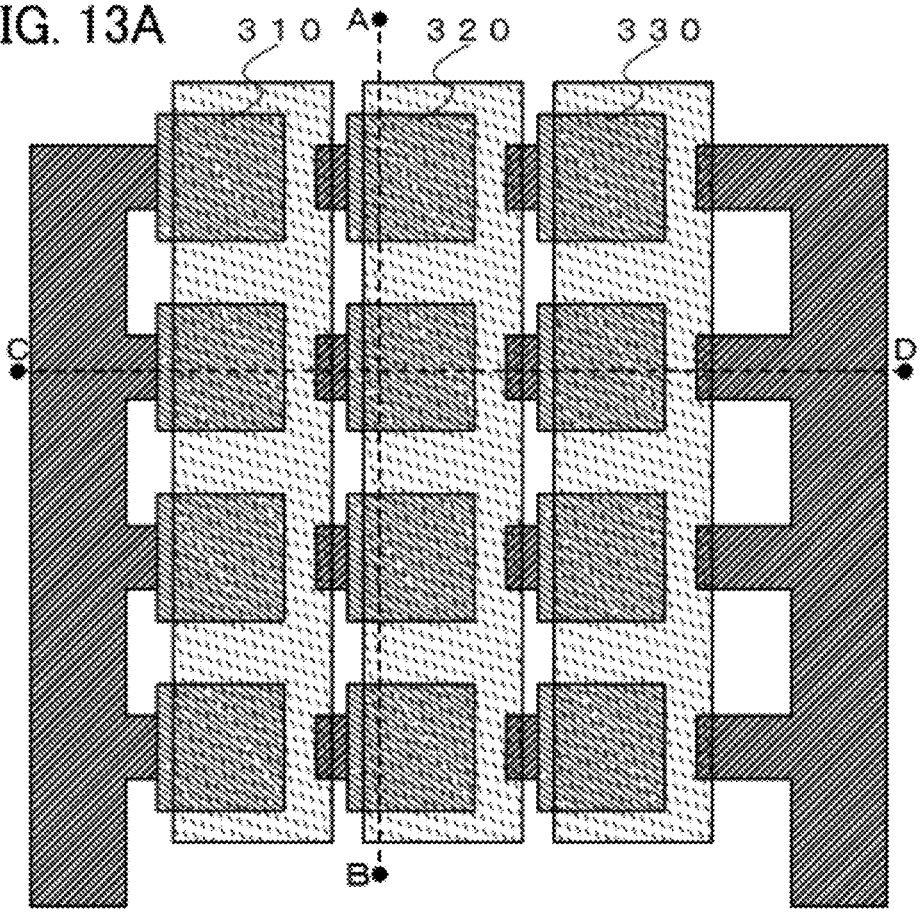
FIGS. 13A, 13B, and 13C illustrate an example of a method for manufacturing a circuit provided in a light-emitting device.
Figure 13B:
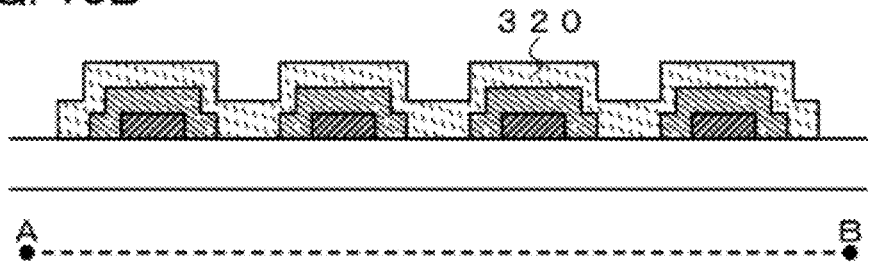
Figure 13C:
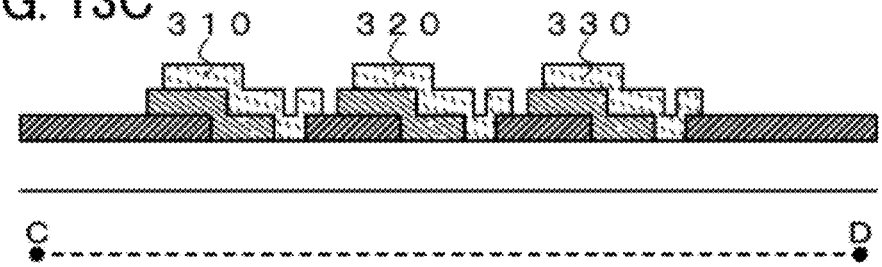

In FIGS. 11A to 11C, FIGS. 12A to 12C, and FIGS. 13A to 13C, FIG. 11A, FIG. 12A, and FIG. 13A are top views. FIG. 11B, FIG. 12B, and FIG. 13B are cross-sectional views along line A-B (cross-sectional views in a column direction) in FIG. 11A, FIG. 12A, and FIG. 13A, respectively. FIG. 11C, FIG. 12C, and FIG. 13C are cross-sectional views along line C-D (cross-sectional views in a row direction) in FIG. 11A, FIG. 12A, and FIG. 13A, respectively.

First, for a plurality of lower electrodes (lower wirings), lower electrodes 110, 121, 122, 123, 124, 131, 132, 133, 134, and 140 are formed over an insulating surface 900 (FIGS. 11A to 11C).

Next, for a plurality of light-emitting body layers, light-emitting body layers 211, 212, 213, 214, 221, 222, 223, 224, 231, 232, 233, and 234 are formed over the plurality of lower electrodes (lower wirings) (FIGS. 12A to 12C).

Next, for a plurality of upper electrodes (upper wirings), upper electrodes 310, 320, and 330 are formed over the plurality of light-emitting body layers (FIGS. 13A to 13C).

Here, the shapes of the layers will be described.

The lower electrodes 110 and 140 each have a plurality of island regions connected electrically.

Note that the lower electrodes 110 and 140 each do not necessarily have a plurality of island regions and may have a simply linear shape or the like.

The lower electrodes 121, 122, 123, 124, 131, 132, 133, and 134 each have an island shape.

The plurality of light-emitting body layers each has an island shape.

Note that in this embodiment, the plurality of light-emitting body layers is divided in the row direction and in the column direction; however, there is no problem as long as each of the light-emitting body layers is not formed over a connection portion between the upper electrode in one light-emitting element and the lower electrode in another light-emitting element. Accordingly, the light-emitting body layers are not necessarily divided in the row direction and in the column direction.

Here, in order to connect the light-emitting element groups provided in the row direction in series, the upper electrode in one light-emitting element and the lower electrode in another light-emitting element need to be connected electrically; therefore, the light-emitting body layer is formed so that part of the lower electrode is exposed.

Further, when the upper electrode in one light-emitting element and the lower electrode in the light-emitting element are connected electrically, a short circuit is caused between the upper electrode and the lower electrode, and the upper electrode and the lower electrode have the same potential. Thus, a current does not flow to the light-emitting body layer in the light-emitting element.

Accordingly, in order to prevent a short circuit between the upper electrode in one light-emitting element and the lower electrode in the light-emitting element, it is preferable that the light-emitting body layer have a larger area than the light-emitting region and a portion overlapping with the upper electrode in an end portion of the lower electrode be covered with the light-emitting body layer.

Further, when a pattern of each layer is formed, in some cases there is a defect (misalignment of a pattern) in that a position where a pattern is actually formed is different from a position where the pattern is designed.

Here, for example, in the case where a structure in which the end portion of a light-emitting body layer corresponds to the end portion of an upper electrode is designed, when misalignment of a pattern occurs, a short circuit between the upper electrode in one light-emitting element and the lower electrode in the light-emitting element is caused in some cases.

In view of the above, as illustrated in FIGS. 13A to 13C, an upper electrode is formed so that part of a light-emitting body layer protrudes from the upper electrode, whereby the probability of a short circuit between the upper electrode in one light-emitting element and the lower electrode in the light-emitting element can be reduced in the case where misalignment of a pattern occurs.

This embodiment can be implemented in combination with any of the other embodiments as appropriate.

(Embodiment 8)

An example of a method for manufacturing a circuit provided in a light-emitting device will be described.

In this embodiment, an example in which part of a lower electrode (a lower wiring) is used as a subsidiary wiring is shown.

Here, when factors that cause a disconnection of a lower electrode (a lower wiring) and factors that cause a disconnection of an upper electrode (an upper wiring) are considered, since many steps exist under the upper electrode (the upper wiring), there is a problem in that the upper electrode (the upper wiring) is likely to be disconnected due to the steps.

Therefore, when part of the lower electrode (the lower wiring) is used as a subsidiary wiring, the possibility of disconnection can be reduced as compared to the case where part of the upper electrode (the upper wiring) is used as a subsidiary wiring.

Figure 14A:
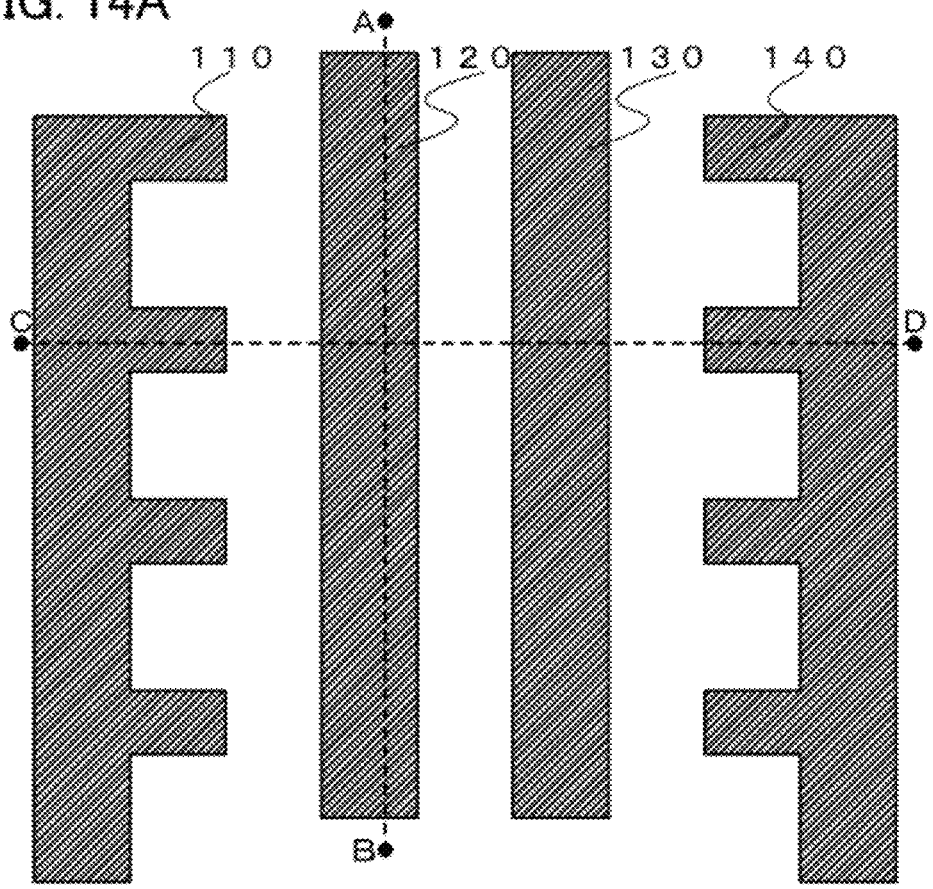
FIGS. 14A, 14B, and 14C illustrate an example of a method for manufacturing a circuit provided in a light-emitting device.
Figure 14B:
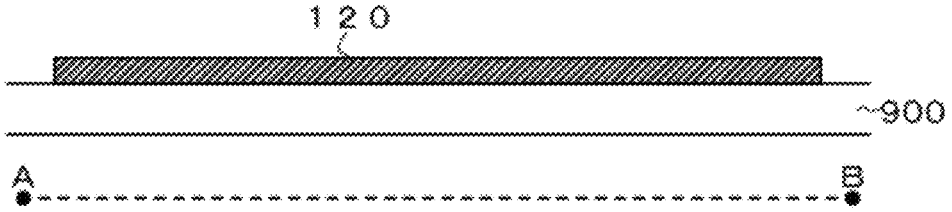
Figure 14C:
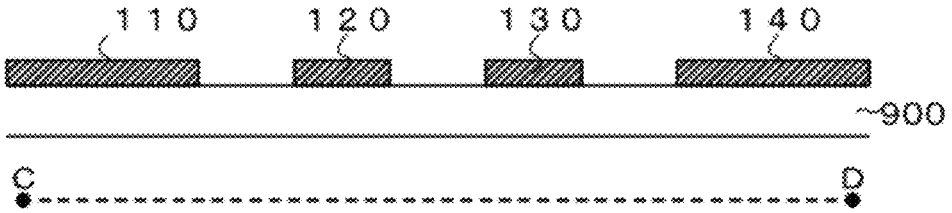
Figure 15A:
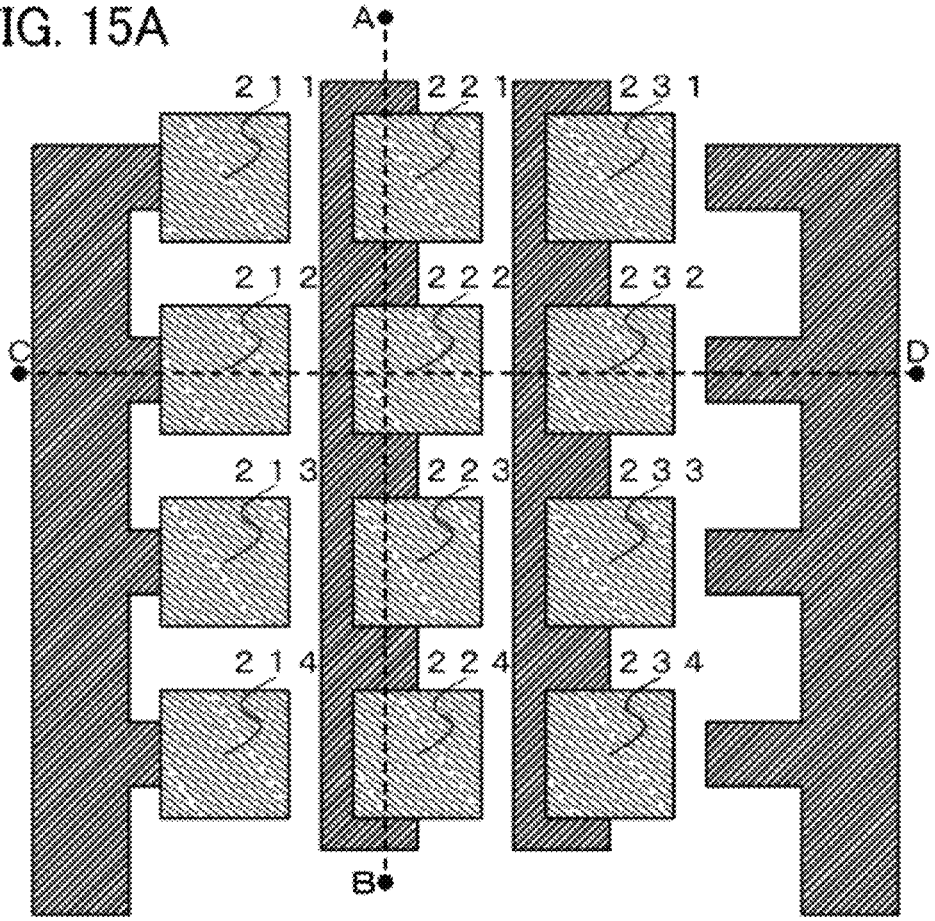
FIGS. 15A, 15B, and 15C illustrate an example of a method for manufacturing a circuit provided in a light-emitting device.
Figure 15B:
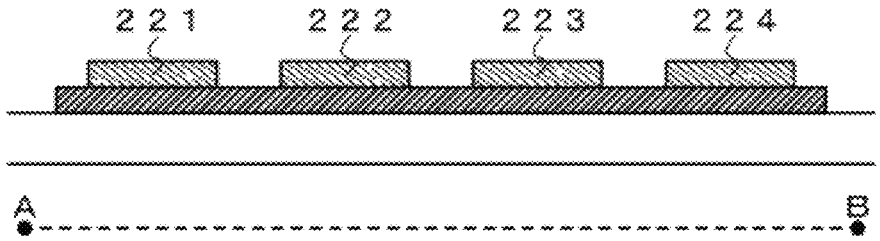
Figure 15C:
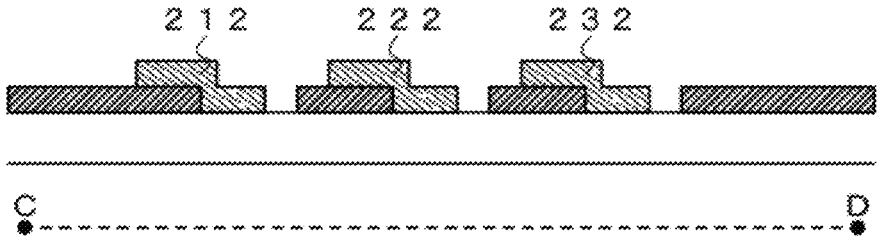
Figure 16A:
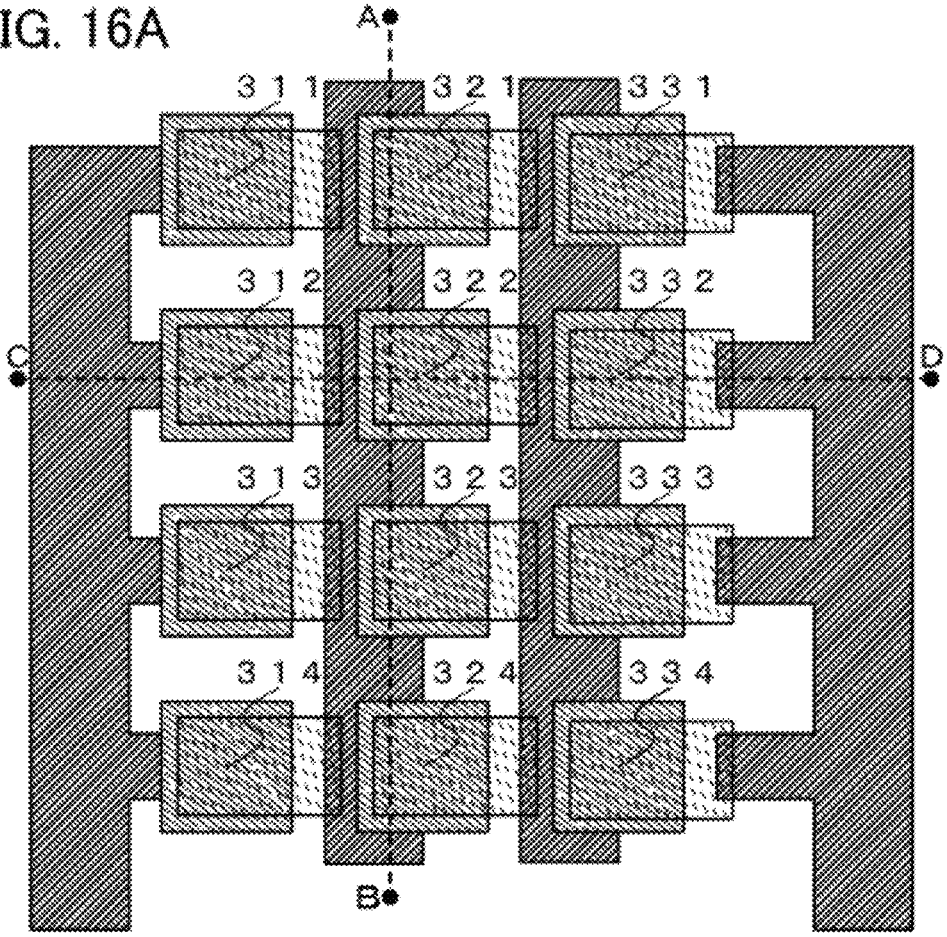
FIGS. 16A, 16B, and 16C illustrate an example of a method for manufacturing a circuit provided in a light-emitting device.
Figure 16B:
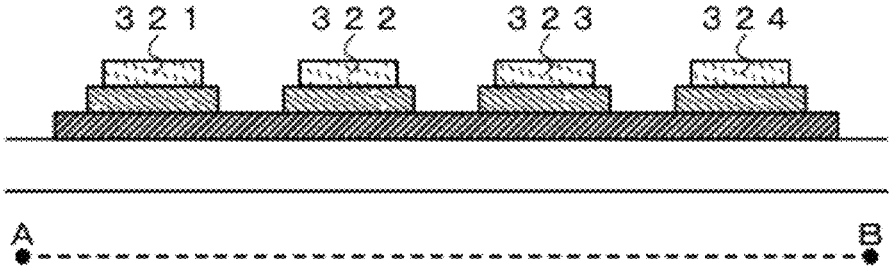
Figure 16C:
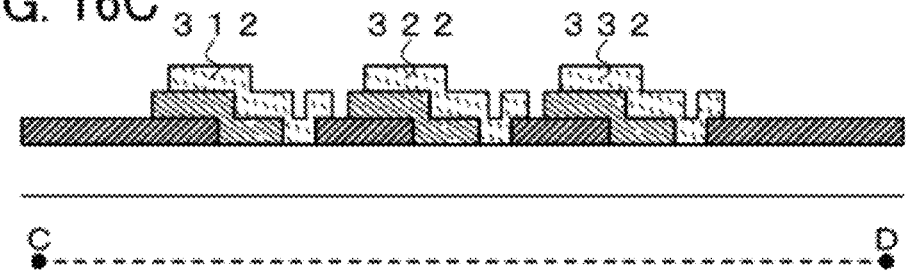

In FIGS. 14A to 14C, FIGS. 15A to 15C, and FIGS. 16A to 16C, FIG. 14A, FIG. 15A, and FIG. 16A are top views. FIG. 14B, FIG. 15B, and FIG. 16B are cross-sectional views along line A-B (cross-sectional views in a column direction) in FIG. 14A, FIG. 15A, and FIG. 16A, respectively. FIG. 14C, FIG. 15C, and FIG. 16C are cross-sectional views along line C-D (cross-sectional views in a row direction) in FIG. 14A, FIG. 15A, and FIG. 16A, respectively.

First, for a plurality of lower electrodes (lower wirings), lower electrodes 110, 120, 130, and 140 are formed over an insulating surface 900 (FIGS. 14A to 14C).

Next, for a plurality of light-emitting body layers, light-emitting body layers 211, 212, 213, 214, 221, 222, 223, 224, 231, 232, 233, and 234 are formed over the plurality of lower electrodes (lower wirings) (FIGS. 15A to 15C).

Next, for a plurality of upper electrodes (upper wirings), upper electrodes 311, 312, 313, 314, 321, 322, 323, 324, 331, 332, 333, and 334 are formed over the plurality of light-emitting body layers (FIGS. 16A to 16C).

Here, the shapes of the layers will be described.

The lower electrodes 110 to 140 are each formed in common in the column direction.

The lower electrodes 110 and 140 each have a plurality of island regions connected electrically.

Note that the lower electrodes 110 and 140 each do not necessarily have a plurality of island regions and may have a simply linear shape or the like.

The plurality of light-emitting body layers each has an island shape.

Note that in this embodiment, the plurality of light-emitting body layers is divided in the row direction and in the column direction; however, there is no problem as long as each of the light-emitting body layers is not formed over a connection portion between the upper electrode in one light-emitting element and the lower electrode in another light-emitting element. Accordingly, the light-emitting body layers are not necessarily divided in the row direction and in the column direction.

Here, in order to connect the light-emitting element groups provided in the row direction in series, the upper electrode in one light-emitting element and the lower electrode in another light-emitting element need to be connected electrically; therefore, the light-emitting body layer is formed so that part of the lower electrode is exposed.

Further, when the upper electrode in one light-emitting element and the lower electrode in the light-emitting element are connected electrically, a short circuit is caused between the upper electrode and the lower electrode, and the upper electrode and the lower electrode have the same potential. Thus, a current does not flow to the light-emitting body layer in the light-emitting element.

Accordingly, in order to prevent a short circuit between the upper electrode in one light-emitting element and the lower electrode in the light-emitting element, it is preferable that the light-emitting body layer have a larger area than the light-emitting region and a portion overlapping with the upper electrode in an end portion of the lower electrode be covered with the light-emitting body layer.

Further, as illustrated in FIGS. 16A to 16C, an upper electrode is formed so that part of a light-emitting body layer protrudes from the upper electrode, whereby the probability of a short circuit between the upper electrode in one light-emitting element and the lower electrode in the light-emitting element can be reduced in the case where misalignment of a pattern occurs.

This embodiment can be implemented in combination with any of the other embodiments as appropriate.

(Embodiment 9)

An example of a method for manufacturing a circuit provided in a light-emitting device will be described.

In this embodiment, an example in which part of a lower electrode (a lower wiring) is used as a subsidiary wiring and part of an upper electrode (an upper wiring) is used as a subsidiary wiring is shown.

The circuit diagram in this embodiment corresponds to FIGS. 5A and 5B, and the circuit has a structure in which subsidiary wirings are provided in different layers (the same layer as a lower electrode and the same layer as an upper electrode). With the structure, an effect of countermeasures against disconnection can be improved.

Figure 17A:
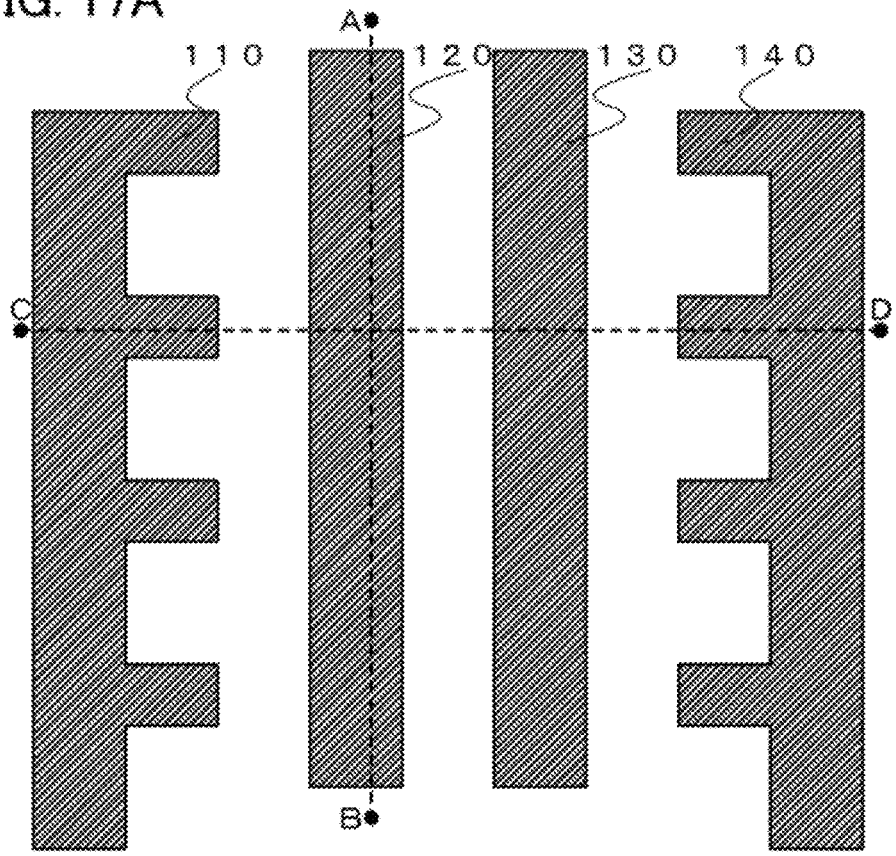
FIGS. 17A, 17B, and 17C illustrate an example of a method for manufacturing a circuit provided in a light-emitting device.
Figure 17B:
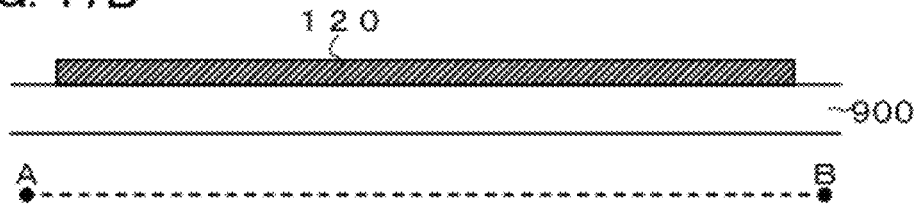
Figure 17C:
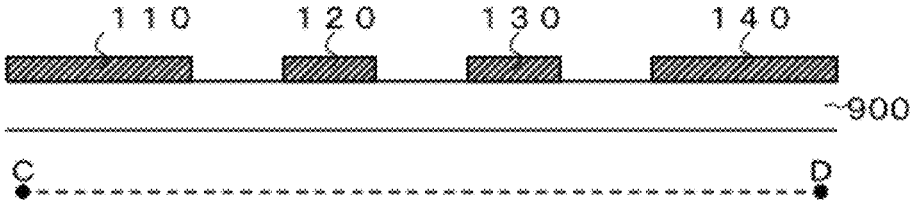
Figure 18A:
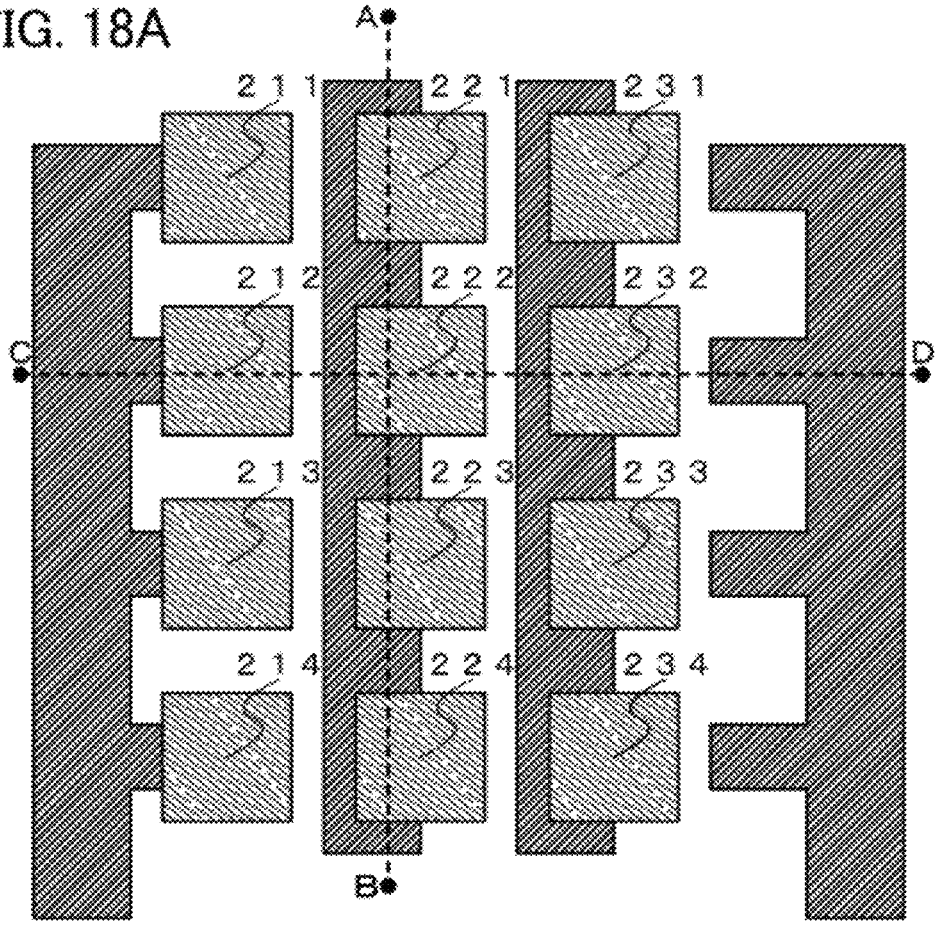
FIGS. 18A, 18B, and 18C illustrate an example of a method for manufacturing a circuit provided in a light-emitting device.
Figure 18B:
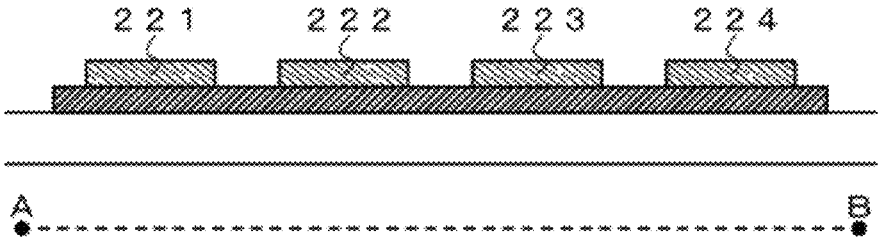
Figure 18C:
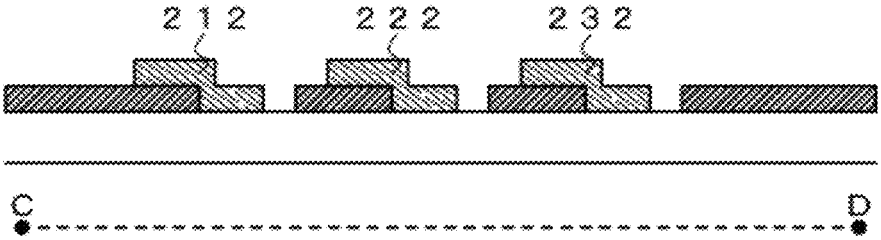
Figure 19A:
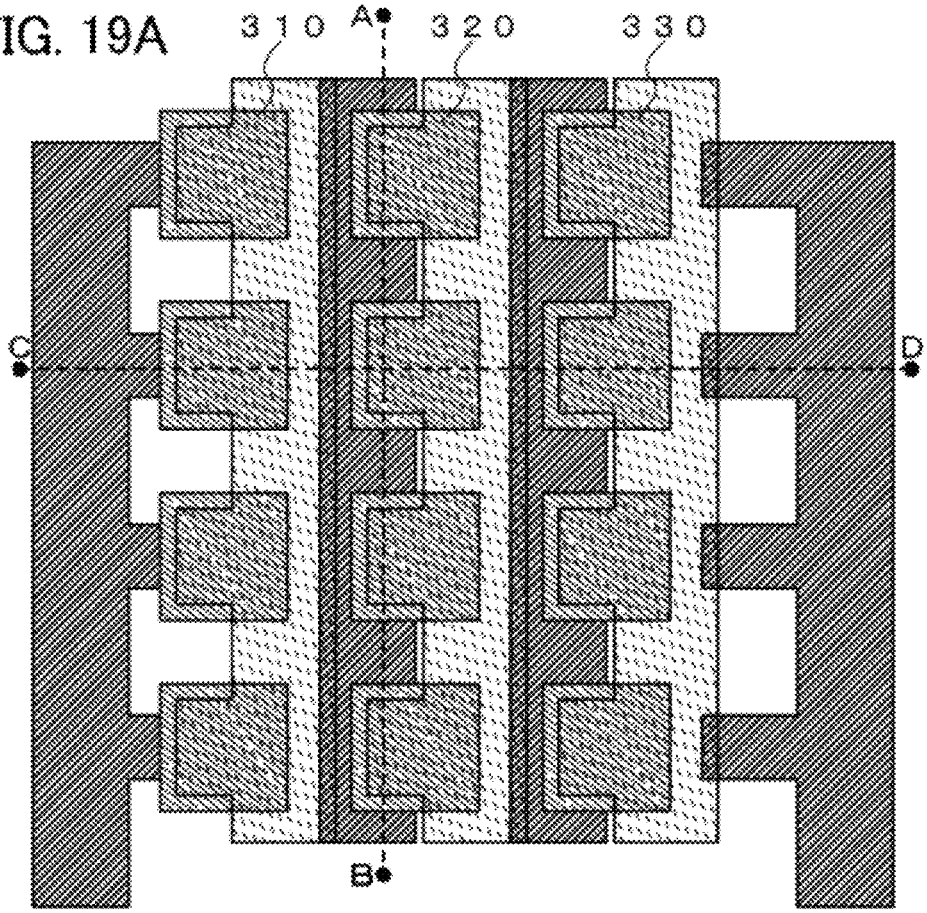
FIGS. 19A, 19B, and 19C illustrate an example of a method for manufacturing a circuit provided in a light-emitting device.
Figure 19B:
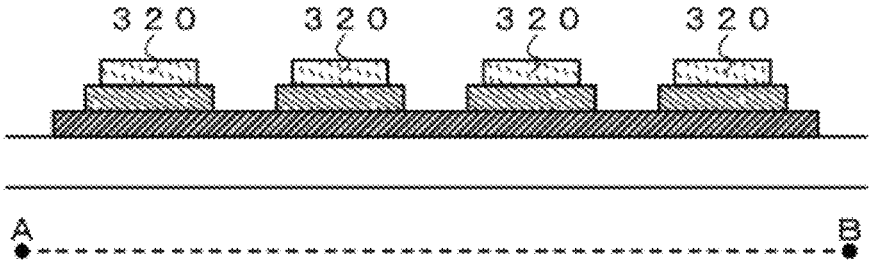
Figure 19C:
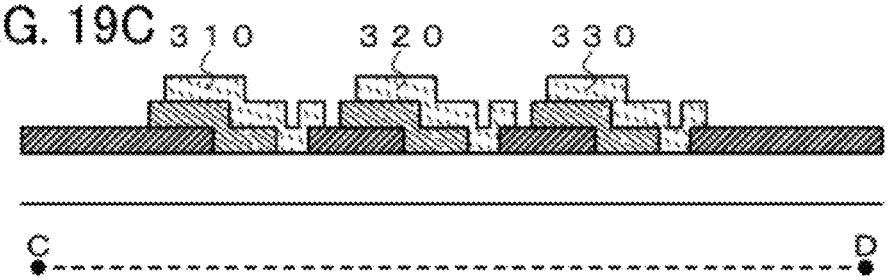

In FIGS. 17A to 17C, FIGS. 18A to 18C, and FIGS. 19A to 19C, FIG. 17A, FIG. 18A, and FIG. 19A are top views. FIG. 17B, FIG. 18B, and FIG. 19B are cross-sectional views along line A-B (cross-sectional views in a column direction) in FIG. 17A, FIG. 18A, and FIG. 19A, respectively. FIG. 17C, FIG. 18C, and FIG. 19C are cross-sectional views along line C-D (cross-sectional views in a row direction) in FIG. 17A, FIG. 18A, and FIG. 19A, respectively.

First, for a plurality of lower electrodes (lower wirings), lower electrodes 110, 120, 130, and 140 are formed over an insulating surface 900 (FIGS. 17A to 17C).

Next, for a plurality of light-emitting body layers, light-emitting body layers 211, 212, 213, 214, 221, 222, 223, 224, 231, 232, 233, and 234 are formed over the plurality of lower electrodes (lower wirings) (FIGS. 18A to 18C).

Next, for a plurality of upper electrodes (upper wirings), upper electrodes 310, 320, and 330 are formed over the plurality of light-emitting body layers (FIGS. 19A to 19C).

Here, the shapes of the layers will be described.

The lower electrodes 110 to 140 are each formed in common in the column direction.

The lower electrodes 110 and 140 each have a plurality of island regions connected electrically.

Note that the lower electrodes 110 and 140 each do not necessarily have a plurality of island regions and may have a simply linear shape or the like.

The plurality of light-emitting body layers each has an island shape.

Note that in this embodiment, the plurality of light-emitting body layers is divided in the row direction and in the column direction; however, there is no problem as long as each of the light-emitting body layers is not formed over a connection portion between the upper electrode in one light-emitting element and the lower electrode in another light-emitting element. Accordingly, the light-emitting body layers are not necessarily divided in the row direction and in the column direction.

Here, in order to connect the light-emitting element groups provided in the row direction in series, the upper electrode in one light-emitting element and the lower electrode in another light-emitting element need to be connected electrically; therefore, the light-emitting body layer is formed so that part of the lower electrode is exposed.

Further, when the upper electrode in one light-emitting element and the lower electrode in the light-emitting element are connected electrically, a short circuit is caused between the upper electrode and the lower electrode, and the upper electrode and the lower electrode have the same potential. Thus, a current does not flow to the light-emitting body layer in the light-emitting element.

Accordingly, in order to prevent a short circuit between the upper electrode in one light-emitting element and the lower electrode in the light-emitting element, it is preferable that the light-emitting body layer have a larger area than the light-emitting region and a portion overlapping with the upper electrode in an end portion of the lower electrode be covered with the light-emitting body layer.

Further, as illustrated in FIGS. 19A to 19C, an upper electrode is formed so that part of a light-emitting body layer protrudes from the upper electrode, whereby the probability of a short circuit between the upper electrode in one light-emitting element and the lower electrode in the light-emitting element can be reduced in the case where misalignment of a pattern occurs.

Furthermore, since part of the upper electrode and part of the lower electrode are used as subsidiary wirings, it is preferable to prevent a short circuit between the upper electrode in one light-emitting element and the lower electrode in the light-emitting element by carefully designing a shape of the upper electrode.

Specifically, as in the upper electrodes 310, 320, and 330, a plurality of first island regions are electrically connected by a second region.

Then, a first island region of the upper electrode in one light-emitting element is provided over a region overlapping with the lower electrode in the light-emitting element with the light-emitting body layer interposed therebetween.

In addition, as a countermeasure against misalignment of a pattern, it is preferable to provide the first island region of the upper electrode in one light-emitting element inside an end portion of the light-emitting body layer in the light-emitting element, over the region overlapping with the lower electrode in the light-emitting element.

That is, it is preferable that the light-emitting body layer in one light-emitting element be formed so that the light-emitting body layer protrudes from the first island region of the upper electrode in the light-emitting element.

Further, the second region of the upper electrode in one light-emitting element is provided not to overlap with the lower electrode in the light-emitting element.

Note that for series connection, the second region of the upper electrode in one light-emitting element is provided at a position overlapping with the lower electrode in an adjacent light-emitting element.

This embodiment can be implemented in combination with any of the other embodiments as appropriate.

(Embodiment 10)

An example of a method for manufacturing a circuit provided in a light-emitting device will be described.

In FIGS. 20A to 20C, FIGS. 21A to 21C, FIGS. 22A to 22C, FIGS. 23A to 23C, FIGS. 24A to 24C, and FIGS. 25A to 25C, FIG. 20A, FIG. 21A, FIG. 22A, FIG. 23A, FIG. 24A, and FIG. 25A are top views. FIG. 20B, FIG. 21B, FIG. 22B, FIG. 23B, FIG. 24B, and FIG. 25B are cross-sectional views along line A-B (cross-sectional views in a column direction) in FIG. 20A, FIG. 21A, FIG. 22A, FIG. 23A, FIG. 24A, and FIG. 25A, respectively. FIG. 20C, FIG. 21C, FIG. 22C FIG. 23C, FIG. 24C, and FIG. 25C are cross-sectional views along line C-D (cross-sectional views in a row direction) in FIG. 20A, FIG. 21A, FIG. 22A, FIG. 23A, FIG. 24A, and FIG. 25A, respectively.

Figure 20A:
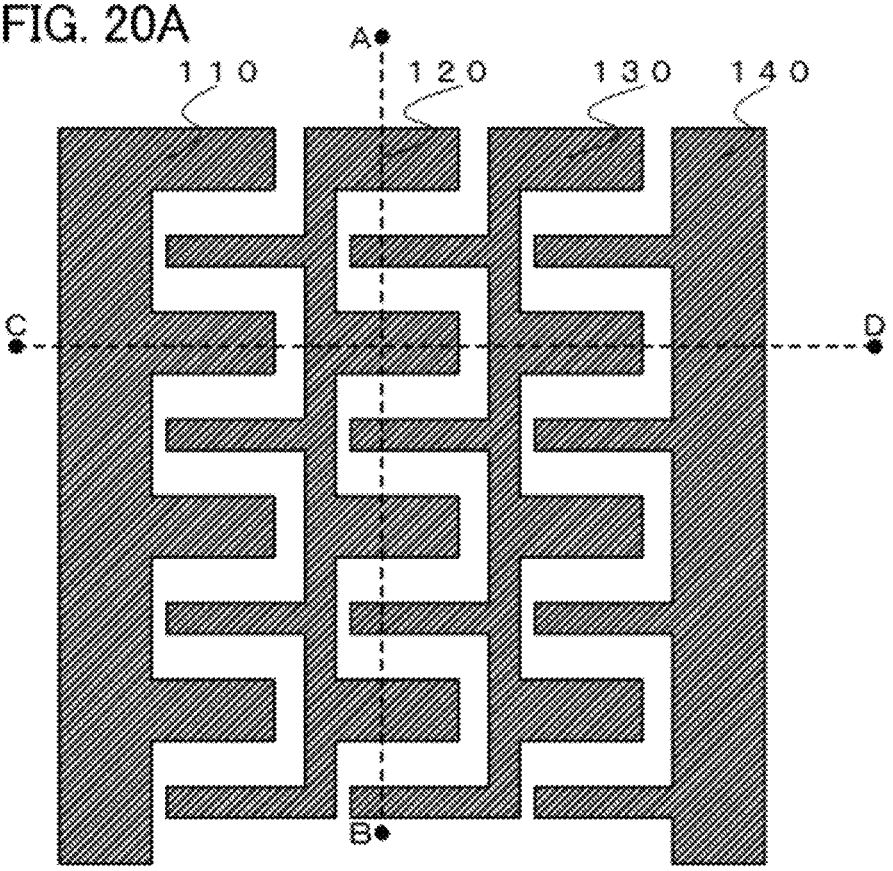
FIGS. 20A, 20B, and 20C illustrate an example of a method for manufacturing a circuit provided in a light-emitting device.
Figure 20B:
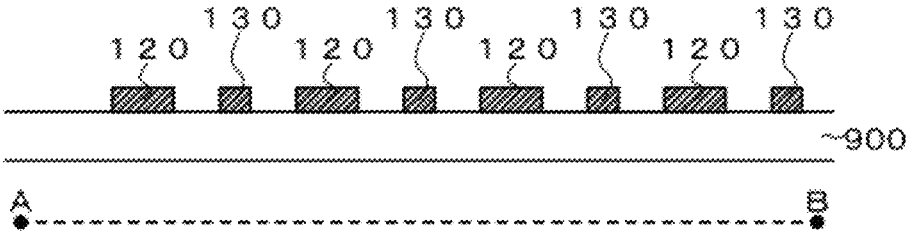
Figure 20C:
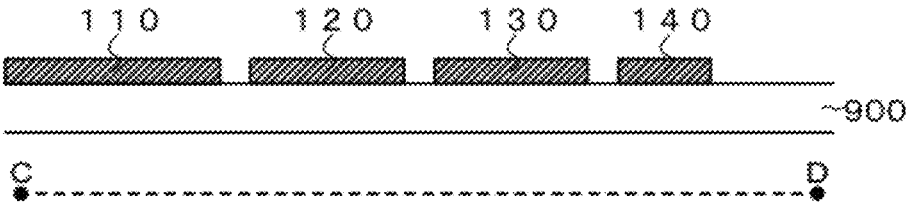

First, for a plurality of lower electrodes (lower wirings), lower electrodes 110, 120, 130, and 140 are formed over an insulating surface 900 (FIGS. 20A to 20C).

Figure 21A:
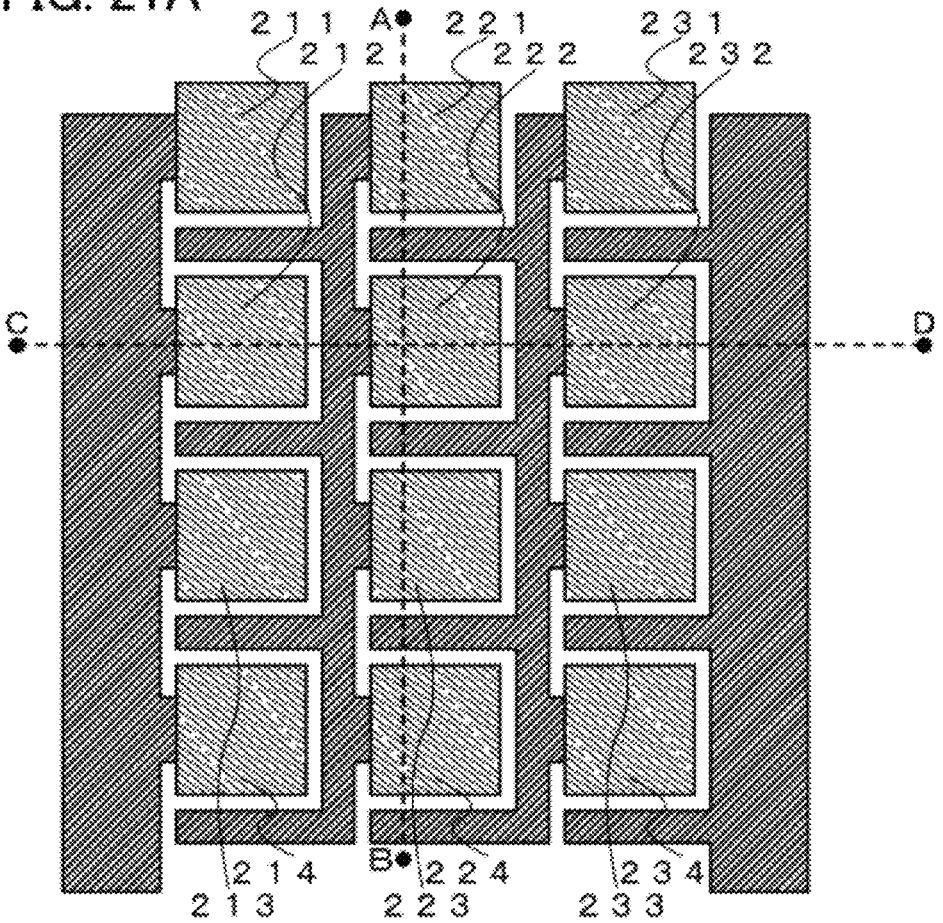
FIGS. 21A, 21B, and 21C illustrate an example of a method for manufacturing a circuit provided in a light-emitting device.
Figure 21B:
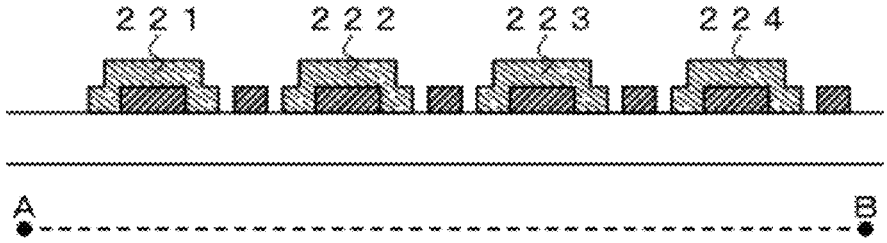
Figure 21C:
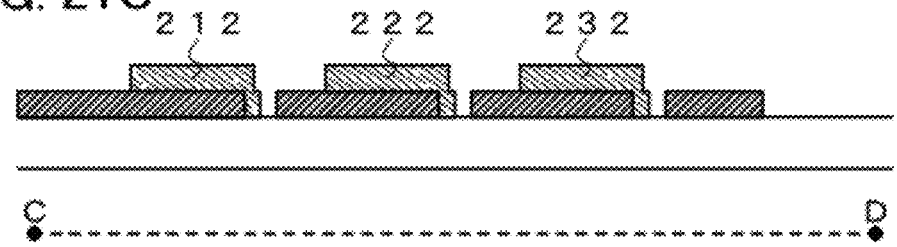

Next, for a plurality of light-emitting body layers, light-emitting body layers 211, 212, 213, 214, 221, 222, 223, 224, 231, 232, 233, and 234 are formed over the plurality of lower electrodes (lower wirings) (FIGS. 21A to 21C).

Figure 22A:
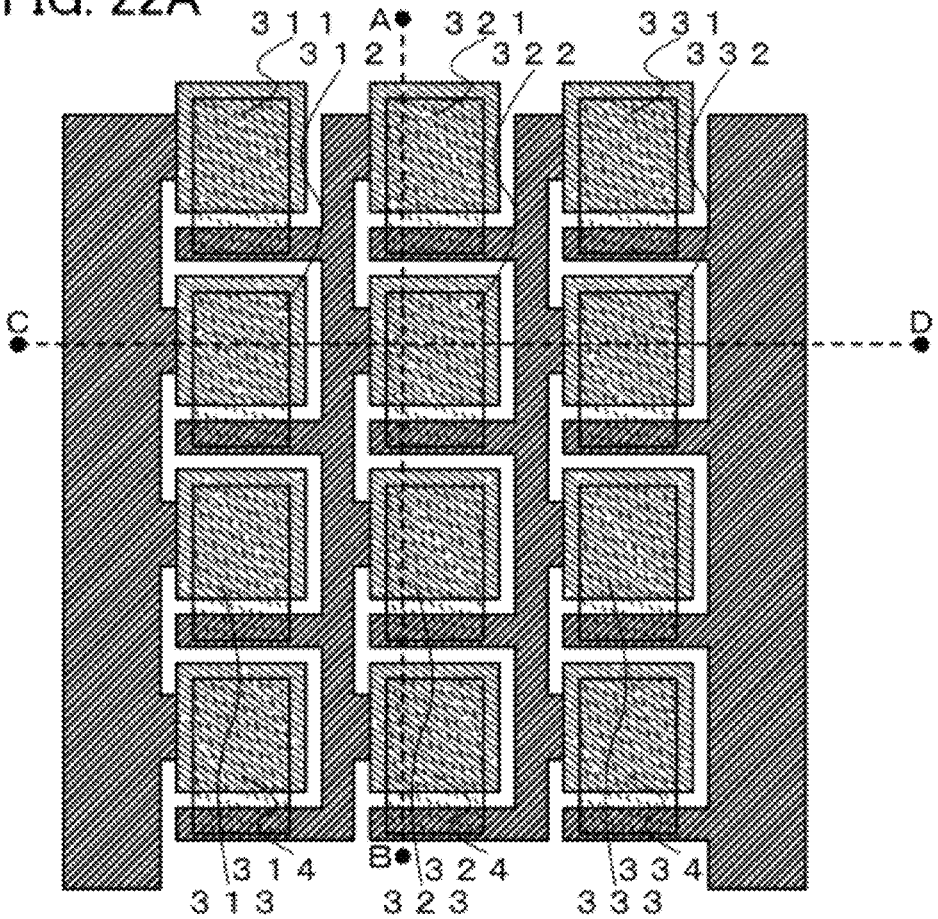
FIGS. 22A, 22B, and 22C illustrate an example of a method for manufacturing a circuit provided in a light-emitting device.
Figure 22B:
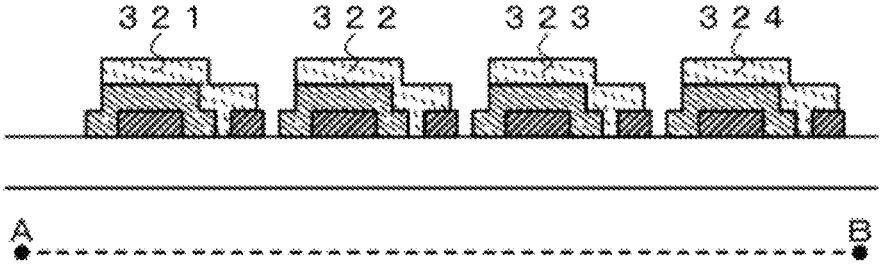
Figure 22C:
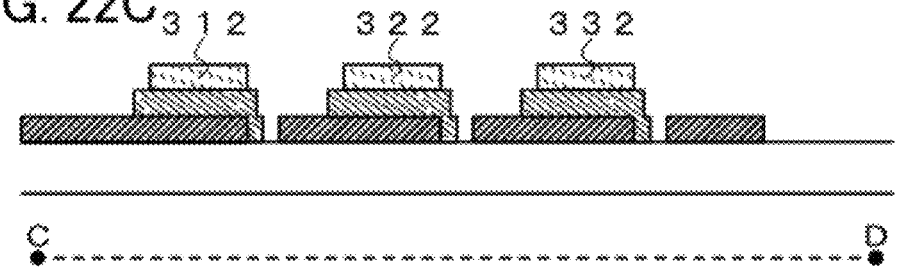

Next, for a plurality of upper electrodes (upper wirings), upper electrodes 311, 312, 313, 314, 321, 322, 323, 324, 331, 332, 333, and 334 are formed over the plurality of light-emitting body layers (FIGS. 22A to 22C).

Here, the shapes of the layers will be described.

The lower electrodes 110 to 140 are each formed in common in the column direction.

Here, the lower electrodes 120 and 130 each include a plurality of first island regions which extends to the C side in line C-D direction in FIG. 22A, a plurality of second island regions which extends to the D side in line C-D direction in FIG. 22A, and a third region for electrically connecting the plurality of first island regions and the plurality of second island regions.

Further, the lower electrode 110 includes a plurality of second island regions which extends to the D side in line C-D direction in FIG. 22A and a third region for connecting the plurality of second island regions electrically.

Furthermore, the lower electrode 140 includes a plurality of first island regions which extends to the C side in line C-D direction in FIG. 22A and a third region for connecting the plurality of first island regions electrically.

Here, the first island region is a portion where a connection portion for series connection is formed and the second island region is a portion where a light-emitting region is formed.

Further, the plurality of first island regions in one lower electrode and the plurality of second island regions in an adjacent lower electrode are alternately arranged in the column direction.

That is, a first comb-shaped electrode (part of one lower electrode) and a second comb-shaped electrode (part of an adjacent lower electrode) are formed so as to engage with each other.

In FIGS. 22A to 22C, the lower electrodes and the upper electrodes are provided so that one upper electrode is connected to one first island region (a connection portion).

Accordingly, a connection portion is provided in a space between one second island region and a second island region adjacent thereto in the column direction, whereby a space can be effectively used and the aperture ratio can be improved.

The plurality of light-emitting body layers each has an island shape.

Note that in this embodiment, the plurality of light-emitting body layers is divided in the row direction and in the column direction; however, there is no problem as long as each of the light-emitting body layers is not formed over a connection portion between the upper electrode in one light-emitting element and the lower electrode in another light-emitting element. Accordingly, the light-emitting body layers are not necessarily divided in the row direction and in the column direction.

Here, in order to connect the light-emitting element groups provided in the row direction in series, the upper electrode in one light-emitting element and the lower electrode in another light-emitting element need to be connected electrically; therefore, the light-emitting body layer is formed so that part of the lower electrode is exposed.

Further, when the upper electrode in one light-emitting element and the lower electrode in the light-emitting element are connected electrically, a short circuit is caused between the upper electrode and the lower electrode, and the upper electrode and the lower electrode have the same potential. Thus, a current does not flow to the light-emitting body layer in the light-emitting element.

Accordingly, in order to prevent a short circuit between the upper electrode in one light-emitting element and the lower electrode in the light-emitting element, it is preferable that the light-emitting body layer have a larger area than the light-emitting region and a portion overlapping with the upper electrode in an end portion of the lower electrode be covered with the light-emitting body layer.

Further, as illustrated in FIGS. 22A to 22C, an upper electrode is formed so that part of a light-emitting body layer protrudes from the upper electrode, whereby the probability of a short circuit between the upper electrode in one light-emitting element and the lower electrode in the light-emitting element can be reduced in the case where misalignment of a pattern occurs.

Further, as a countermeasure against misalignment of a pattern in the row direction, it is preferable that the first island region of the lower electrode have a linear shape which extends in the row direction.

The first island region of the lower electrode has a linear shape which extends in the row direction, whereby a countermeasure against misalignment of a pattern can be taken without increase in a space in the column direction (a space between the second island regions adjacent in the column direction).

Figure 23A:
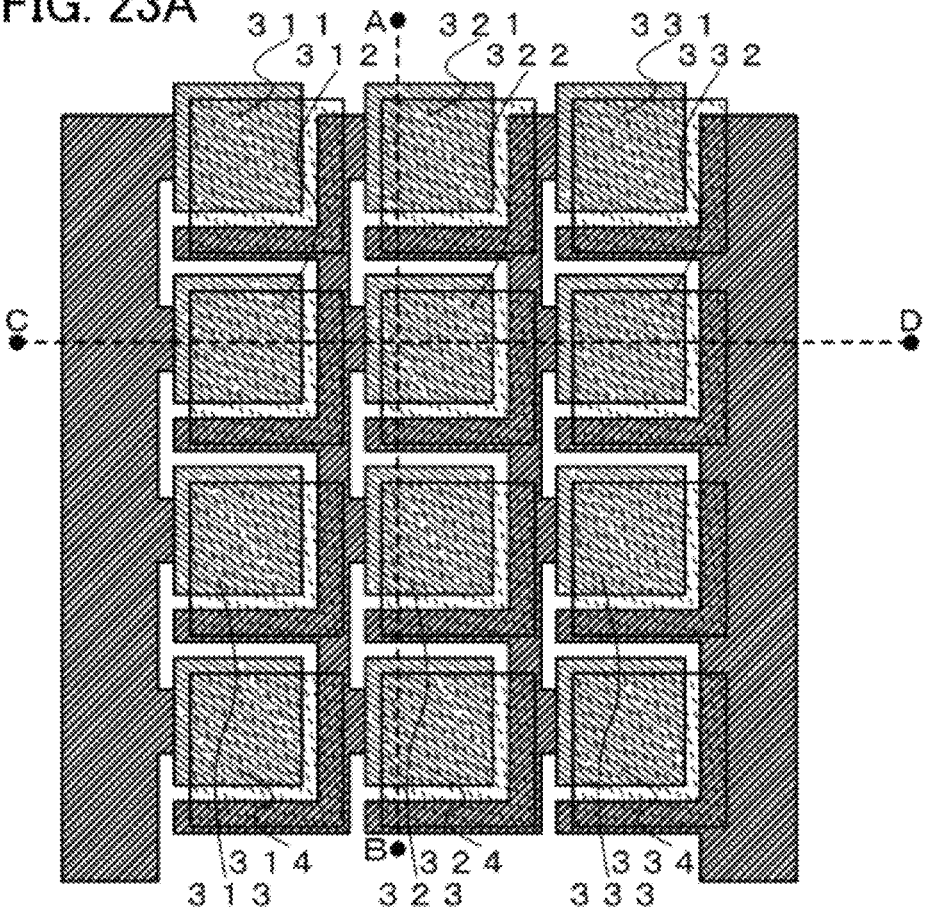
FIGS. 23A, 23B, and 23C illustrate an example of a method for manufacturing a circuit provided in a light-emitting device.
Figure 23B:
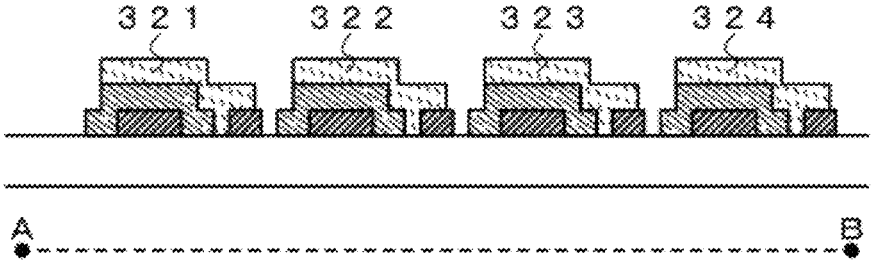
Figure 23C:
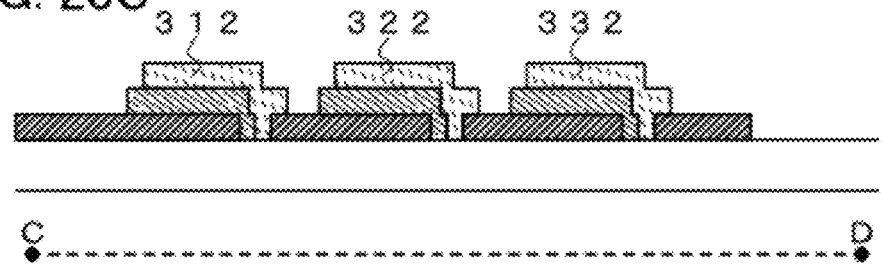

Further, in FIGS. 22A to 22C, the upper electrodes and the lower electrodes are electrically connected only in the column direction; however, it is preferable that the upper electrodes and the lower electrodes be electrically connected also in the row direction by extending the upper electrodes in the row direction as illustrated in FIGS. 23A to 23C.

The structure in FIGS. 23A to 23C is preferable because the number of current paths increases compared to the structure in FIGS. 22A to 22C.

That is, even when disconnection occurs in one of the row direction and the column direction, electrical connection is possible in the other of the row direction and the column direction, which is preferable.

Further, in the structure in FIGS. 23A to 23C, there is an advantage in that contact resistance can be reduced because the area of a connection portion increases compared to the structure in FIGS. 22A to 22C.

Furthermore, in the structure in FIGS. 22A to 22C, when misalignment of a pattern of an upper electrode occurs in the column direction, there is a problem in that a bad connection between the upper electrode and the lower electrode is easily caused.

Figure 24A:
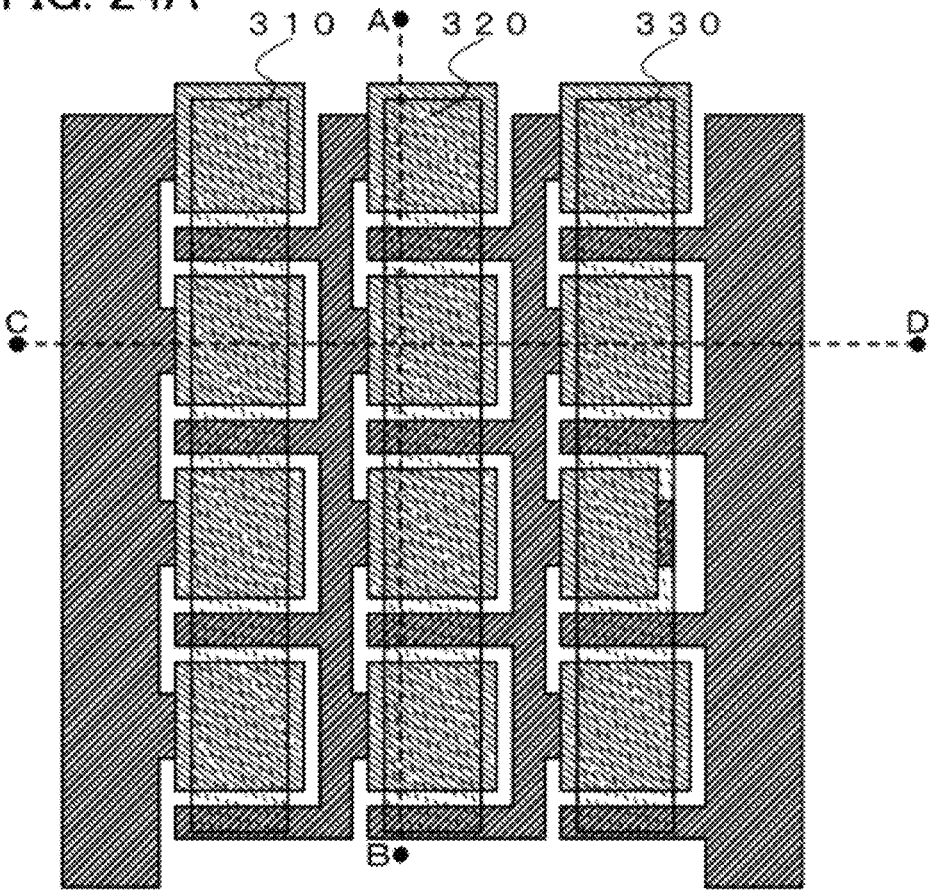
FIGS. 24A, 24B, and 24C illustrate an example of a method for manufacturing a circuit provided in a light-emitting device.
Figure 24B:
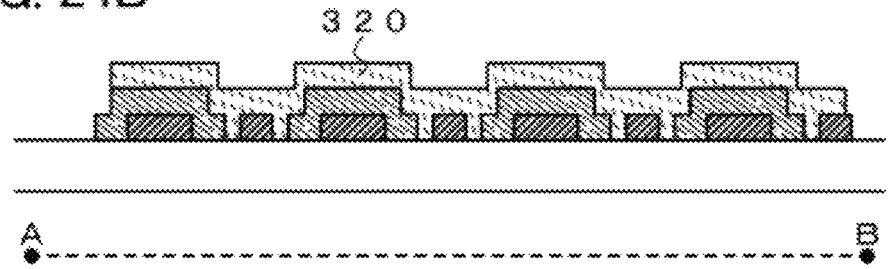
Figure 24C:
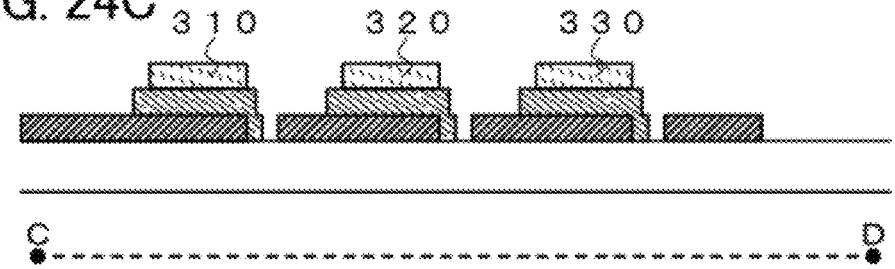

In view of the above, as illustrated in FIGS. 24A to 24C, a structure in which an upper electrode is provided in common in every column is employed, whereby the length in the column direction can have an enough space; therefore, the above problem can be solved.

Specifically, as illustrated in FIGS. 24A to 24C, the upper electrodes (the upper electrodes 310, 320, and 330) each preferably have a linear shape and are each provided so as to intersect with a plurality of first island regions of lower electrodes.

Figure 25A:
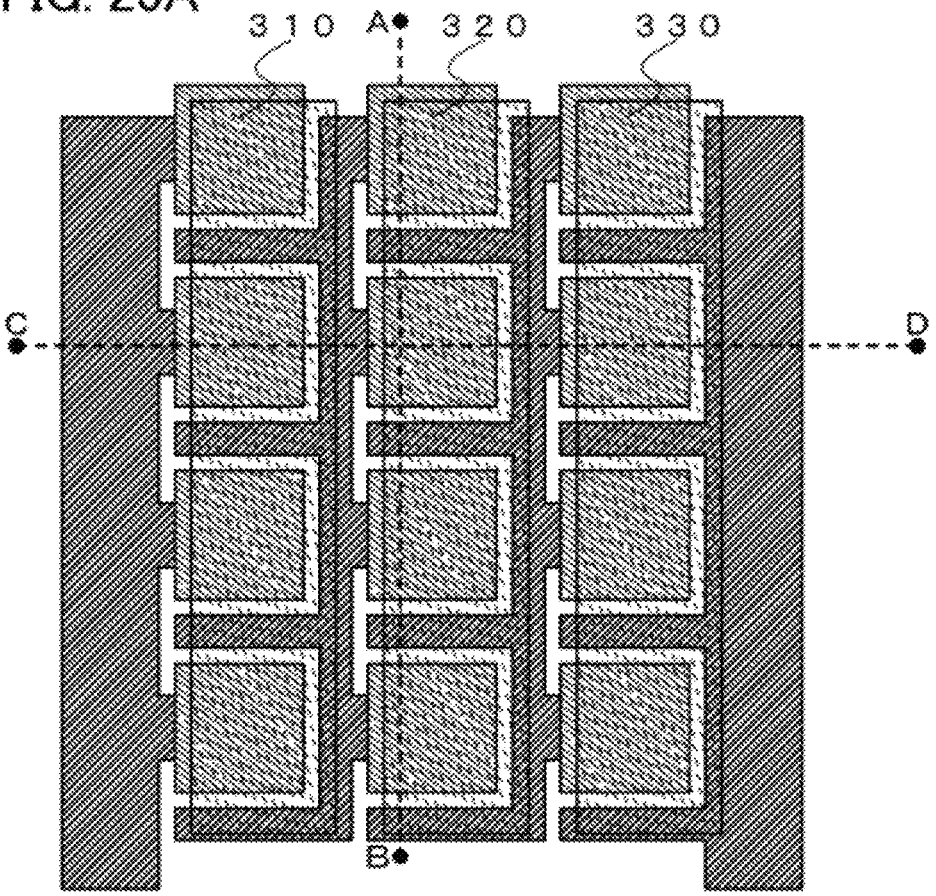
FIGS. 25A, 25B, and 25C illustrate an example of a method for manufacturing a circuit provided in a light-emitting device.
Figure 25B:
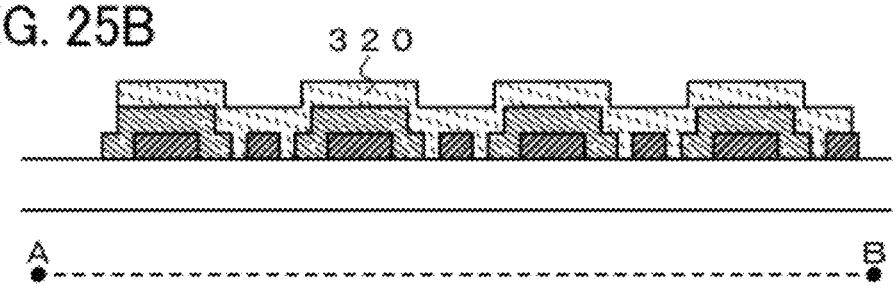
Figure 25C:
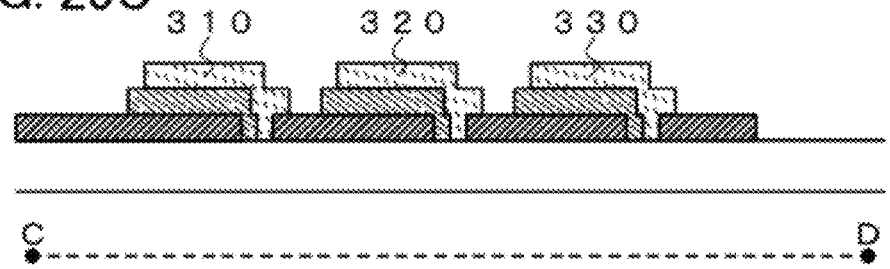

Further, in FIGS. 24A to 24C, the upper electrodes and the lower electrodes are electrically connected only in the column direction; however, it is preferable that the upper electrodes and the lower electrodes be electrically connected also in the row direction by extending the upper electrodes in the row direction as illustrated in FIGS. 25A to 25C.

The structure in FIGS. 25A to 25C is preferable because the number of current paths increases compared to the structure in FIGS. 24A to 24C.

That is, even when disconnection occurs in one of the row direction and the column direction, electrical connection is possible in the other of the row direction and the column direction, which is preferable.

Further, in the structure in FIGS. 25A to 25C, there is an advantage in that contact resistance can be reduced because the area of a connection portion increases compared to the structure in FIGS. 24A to 24C.

This embodiment can be implemented in combination with any of the other embodiments as appropriate.

(Embodiment 11)

An example of a method for manufacturing a circuit provided in a light-emitting device will be described.

In FIGS. 26A to 26C, FIGS. 27A to 27C, FIGS. 28A to 28C, FIGS. 29A to 29C, FIGS. 30A to 30C, FIGS. 31A to 31C, FIGS. 32A to 32C, and FIGS. 33A to 33C, FIG. 26A, FIG. 27A, FIG. 28A, FIG. 29A, FIG. 30A, FIG. 31A, FIG. 32A, and FIG. 33A are top views. FIG. 26B, FIG. 27B, FIG. 28B, FIG. 29B, FIG. 30B, FIG. 31B, FIG. 32B, and FIG. 33B are cross-sectional views along line A-B (cross-sectional views in a column direction) in FIG. 26A, FIG. 27A, FIG. 28A, FIG. 29A, FIG. 30A, FIG. 31A, FIG. 32A, and FIG. 33A, respectively. FIG. 26C, FIG. 27C, FIG. 28C, FIG. 29C, FIG. 30C, FIG. 31C, FIG. 32C, and FIG. 33C are cross-sectional views along line C-D (cross-sectional views in a row direction) in FIG. 26A, FIG. 27A, FIG. 28A, FIG. 29A, FIG. 30A, FIG. 31A, FIG. 32A, and FIG. 33A, respectively.

Figure 26A:
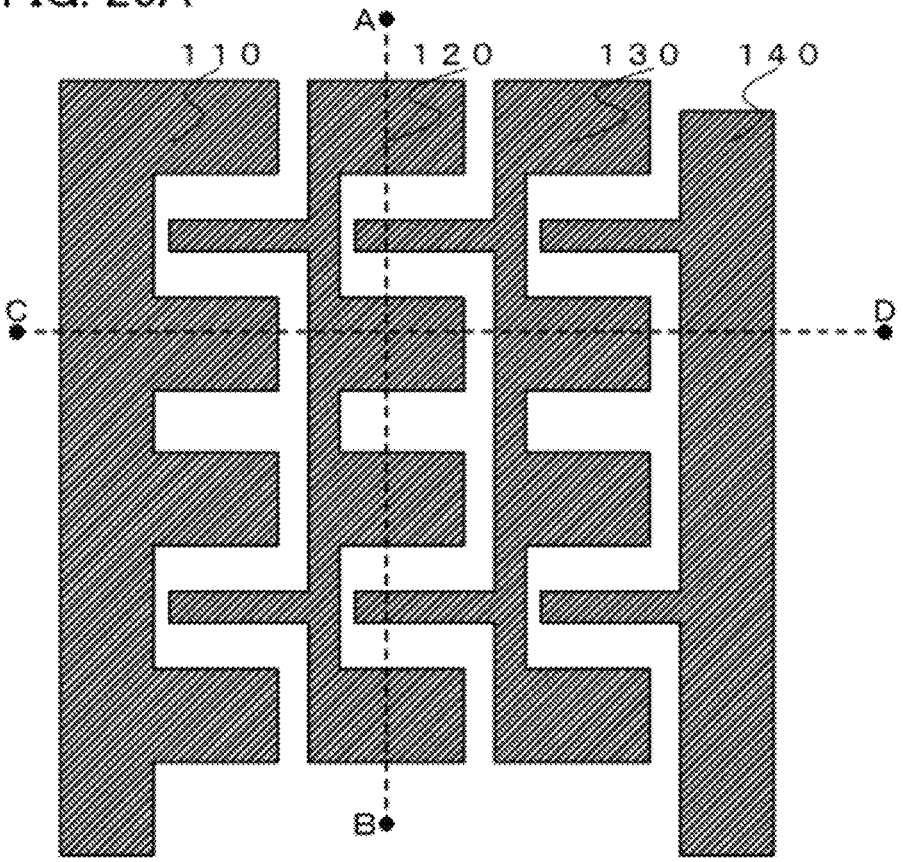
FIGS. 26A, 26B, and 26C illustrate an example of a method for manufacturing a circuit provided in a light-emitting device.
Figure 26B:
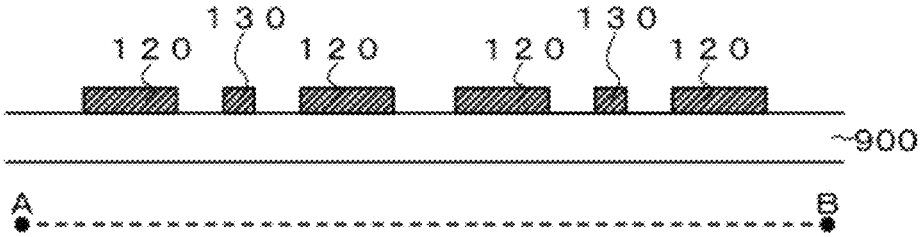
Figure 26C:
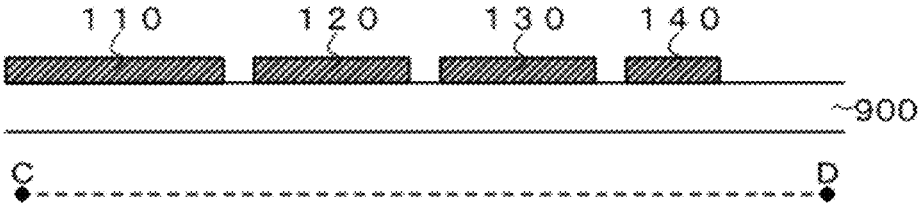

First, for a plurality of lower electrodes (lower wirings), lower electrodes 110, 120, 130, and 140 are formed over an insulating surface 900 (FIGS. 26A to 26C).

Figure 27A:
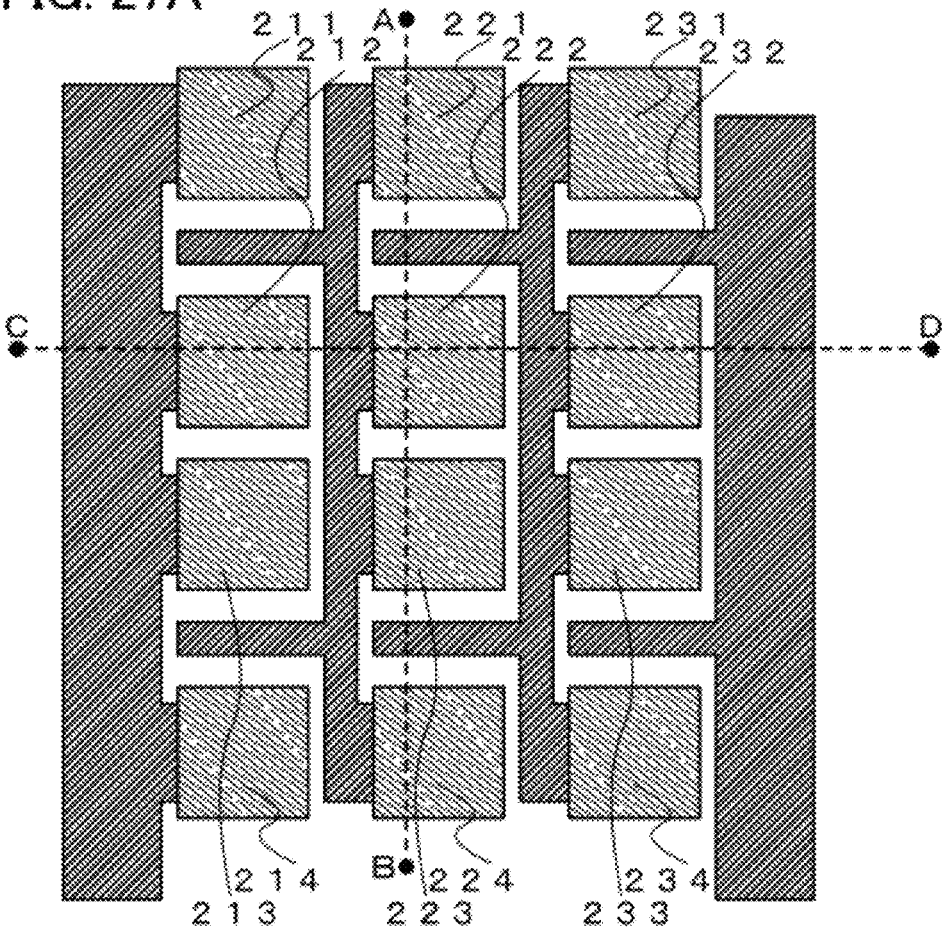
FIGS. 27A, 27B, and 27C illustrate an example of a method for manufacturing a circuit provided in a light-emitting device.
Figure 27B:
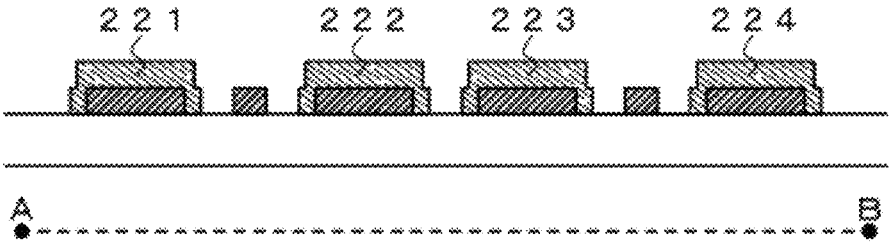
Figure 27C:
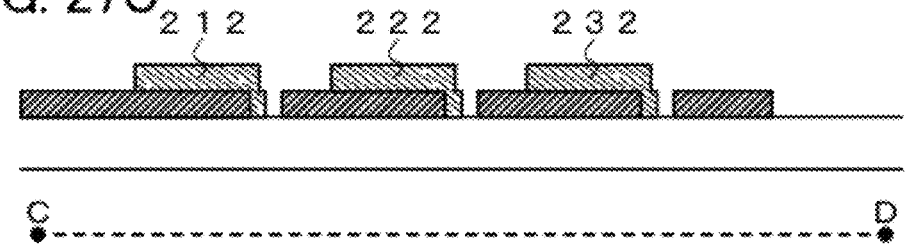

Next, for a plurality of light-emitting body layers, light-emitting body layers 211, 212, 213, 214, 221, 222, 223, 224, 231, 232, 233, and 234 are formed over the plurality of lower electrodes (lower wirings) (FIGS. 27A to 27C).

Figure 28A:
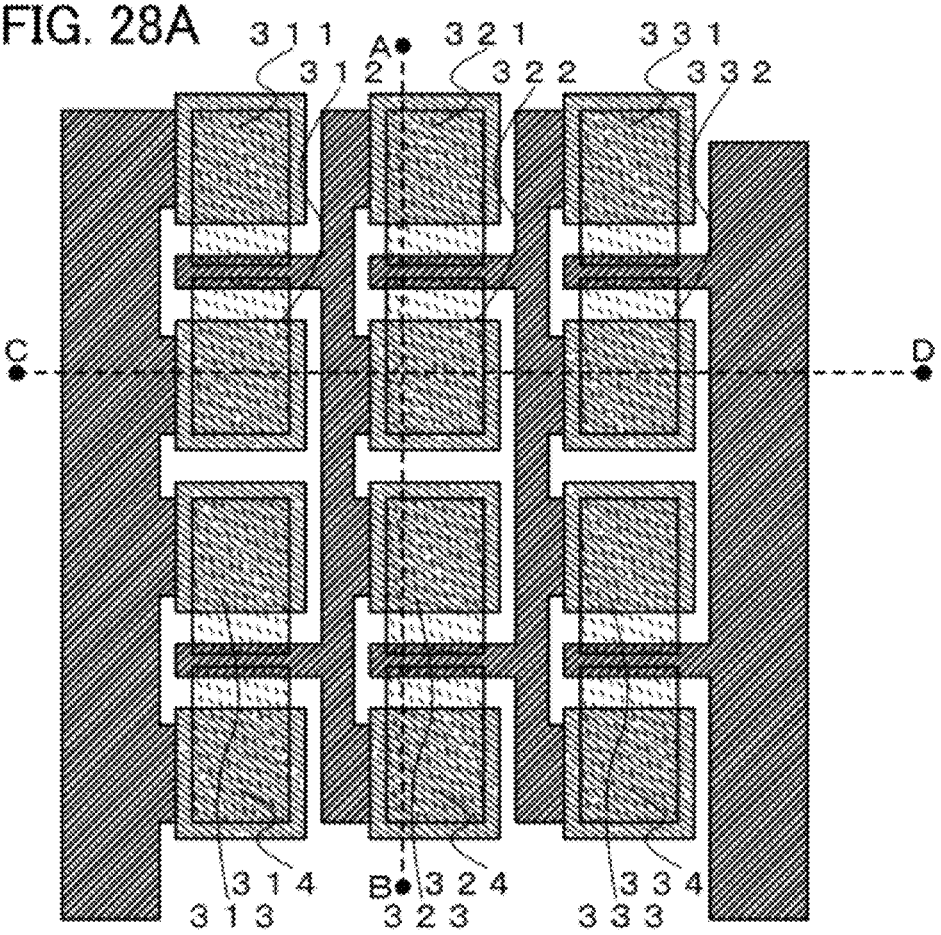
FIGS. 28A, 28B, and 28C illustrate an example of a method for manufacturing a circuit provided in a light-emitting device.
Figure 28B:
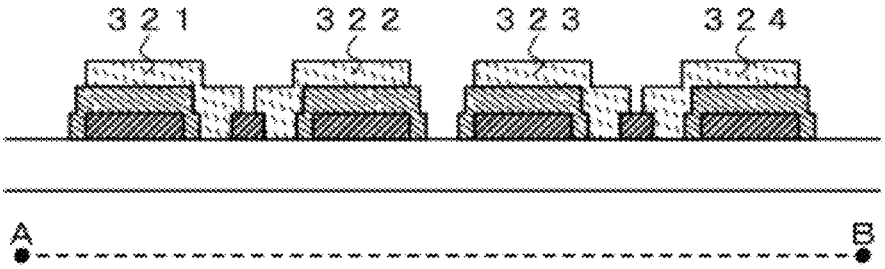
Figure 28C:
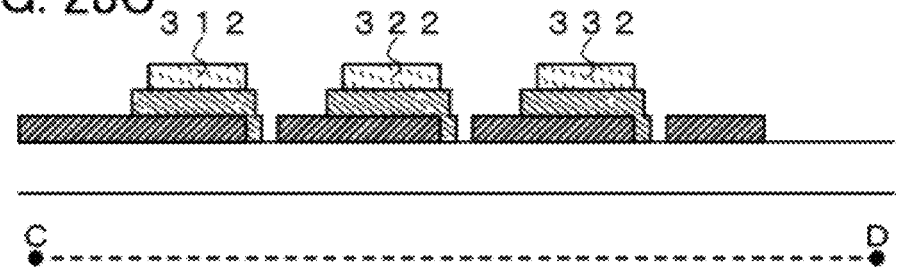

Next, for a plurality of upper electrodes (upper wirings), upper electrodes 311, 312, 313, 314, 321, 322, 323, 324, 331, 332, 333, and 334 are formed over the plurality of light-emitting body layers (FIGS. 28A to 28C).

Here, the shapes of the layers will be described.

The lower electrodes 110 to 140 are each formed in common in the column direction.

Here, the lower electrodes 120 and 130 each include a plurality of first island regions which extends to the C side in line C-D direction in FIG. 28A, a plurality of second island regions which extends to the D side in line C-D direction in FIG. 28A, and a third region for electrically connecting the plurality of first island regions and the plurality of second island regions.

Further, the lower electrode 110 includes a plurality of second island regions which extends to the D side in line C-D direction in FIG. 28A and a third region for connecting the plurality of second island regions electrically.

Furthermore, the lower electrode 140 includes a plurality of first island regions which extends to the C side in line C-D direction in FIG. 28A and a third region for connecting the plurality of first island regions electrically.

Here, the first island region is a portion where a connection portion for series connection is formed and the second island region is a portion where a light-emitting region is formed.

Here, in FIGS. 22A to 22C, one first island region (a connection portion) is provided for one light-emitting element. On the other hand, in FIGS. 28A to 28C, one first island region (a connection portion) is provided for two light-emitting elements adjacent to each other.

Further, with the structure in FIGS. 28A to 28C, the number of connection portions provided in spaces between the second island regions can be reduced; therefore, a space in the row direction can be effectively used and the aperture ratio can be improved.

In FIGS. 28A to 28C, the lower electrodes and the upper electrodes are provided so that two upper electrodes are connected to one first island region (a connection portion).

The plurality of light-emitting body layers each has an island shape.

Note that in this embodiment, the plurality of light-emitting body layers is divided in the row direction and in the column direction; however, there is no problem as long as each of the light-emitting body layers is not formed over a connection portion between the upper electrode in one light-emitting element and the lower electrode in another light-emitting element. Accordingly, the light-emitting body layers are not necessarily divided in the row direction and in the column direction.

Here, in order to connect the light-emitting element groups provided in the row direction in series, the upper electrode in one light-emitting element and the lower electrode in another light-emitting element need to be connected electrically; therefore, the light-emitting body layer is formed so that part of the lower electrode is exposed.

Further, when the upper electrode in one light-emitting element and the lower electrode in the light-emitting element are connected electrically, a short circuit is caused between the upper electrode and the lower electrode, and the upper electrode and the lower electrode have the same potential. Thus, a current does not flow to the light-emitting body layer in the light-emitting element.

Accordingly, in order to prevent a short circuit between the upper electrode in one light-emitting element and the lower electrode in the light-emitting element, it is preferable that the light-emitting body layer have a larger area than the light-emitting region and a portion overlapping with the upper electrode in an end portion of the lower electrode be covered with the light-emitting body layer.

Further, as illustrated in FIGS. 28A to 28C, an upper electrode is formed so that part of a light-emitting body layer protrudes from the upper electrode, whereby the probability of a short circuit between the upper electrode in one light-emitting element and the lower electrode in the light-emitting element can be reduced in the case where misalignment of a pattern occurs.

Further, as a countermeasure against misalignment of a pattern in the row direction, it is preferable that the first island region of the lower electrode have a linear shape which extends in the row direction.

The first island region of the lower electrode has a linear shape which extends in the row direction, whereby a countermeasure against misalignment of a pattern can be taken without increase in a space in the column direction (a space between the second island regions adjacent in the column direction).

Figure 29A:
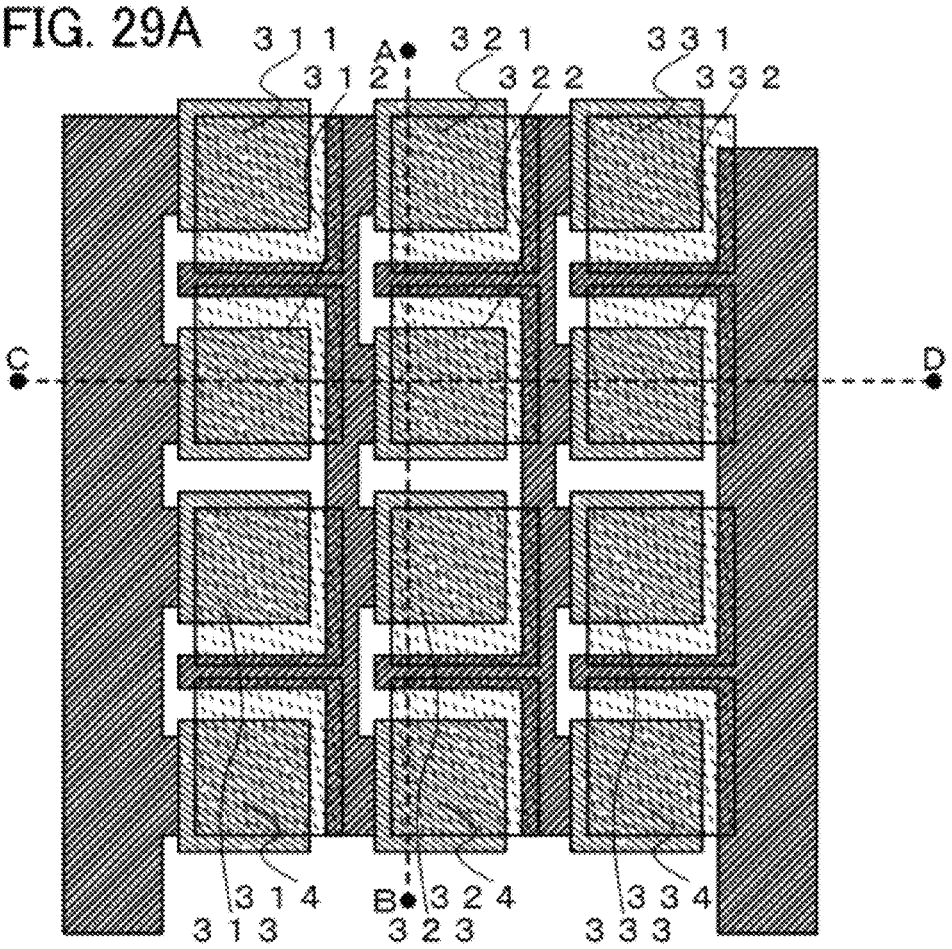
FIGS. 29A, 29B, and 29C illustrate an example of a method for manufacturing a circuit provided in a light-emitting device.
Figure 29B:
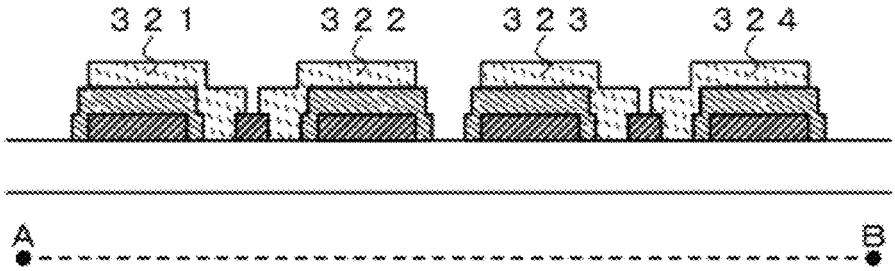
Figure 29C:
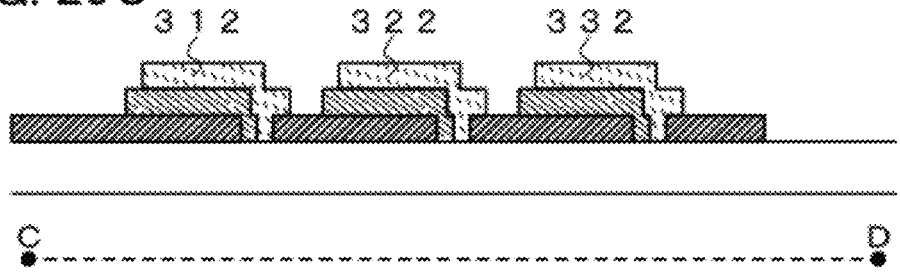

Further, in FIGS. 28A to 28C, the upper electrodes and the lower electrodes are electrically connected only in the column direction; however, it is preferable that the upper electrodes and the lower electrodes be electrically connected also in the row direction by extending the upper electrodes in the row direction as illustrated in FIGS. 29A to 29C.

The structure in FIGS. 29A to 29C is preferable because the number of current paths increases compared to the structure in FIGS. 28A to 28C.

That is, even when disconnection occurs in one of the row direction and the column direction, electrical connection is possible in the other of the row direction and the column direction, which is preferable.

Further, in the structure in FIGS. 29A to 29C, there is an advantage in that contact resistance can be reduced because the area of a connection portion increases compared to the structure in FIGS. 28A to 28C.

Furthermore, in the structure in FIGS. 28A to 28C, when misalignment of a pattern of an upper electrode occurs in the column direction, there is a problem in that a bad connection between the upper electrode and the lower electrode is easily caused.

In view of the above, as illustrated in FIGS. 30A to 30C and FIGS. 32A to 32C, a structure in which an upper electrode is provided in common in the column direction is employed, whereby the length in the column direction can have an enough space; therefore, the above problem can be solved.

Figure 30A:
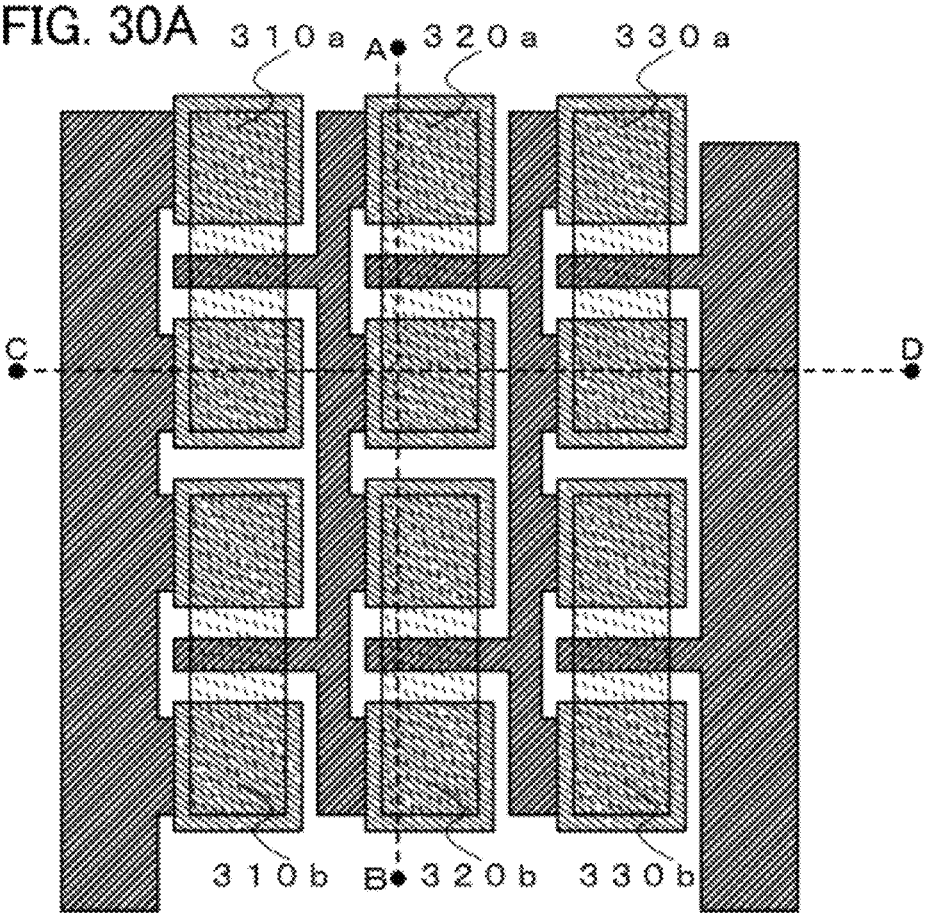
FIGS. 30A, 30B, and 30C illustrate an example of a method for manufacturing a circuit provided in a light-emitting device.
Figure 30B:
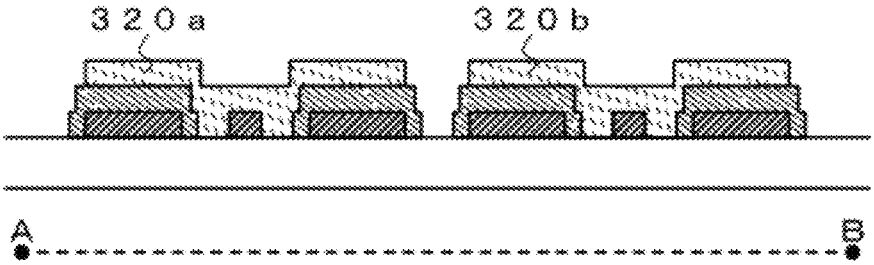
Figure 30C:
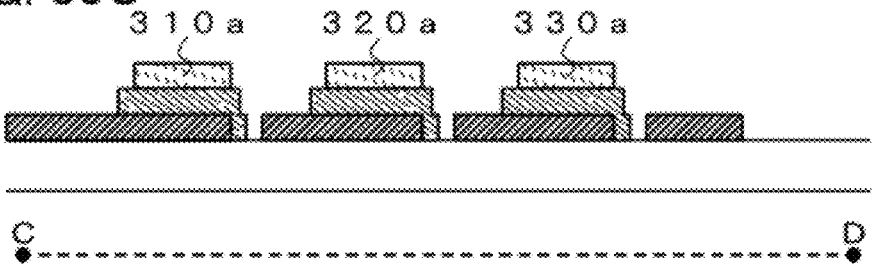
Figure 31A:
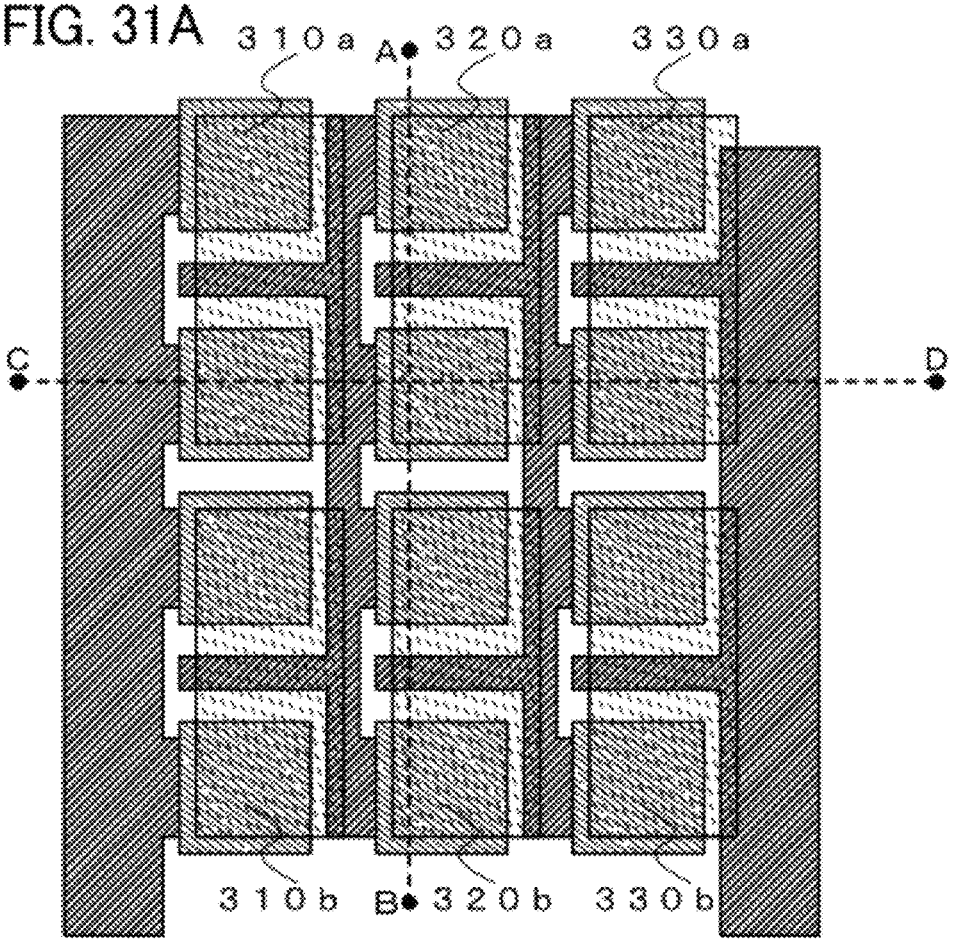
FIGS. 31A, 31B, and 31C illustrate an example of a method for manufacturing a circuit provided in a light-emitting device.
Figure 31B:
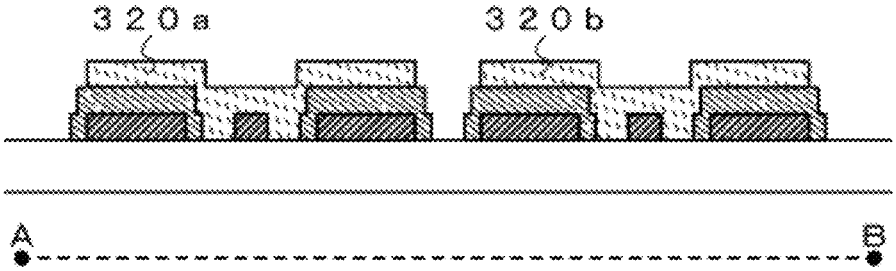
Figure 31C:
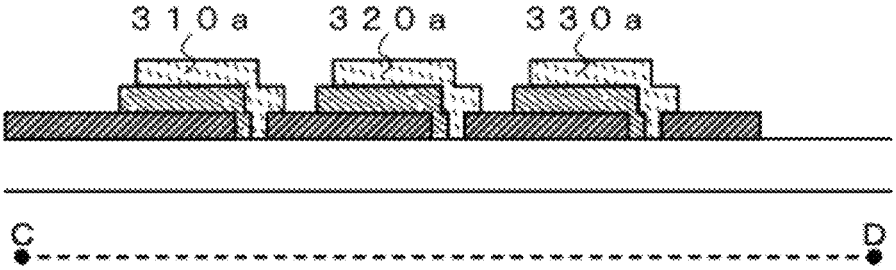

Specifically, as illustrated in FIGS. 30A to 30C, the upper electrodes (the upper electrodes 310*a*, 320*a*, 330*a*, 310*b*, 320*b*, and 330*b*) each preferably have a linear shape across two light-emitting elements and are each provided so as to intersect with the first island region provided between the two light-emitting elements.

Figure 32A:
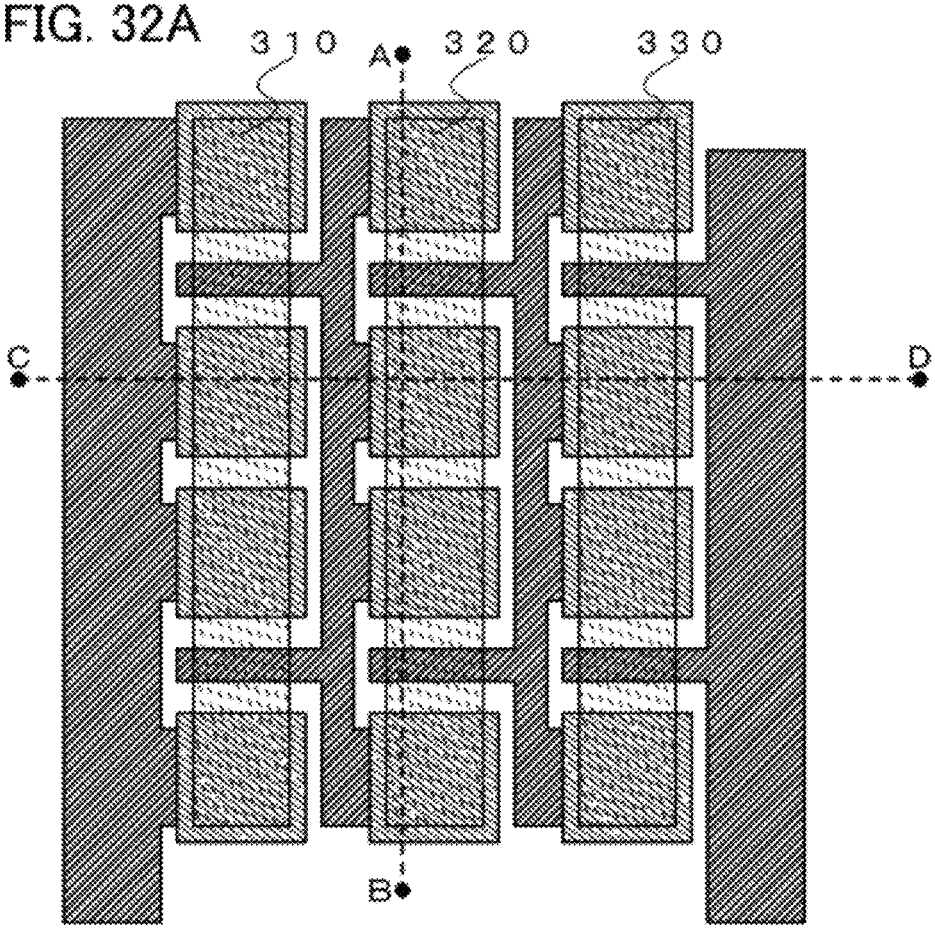
FIGS. 32A, 32B, and 32C illustrate an example of a method for manufacturing a circuit provided in a light-emitting device.
Figure 32B:
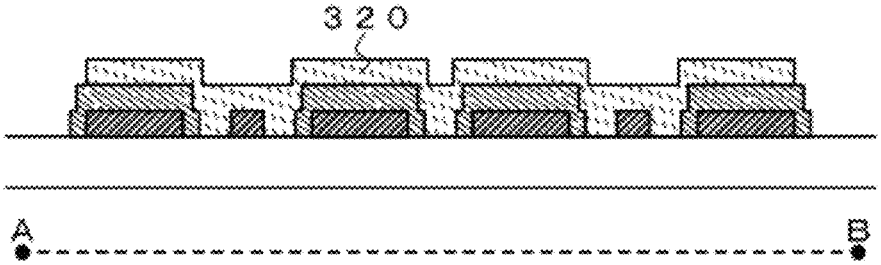
Figure 32C:
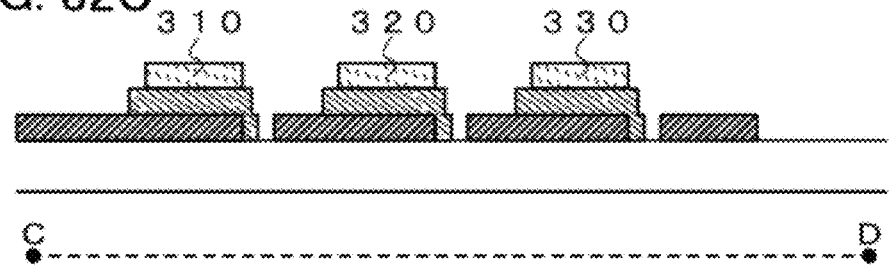
Figure 33A:
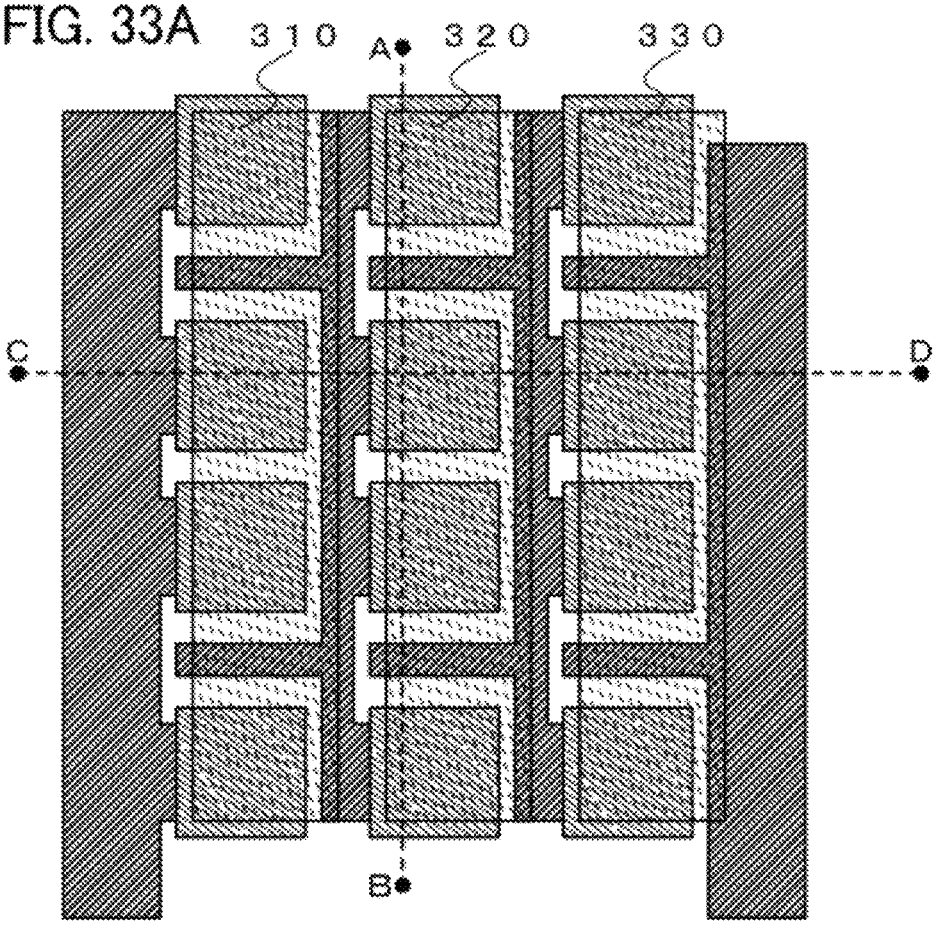
FIGS. 33A, 33B, and 33C illustrate an example of a method for manufacturing a circuit provided in a light-emitting device.
Figure 33B:
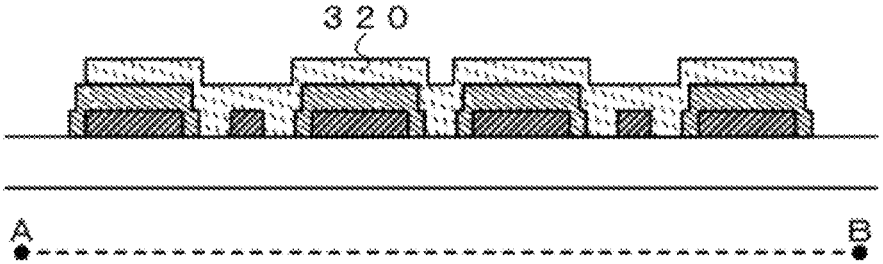
Figure 33C:
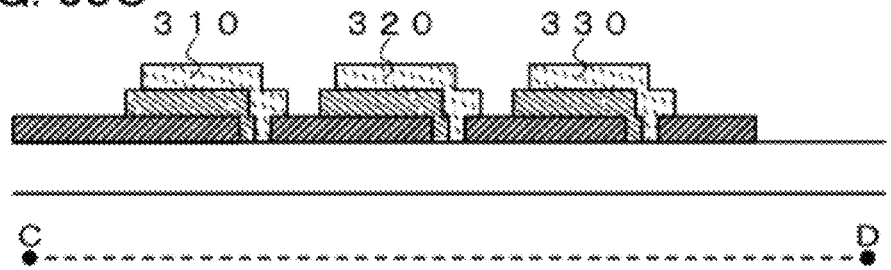

Specifically, as illustrated in FIGS. 32A to 32C, the upper electrodes (the upper electrodes 310, 320, and 330) each preferably have a linear shape and are each provided so as to intersect with a plurality of first island regions of lower electrodes.

Further, in FIGS. 30A to 30C and FIGS. 32A to 32C, the upper electrodes and the lower electrodes are electrically connected only in the column direction; however, it is preferable that the upper electrodes and the lower electrodes be electrically connected also in the row direction by extending the upper electrodes in the row direction as illustrated in FIGS. 31A to 31C and FIGS. 33A to 33C.

The structures in FIGS. 31A to 31C and FIGS. 33A to 33C are preferable because the number of current paths increases compared to the structures in FIGS. 30A to 30C and FIGS. 32A to 32C.

That is, even when disconnection occurs in one of the row direction and the column direction, electrical connection is possible in the other of the row direction and the column direction, which is preferable.

Further, in the structures in FIGS. 31A to 31C and FIGS. 33A to 33C, there is an advantage in that contact resistance can be reduced because the area of a connection portion increases compared to the structures in FIGS. 30A to 30C and FIGS. 32A to 32C.

This embodiment can be implemented in combination with any of the other embodiments as appropriate.

(Embodiment 12)

An example of a method for manufacturing a circuit provided in a light-emitting device will be described.

In FIGS. 34A to 34C, FIGS. 35A to 35C, FIGS. 36A to 36C, FIGS. 37A to 37C, FIGS. 38A to 38C, and FIGS. 39A to 39C, FIG. 34A, FIG. 35A, FIG. 36A, FIG. 37A, FIG. 38A, and FIG. 39A are top views. FIG. 34B, FIG. 35B, FIG. 36B, FIG. 37B, FIG. 38B, and FIG. 39B are cross-sectional views along line A-B (cross-sectional views in a column direction) in FIG. 34A, FIG. 35A, FIG. 36A, FIG. 37A, FIG. 38A, and FIG. 39A, respectively. FIG. 34C, FIG. 35C, FIG. 36C, FIG. 37C, FIG. 38C, and FIG. 39C are cross-sectional views along line C-D (cross-sectional views in a row direction) in FIG. 34A, FIG. 35A, FIG. 36A, FIG. 37A, FIG. 38A, and FIG. 39A, respectively.

Figure 34A:
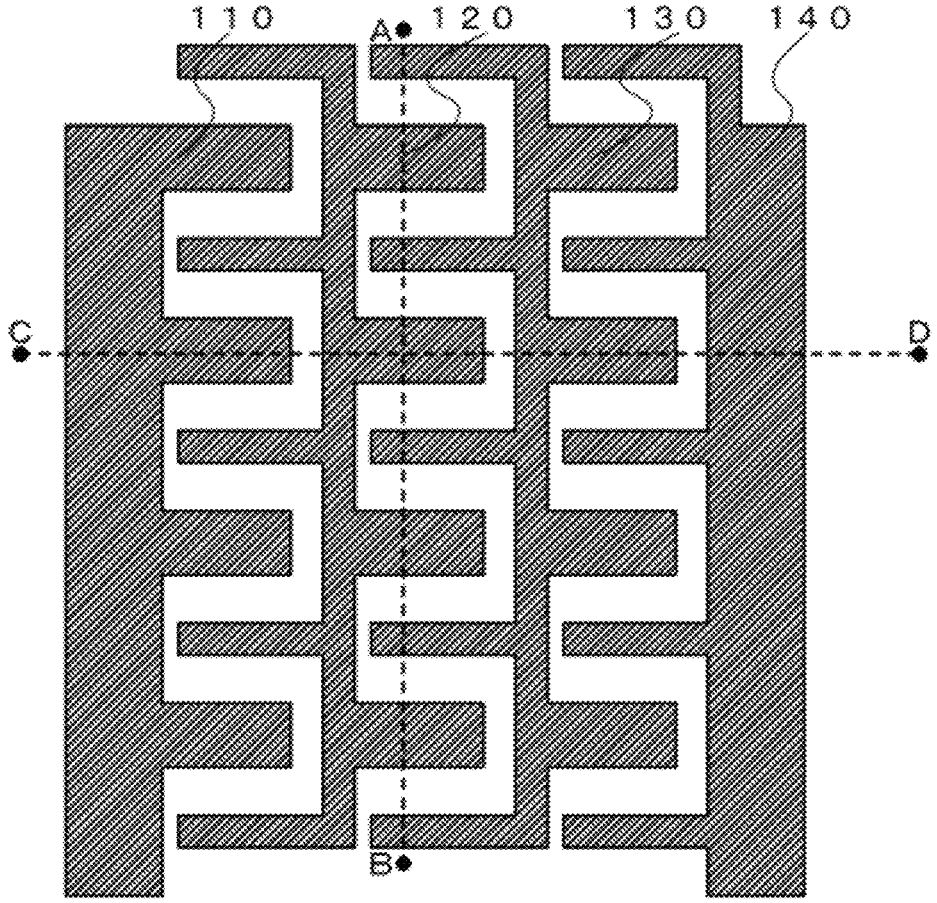
FIGS. 34A, 34B, and 34C illustrate an example of a method for manufacturing a circuit provided in a light-emitting device.
Figure 34B:
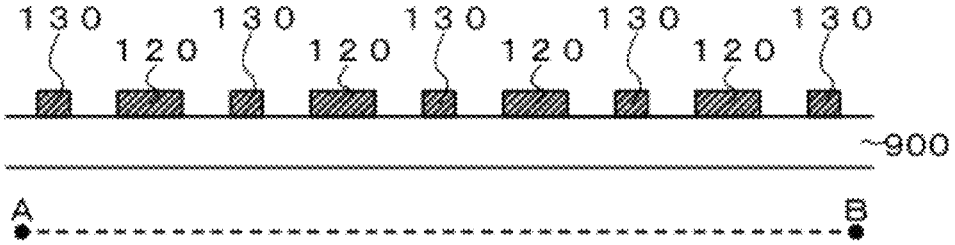
Figure 34C:
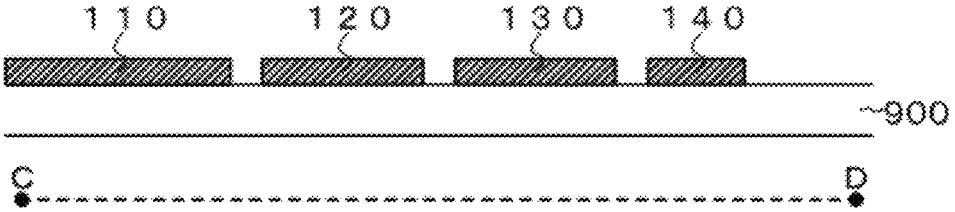

First, for a plurality of lower electrodes (lower wirings), lower electrodes 110, 120, 130, and 140 are formed over an insulating surface 900 (FIGS. 34A to 34C).

Figure 35A:
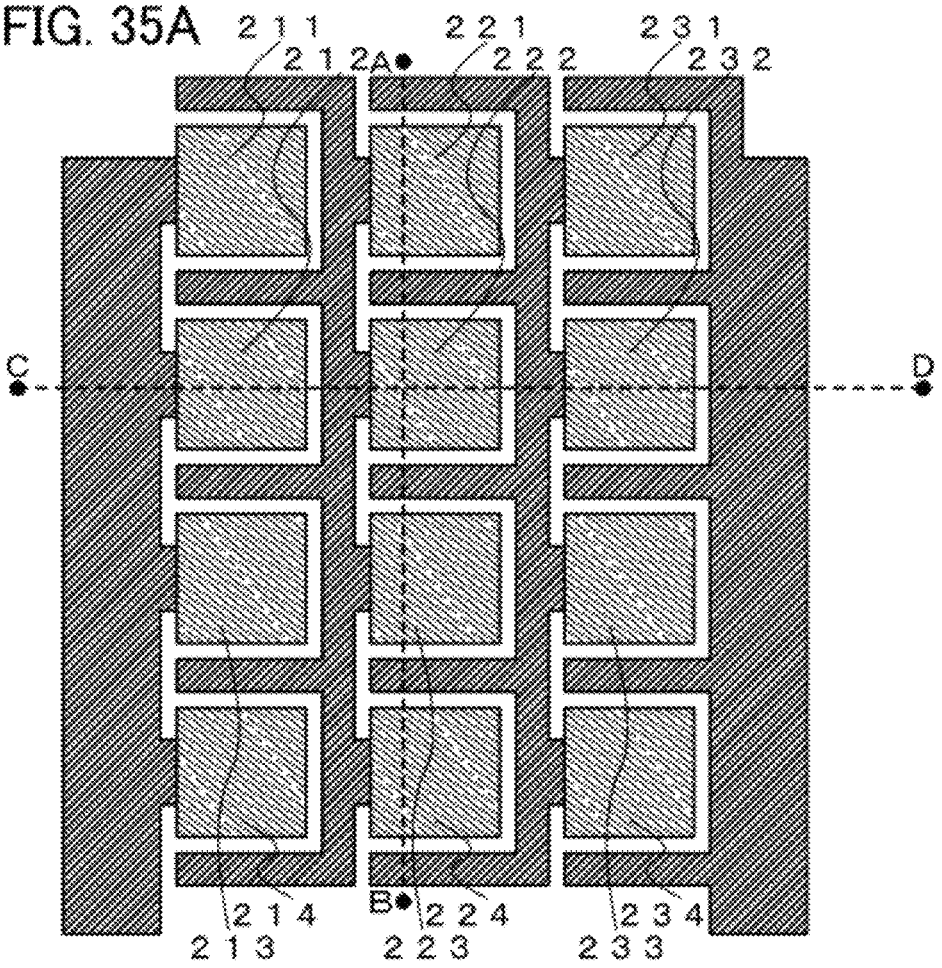
FIGS. 35A, 35B, and 35C illustrate an example of a method for manufacturing a circuit provided in a light-emitting device.
Figure 35B:
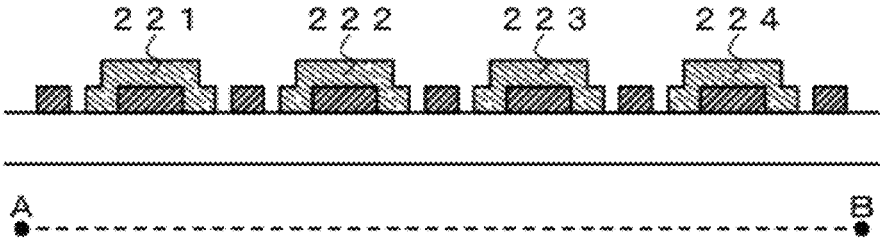
Figure 35C:
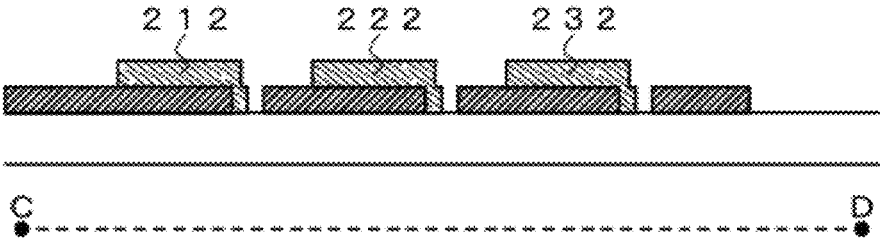

Next, for a plurality of light-emitting body layers, light-emitting body layers 211, 212, 213, 214, 221, 222, 223, 224, 231, 232, 233, and 234 are formed over the plurality of lower electrodes (lower wirings) (FIGS. 35A to 35C).

Figure 36A:
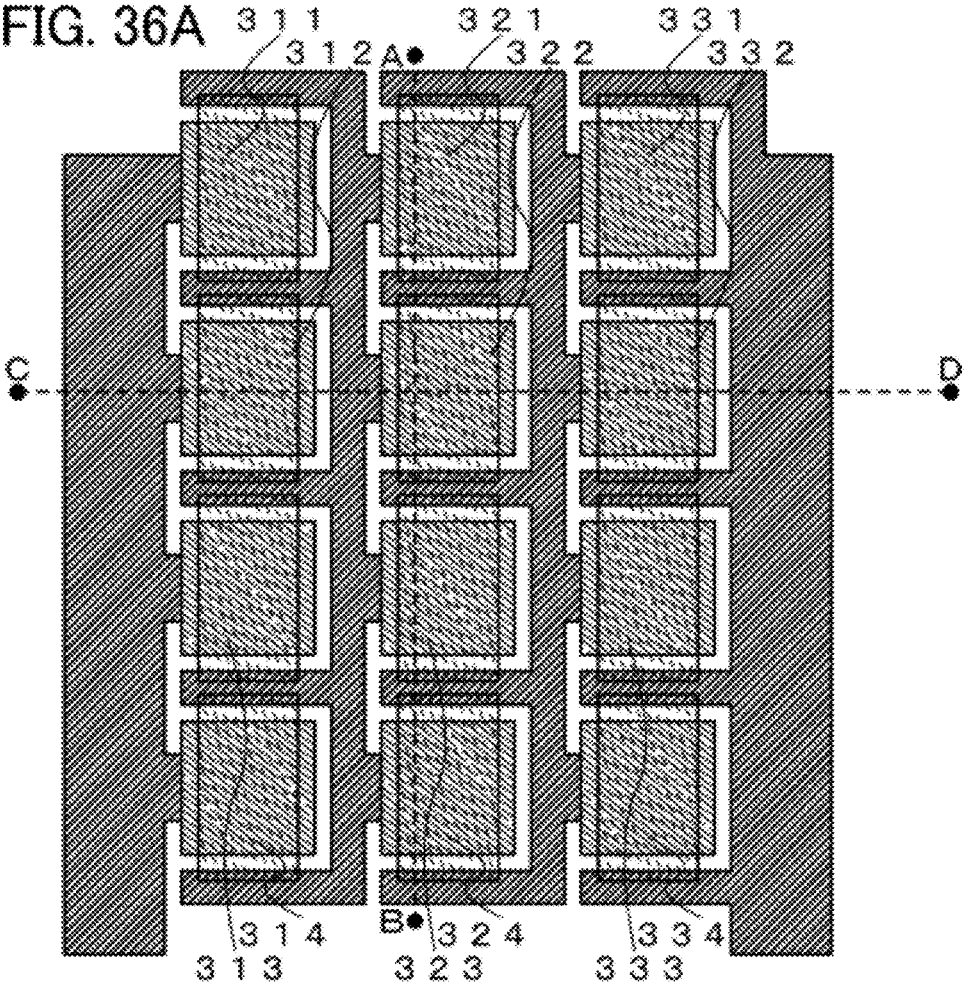
FIGS. 36A, 36B, and 36C illustrate an example of a method for manufacturing a circuit provided in a light-emitting device.
Figure 36B:
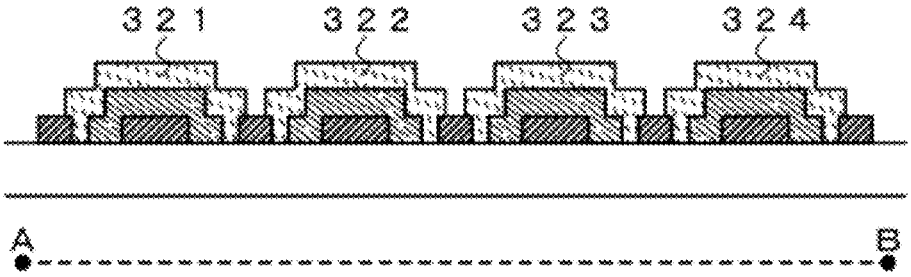
Figure 36C:
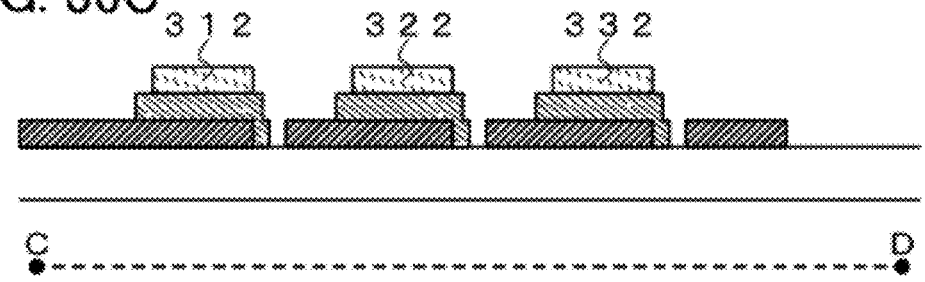

Next, for a plurality of upper electrodes (upper wirings), upper electrodes 311, 312, 313, 314, 321, 322, 323, 324, 331, 332, 333, and 334 are formed over the plurality of light-emitting body layers (FIGS. 36A to 36C).

Here, the shapes of the layers will be described.

The lower electrodes 110 to 140 are each formed in common in the column direction.

Here, the lower electrodes 120 and 130 each include a plurality of first island regions which extends to the C side in line C-D direction in FIG. 36A, a plurality of second island regions which extends to the D side in line C-D direction in FIG. 36A, and a third region for connecting electrically the plurality of first island regions and the plurality of second island regions.

Further, the lower electrode 110 includes a plurality of second island regions which extends to the D side in line C-D direction in FIG. 36A and a third region for connecting the plurality of second island regions electrically.

Furthermore, the lower electrode 140 includes a plurality of first island regions which extends to the C side in line C-D direction in FIG. 36A and a third region for connecting the plurality of first island regions electrically.

Here, the first island region is a portion where a connection portion for series connection is formed and the second island region is a portion where a light-emitting region is formed.

Further, the plurality of first island regions in one lower electrode and the plurality of second island regions in an adjacent lower electrode are alternately arranged in the column direction.

That is, a first comb-shaped electrode (part of one lower electrode) and a second comb-shaped electrode (part of an adjacent lower electrode) are formed so as to engage with each other.

In FIGS. 36A to 36C, the lower electrodes and the upper electrodes are provided so that one upper electrode is connected to two first island regions (connection portions).

Here, in the case of FIGS. 22A to 22C, an upper electrode and a lower electrode are electrically connected only at one portion in the column direction. Therefore, when misalignment of a pattern occurs in the column direction, there is a problem in that a bad connection between the upper electrode and the lower electrode is easily caused.

Accordingly, as illustrated in FIGS. 34A to 34C, FIGS. 35A to 35C, FIGS. 36A to 36C, FIGS. 37A to 37C, FIGS. 38A to 38C, and FIGS. 39A to 39C, an upper electrode and a lower electrode are electrically connected using two connection portions between which a second island region is sandwiched in the column direction, whereby even when misalignment of a pattern occurs in the column direction, electrical connection of at least one of the two connection portions is possible, so that the above problem can be solved.

The plurality of light-emitting body layers each has an island shape.

Note that in this embodiment, the plurality of light-emitting body layers is divided in the row direction and in the column direction; however, there is no problem as long as each of the light-emitting body layers is not formed over a connection portion between the upper electrode in one light-emitting element and the lower electrode in another light-emitting element. Accordingly, the light-emitting body layers are not necessarily divided in the row direction and in the column direction.

Here, in order to connect the light-emitting element groups provided in the row direction in series, the upper electrode in one light-emitting element and the lower electrode in another light-emitting element need to be connected electrically; therefore, the light-emitting body layer is formed so that part of the lower electrode is exposed.

Further, when the upper electrode in one light-emitting element and the lower electrode in the light-emitting element are connected electrically, a short circuit is caused between the upper electrode and the lower electrode, and the upper electrode and the lower electrode have the same potential. Thus, a current does not flow to the light-emitting body layer in the light-emitting element.

Accordingly, in order to prevent a short circuit between the upper electrode in one light-emitting element and the lower electrode in the light-emitting element, it is preferable that the light-emitting body layer have a larger area than the light-emitting region and a portion overlapping with the upper electrode in an end portion of the lower electrode be covered with the light-emitting body layer.

Further, as illustrated in FIGS. 36A to 36C, an upper electrode is formed so that part of a light-emitting body layer protrudes from the upper electrode, whereby the probability of a short circuit between the upper electrode in one light-emitting element and the lower electrode in the light-emitting element can be reduced in the case where misalignment of a pattern occurs.

Further, as a countermeasure against misalignment of a pattern in the row direction, it is preferable that the first island region of the lower electrode have a linear shape which extends in the row direction.

The first island region of the lower electrode has a linear shape which extends in the row direction, whereby a countermeasure against misalignment of a pattern can be taken without increase in a space in the column direction (a space between the second island regions adjacent in the column direction).

Figure 37A:
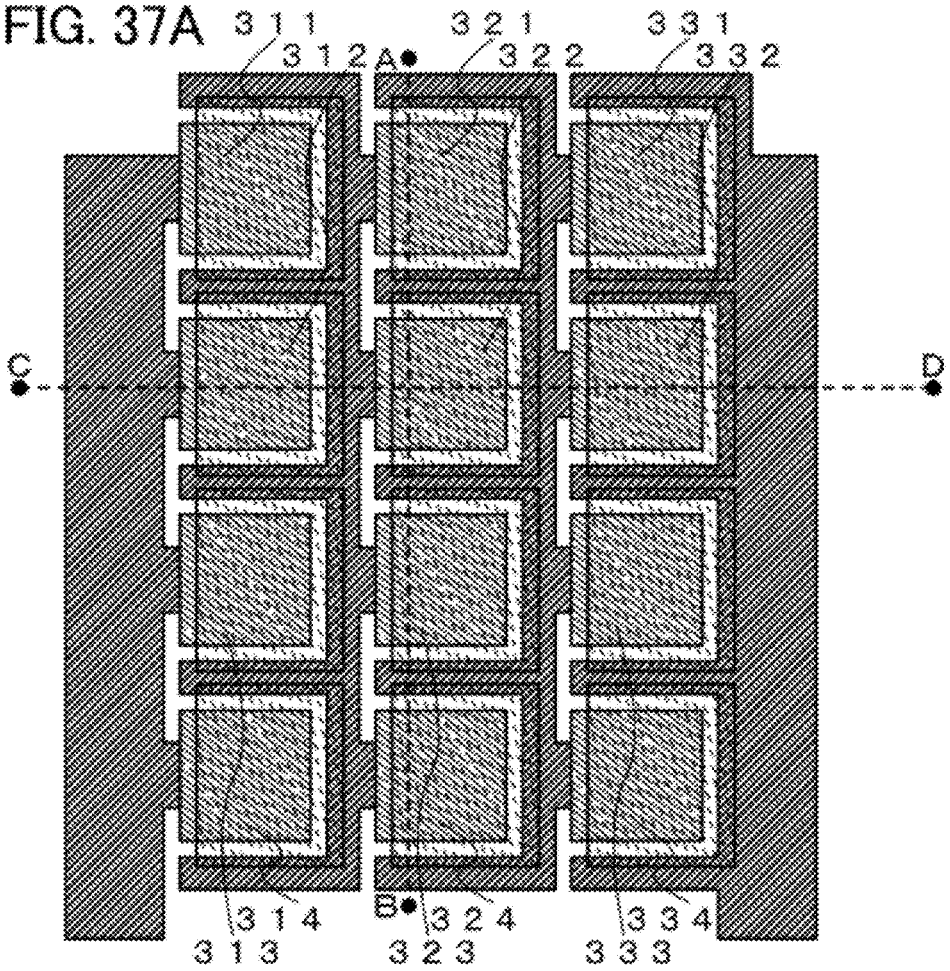
FIGS. 37A, 37B, and 37C illustrate an example of a method for manufacturing a circuit provided in a light-emitting device.
Figure 37B:
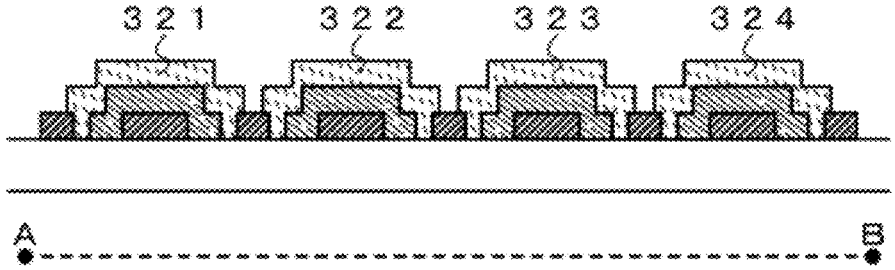
Figure 37C:
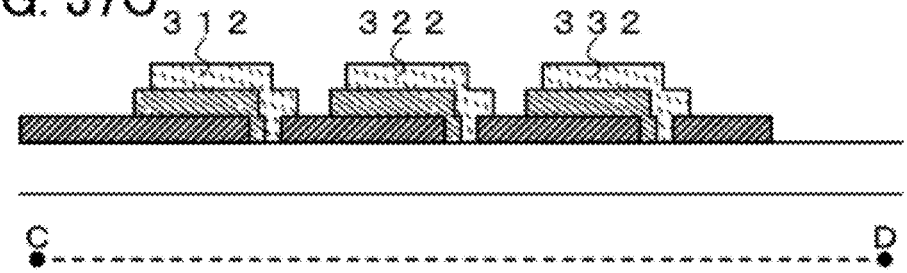

Further, in FIGS. 36A to 36C, the upper electrodes and the lower electrodes are electrically connected only in the column direction; however, it is preferable that the upper electrodes and the lower electrodes be electrically connected also in the row direction by extending the upper electrodes in the row direction as illustrated in FIGS. 37A to 37C.

The structure in FIGS. 37A to 37C is preferable because the number of current paths increases compared to the structure in FIGS. 36A to 36C.

That is, even when disconnection occurs in one of the row direction and the column direction, electrical connection is possible in the other of the row direction and the column direction, which is preferable.

Further, in the structure in FIGS. 37A to 37C, there is an advantage in that contact resistance can be reduced because the area of a connection portion increases compared to the structure in FIGS. 36A to 36C.

Furthermore, in the structure in FIGS. 36A to 36C, when misalignment of a pattern of an upper electrode occurs in the column direction, connection of one of the two connection portions is lost in some cases.

Figure 38A:
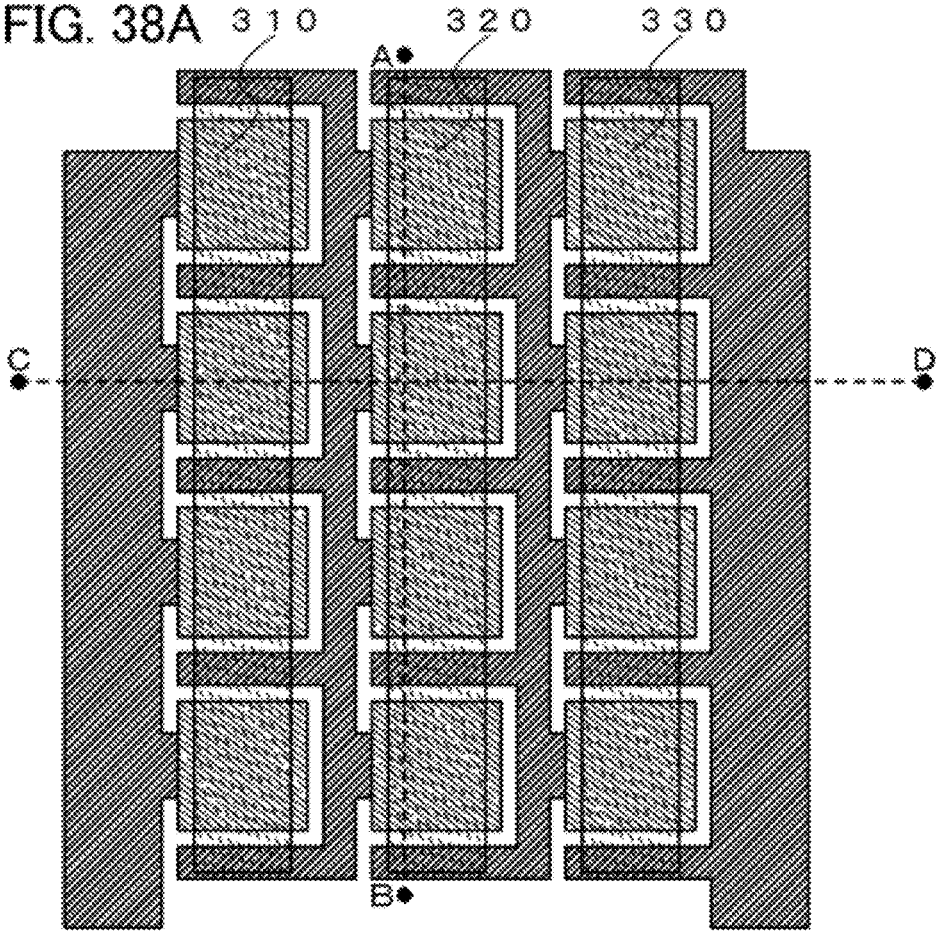
FIGS. 38A, 38B, and 38C illustrate an example of a method for manufacturing a circuit provided in a light-emitting device.
Figure 38B:
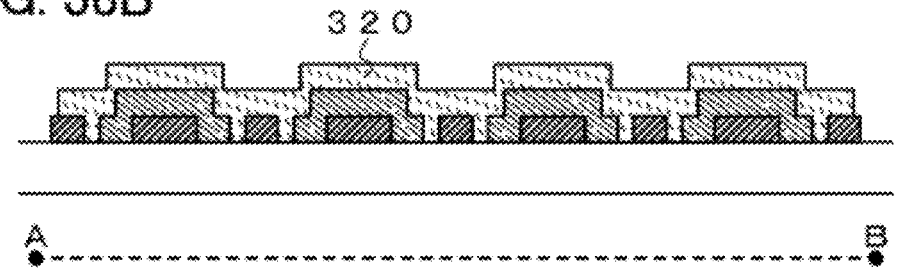
Figure 38C:
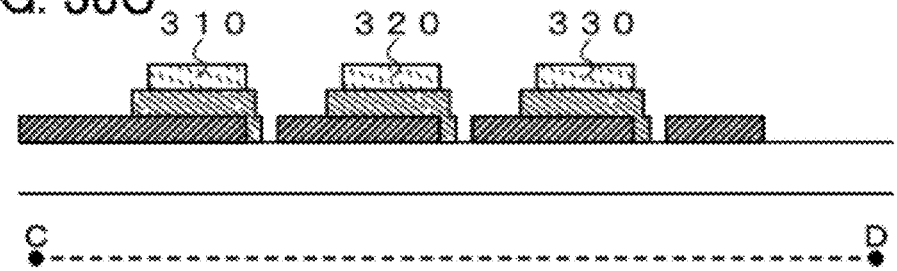

In view of the above, as illustrated in FIGS. 38A to 38C, a structure in which an upper electrode is provided in common in every column is employed, whereby the length in the column direction can have an enough space; therefore, the above problem can be solved.

Specifically, as illustrated in FIGS. 38A to 38C, the upper electrodes (the upper electrodes 310, 320, and 330) each preferably have a linear shape and are each provided so as to intersect with a plurality of first island regions of lower electrodes.

Figure 39A:
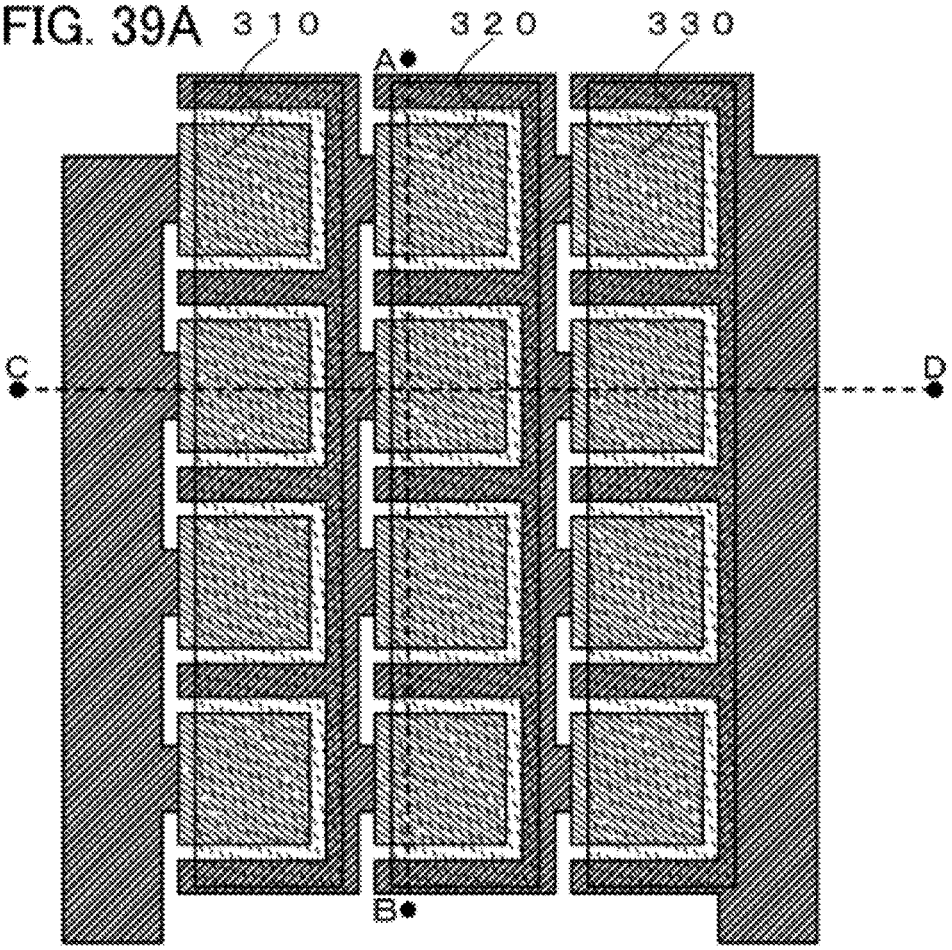
FIGS. 39A, 39B, and 39C illustrate an example of a method for manufacturing a circuit provided in a light-emitting device.
Figure 39B:
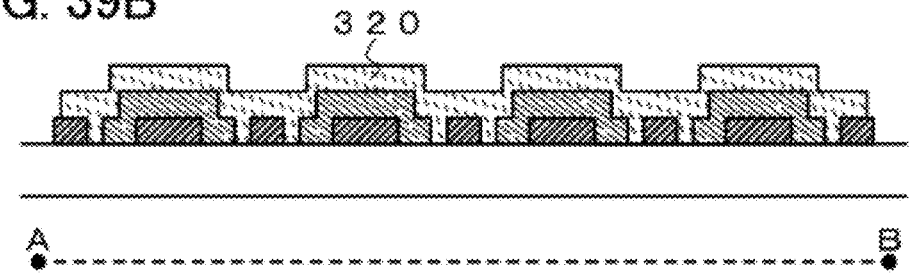
Figure 39C:
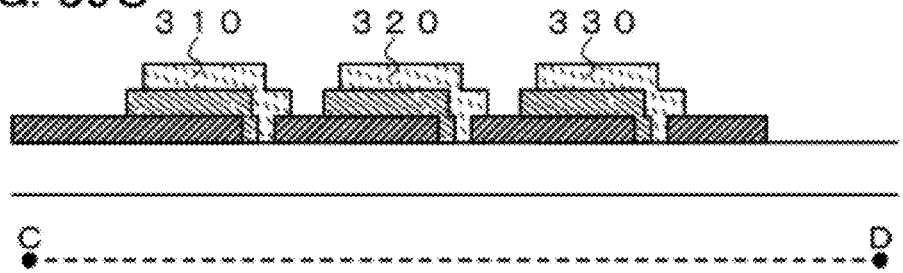

Further, in FIGS. 38A to 38C, the upper electrodes and the lower electrodes are electrically connected only in the column direction; however, it is preferable that the upper electrodes and the lower electrodes be electrically connected also in the row direction by extending the upper electrodes in the row direction as illustrated in FIGS. 39A to 39C.

The structure in FIGS. 39A to 39C is preferable because the number of current paths increases compared to the structure in FIGS. 38A to 38C.

That is, even when disconnection occurs in one of the row direction and the column direction, electrical connection is possible in the other of the row direction and the column direction, which is preferable.

Further, in the structure in FIGS. 39A to 39C, there is an advantage in that contact resistance can be reduced because the area of a connection portion increases compared to the structure in FIGS. 38A to 38C.

This embodiment can be implemented in combination with any of the other embodiments as appropriate.

(Embodiment 13)

Materials of the layers will be described.

As the insulating surface, a substrate having an insulating surface, an interlayer insulating film formed over a substrate with a switching element, a wiring, or the like interposed therebetween or the like is given.

For the substrate, any material can be used. For example, a glass substrate, a quartz substrate, a metal substrate, a plastic substrate, a semiconductor substrate, or a paper substrate can be used, but the substrate is not limited to these examples.

Note that a plastic substrate, a metal substrate, a paper substrate, and the like can easily be made flexible by having a small thickness.

The flexible substrate is preferable in that it has pliability and does not easily crack.

In the case where an insulating substrate is used as the substrate, the substrate has an insulating surface.

On the other hand, in the case where a metal substrate, a semiconductor substrate, or the like is used as the substrate, the substrate can have an insulating surface when a base insulating film is formed over the substrate.

Note that a base insulating film may be formed over the substrate also in the case where an insulating substrate is used as the substrate.

As the base insulating film and the interlayer insulating film, any material having an insulating property can be used. For example, a silicon oxide film, a silicon nitride film, a silicon oxide film including nitrogen, a silicon nitride film including oxygen, an aluminum nitride film, an aluminum oxide film, a film obtained by oxidizing or nitriding a semiconductor layer, a film obtained by oxidizing or nitriding a semiconductor substrate, a hafnium oxide film, or the like can be used, but the base insulating film and the interlayer insulating film are not limited to these examples. The base insulating film and the interlayer insulating film may have a single-layer structure or a stacked-layer structure.

As the lower electrode and the upper electrode, any material having conductivity can be used. For example, metal, an oxide conductor, or the like can be used, but the lower electrode and the upper electrode are not limited to these examples.

For instance, as the lower electrode and the upper electrode, metal nitride, metal oxide, or a metal alloy which has conductivity may be used.

The lower electrode and the upper electrode may have a single-layer structure or a stacked-layer structure.

Examples of the metal include, but not limited to, tungsten, titanium, aluminum, molybdenum, gold, silver, copper, platinum, palladium, iridium, alkali metal, alkaline-earth metal, and the like.

Examples of the oxide conductor include, but not limited to, indium tin oxide, zinc oxide, zinc oxide containing indium, zinc oxide containing indium and gallium, and the like.

When an organic EL element is formed, a material having a low work function (e.g., alkali metal, alkaline-earth metal, a magnesium-silver alloy, an aluminum-lithium alloy, or a magnesium-lithium alloy) is preferably applied to a cathode.

When an organic EL element is formed, a material having a high work function (e.g., an oxide conductor) is preferably applied to an anode.

Because light needs to be extracted from the light-emitting element, at least one of the lower electrode and the upper electrode has a light-transmitting property.

When each of the lower electrode, the upper electrode, the first substrate, and the second substrate has a light-transmitting property, it is possible to provide a lighting device from both surfaces of which light can be extracted (a dual-emission lighting device).

Note that an oxide conductor has a light-transmitting property.

Further, a light-transmitting property can be realized even with metal, metal nitride, metal oxide, or a metal alloy by a reduction in thickness (a thickness of 50 nm or less is preferable).

When an organic EL element is formed, the light-emitting body layer has a light-emitting unit that includes at least a light-emitting layer containing an organic compound.

When an organic EL element is formed, the light-emitting unit may include an electron-injection layer, an electron-transport layer, a hole-injection layer, a hole-transport layer, or the like in addition to the light-emitting layer.

Further, when an organic EL element is formed, a structure in which a plurality of light-emitting units and a plurality of charge generation layers partitioning the plurality of light-emitting units are provided is employed, whereby luminance can be improved.

For the charge generation layer, metal, an oxide conductor, a stack structure of metal oxide and an organic compound, a mixture of metal oxide and an organic compound, or the like can be used.

For the charge generation layer, use of the stack structure of metal oxide and an organic compound, the mixture of metal oxide and an organic compound, or the like is preferred, because such materials allow hole injection in the direction of the cathode and electron injection in the direction of the anode upon application of a voltage.

Examples of the metal oxide that is preferably used for the charge generation layer include oxide of transition metal, such as vanadium oxide, niobium oxide, tantalum oxide, a chromium oxide, molybdenum oxide, tungsten oxide, manganese oxide, and rhenium oxide.

As the organic compound used for the charge generation layer, an amine-based compound (an arylamine compound in particular), a carbazole derivative, aromatic hydrocarbon, Alq, or the like is preferably used, because these materials form a charge-transfer complex with the oxide of transition metal.

When an inorganic EL element is formed, the light-emitting body layer has a light-emitting unit that includes at least a light-emitting layer containing an inorganic compound.

In addition, it is preferable that the light-emitting layer containing an inorganic compound be interposed between a pair of dielectric layers.

When a light-emitting diode element is formed, the light-emitting body layer has a light-emitting unit that includes at least semiconductor layers which form a p-n junction.

Note that since such a light-emitting element easily deteriorates, it is preferable that a circuit having a light-emitting element group be sealed after the circuit is formed.

This embodiment can be implemented in combination with any of the other embodiments as appropriate.

(Embodiment 14)

Since many steps exist under the upper electrode (the upper wiring), there is a problem in that the upper electrode (the upper wiring) is likely to be disconnected due to the steps.

In view of the above, an example in which a conductive layer formed by a wet method is provided over the upper electrode (the upper wiring) will be described.

Note that in this embodiment, an example in which subsidiary wirings in which a conductive layer formed by a wet method and auxiliary wirings are sequentially stacked is provided over the upper electrodes (the upper wirings) will be described; however, the auxiliary wirings are not necessarily provided.

However, by providing the auxiliary wirings, the total resistance of the subsidiary wirings can be reduced; therefore, it is preferable that the auxiliary wirings be provided.

In this embodiment, an example in which the subsidiary wirings are provided over the circuit in FIGS. 19A to 19C is described; however, it is needless to say that the shapes of the upper electrode, the lower electrode, and the light-emitting body layer are not limited to the shapes in FIGS. 19A to 19C.

Figure 40A:
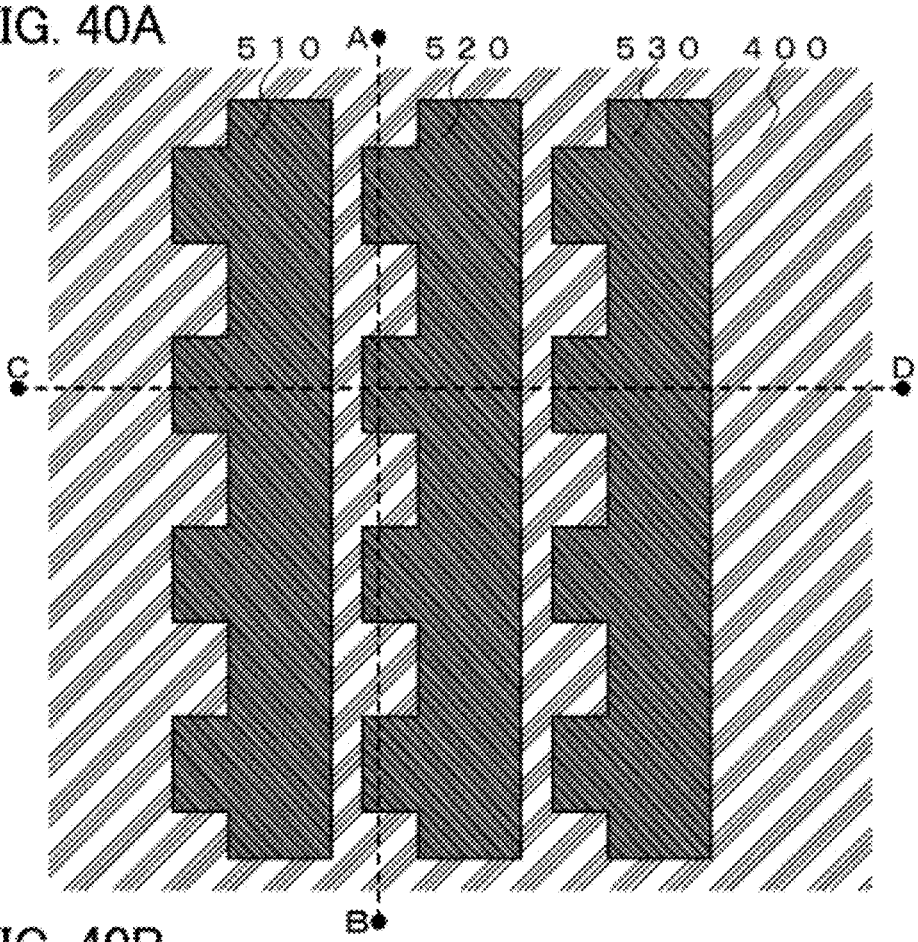
FIGS. 40A, 40B, and 40C illustrate an example of a method for manufacturing a circuit provided in a light-emitting device.
Figure 40B:
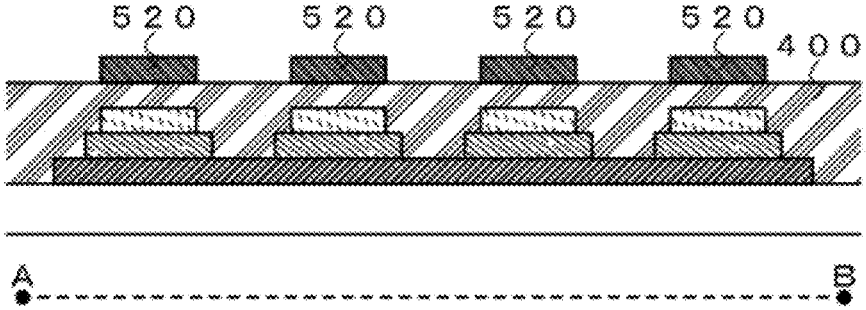
Figure 40C:
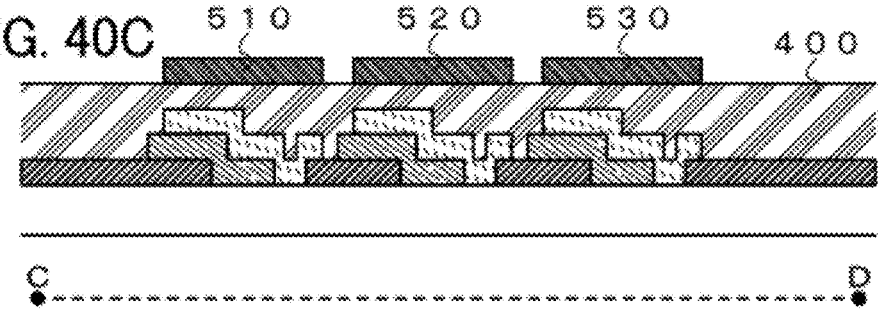

First, a conductive layer 400 formed by a wet method is formed over and in contact with the upper electrodes, and then a plurality of auxiliary wirings (auxiliary wirings 510, 520, and 530) is selectively formed over the conductive layer 400 (FIGS. 40A to 40C).

Note that since the plurality of auxiliary wirings is connected to the plurality of upper wirings in parallel, it is preferable that the plurality of auxiliary wirings be formed so as to overlap with the plurality of upper wirings.

Figure 41A:
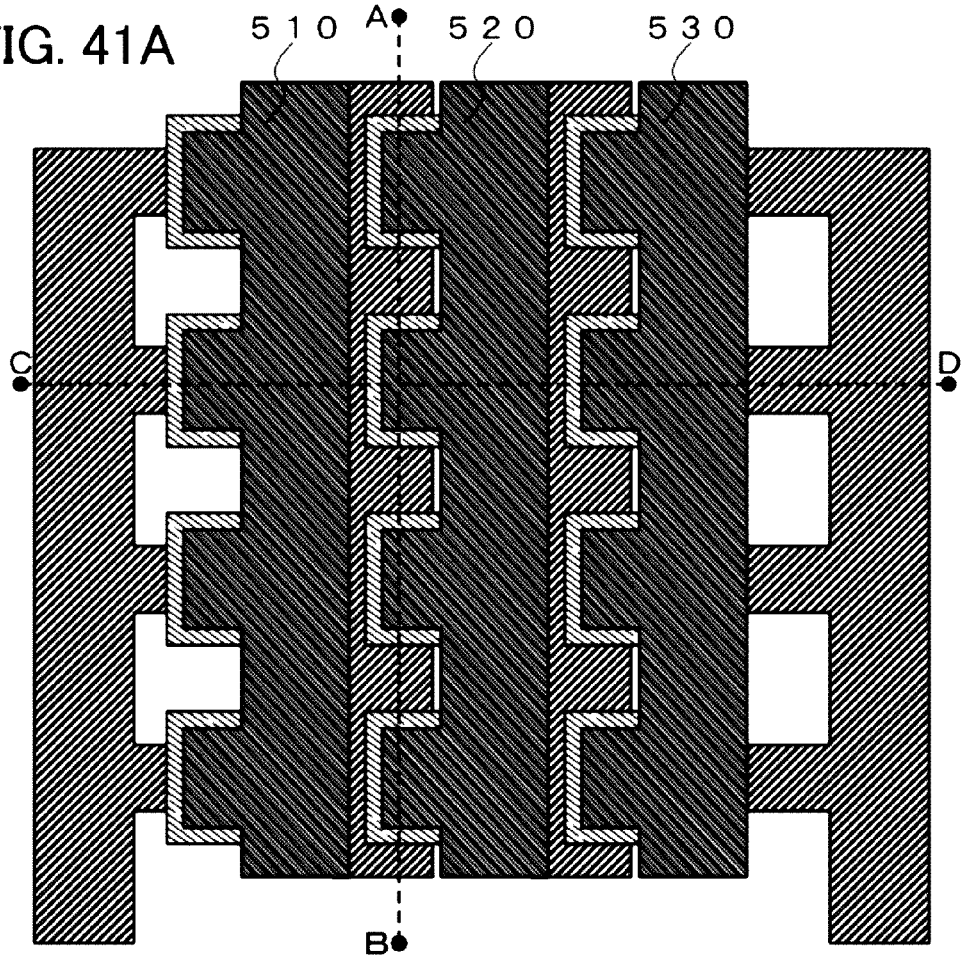
FIGS. 41A, 41B, and 41C illustrate an example of a method for manufacturing a circuit provided in a light-emitting device.
Figure 41B:
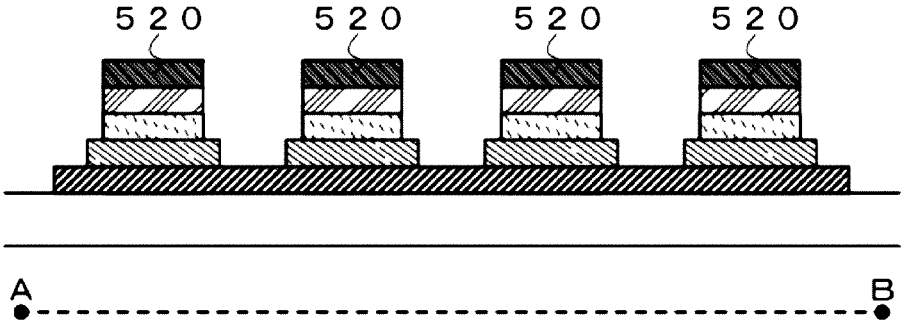
Figure 41C:
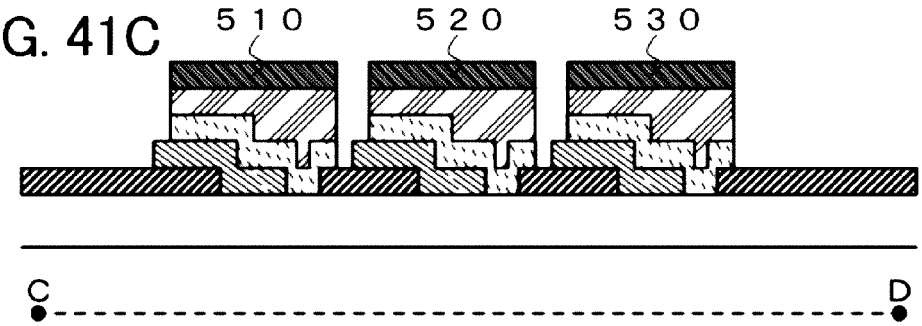

Next, with the use of the plurality of auxiliary wirings as a mask, the conductive layer 400 is etched, so that the conductive layer 400 is divided into a plurality of conductive layers (FIGS. 41A to 41C).

Note that the circuit in FIGS. 41A to 41C corresponds to the circuit in FIG. 6 and a structure in which the subsidiary wirings are formed using three different kinds of layers.

Here, the auxiliary wirings can be formed selectively and minutely with the use of a metal mask, a photomask, or the like.

On the other hand, it is difficult to process selectively and minutely the conductive layer formed by a wet method with the use of a metal mask, a photomask, or the like.

For example, for the auxiliary wirings, a material which has lower resistance than that of the conductive layer formed by a wet method and is similar to materials of the upper electrode and the lower electrode can be used; therefore, the auxiliary wirings can be formed selectively and minutely with the use of a metal mask, a photomask, or the like.

On the other hand, the conductive layer can be formed by a wet method such as a spin coating method, an ink-jet method, or the like; a conductive polymer, a solvent including conductive particles, a sealant including conductive particles, or the like can be used.

Note that for example, when a spin coating method is used, it is difficult to form the conductive layer selectively.

Alternatively, for example, when an ink-jet method is used, the conductive layer can be formed selectively; however, it is difficult to form the conductive layer minutely because there is limitation on the minimum diameter of a nozzle.

Accordingly, it is preferable that the conductive layer be patterned by etching the conductive layer formed by a wet method, with the use of the plurality of auxiliary wirings as a mask.

The conductive layer formed by a wet method can fill a step of the lower layer of the conductive layer; therefore, when the upper electrode is disconnected or a pinhole is generated in the upper electrode, the disconnected portion or the portion where the pinhole is generated can be filled.

In addition, since the conductive layer formed by a wet method has a planarized surface, when an auxiliary wiring is provided, disconnection of the auxiliary wiring can be prevented.

Note that in this embodiment, a means to accomplish the second object is disclosed.

Therefore, in a conventional circuit in FIGS. 44A and 44B, a structure in which the conductive layer formed by a wet method is provided over the upper electrode may be employed.

Figure 43:
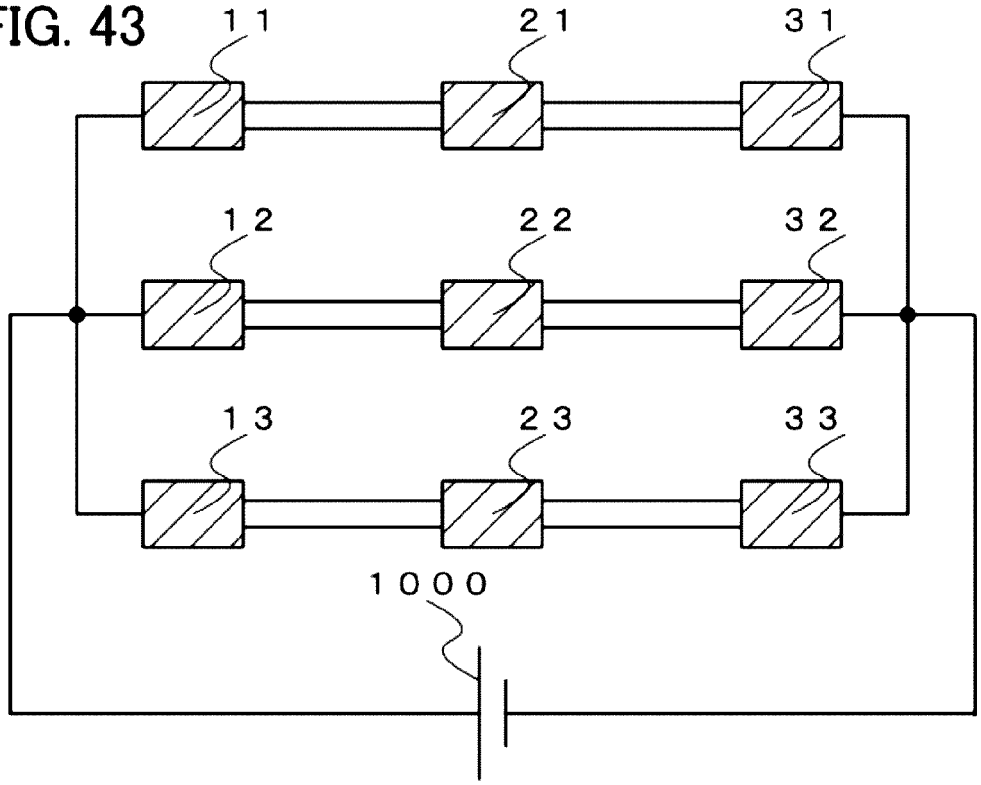
FIG. 43 illustrates an example of a circuit provided in a light-emitting device.

In this case, as illustrated in FIG. 43, the circuit includes the subsidiary wirings provided in the row direction. Accordingly, the circuit can have an effect of prevention of a problem in that the whole of the light-emitting element group provided in the row direction is in a non-light emitting state, even when one of the wirings in the row direction is disconnected.

That is, it can be said that the first object is achieved by the circuit in FIG. 43.

Note that as long as the circuit in FIG. 43 is used, even when a conductive layer other than the conductive layer formed by a wet method is used as the subsidiary wirings provided in the row direction, the first object can be achieved.

Therefore, in the case where the circuit in FIG. 43 is used, there is no limitation on a material of the subsidiary wirings.

Note that in the case where the circuit in FIG. 43 is used, it is preferable that the subsidiary wiring be formed in a different layer from the upper electrode, from the point of view of countermeasures against disconnection.

Further, in a simple light-emitting device including a light-emitting body layer interposed between a lower electrode and an upper electrode, a structure in which a conductive layer formed by a wet method is provided over the upper electrode may be employed.

This embodiment can be implemented in combination with any of the other embodiments as appropriate.

(Embodiment 15)

Since concentration of electric fields occurs at the edge portion of a lower electrode, there is a problem in that a light-emitting body layer formed at a position overlapping with the edge portion of the lower electrode easily deteriorates.

Accordingly, a nonconductive layer is formed at least at a position where the edge portion of the lower electrode overlaps with the light-emitting body layer, whereby deterioration of the light-emitting body layer due to concentration of electric fields at the edge portion of the lower electrode can be suppressed.

Figure 42A:
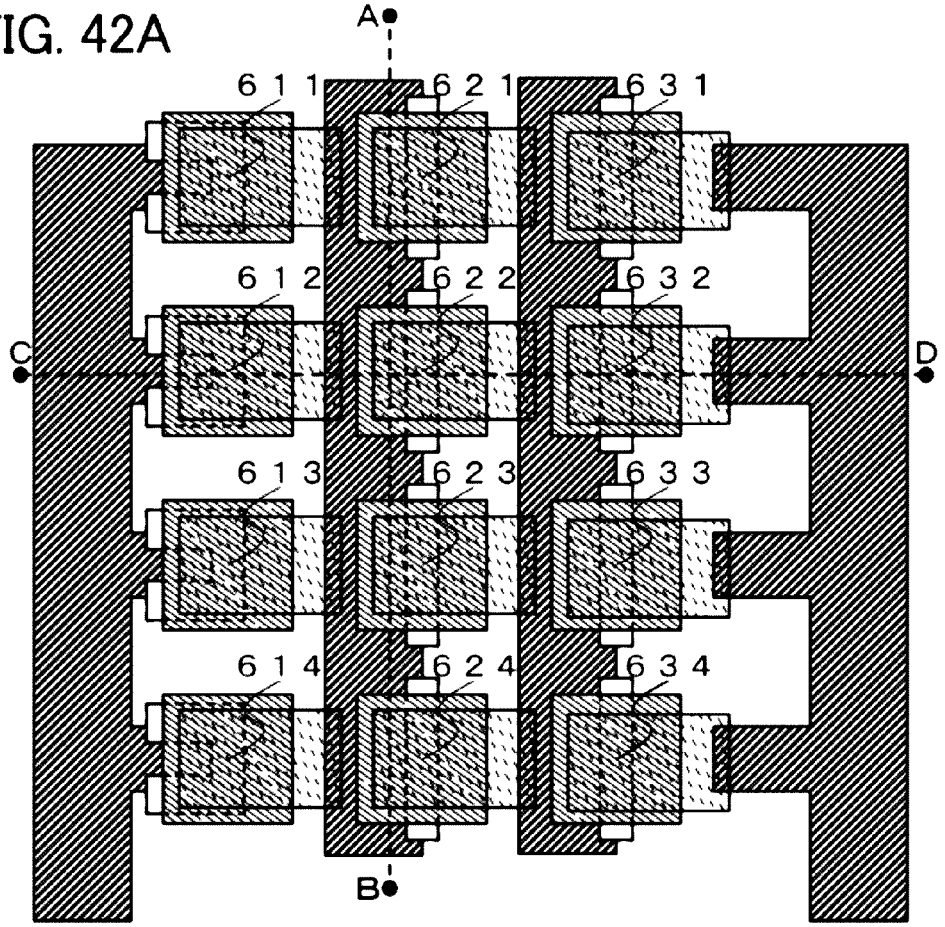
FIGS. 42A, 42B, and 42C illustrate an example of a method for manufacturing a circuit provided in a light-emitting device.
Figure 42B:
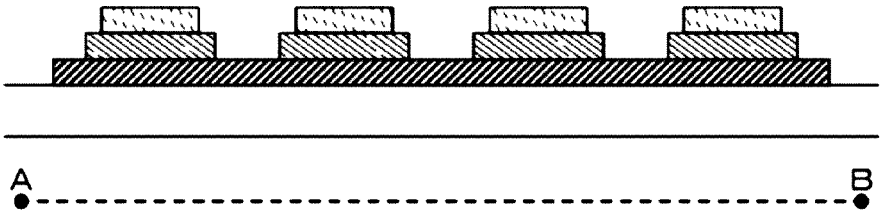
Figure 42C:
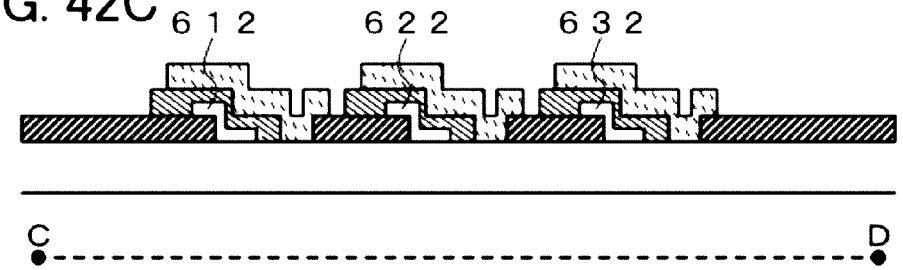

FIGS. 42A to 42C illustrate an example in which as a plurality of nonconductive layers, nonconductive layers 611, 612, 613, 614, 621, 622, 623, 624, 631, 632, 633, and 634 are each formed at a position where the edge portion of the lower electrode overlaps with the light-emitting body layer in FIGS. 16A to 16C.

Note that FIGS. 42A to 42C illustrate an example in which the nonconductive layers are formed at the minimum necessary portions; however, the nonconductive layer may have any shape as long as the light-emitting region and the region to be a connection portion between the upper electrode and the lower electrode are exposed and the nonconductive layer is formed at a position where the edge portion of the lower electrode overlaps with the light-emitting body layer.

In this embodiment, an example in which the nonconductive layers are provided in the circuit in FIGS. 16A to 16C is described; however, it is needless to say that the shapes of the upper electrode, the lower electrode, and the light-emitting body layer are not limited to the shapes in FIGS. 16A to 16C.

Note that the nonconductive layer is an insulating layer or a semiconductor layer.

As the insulating layer, an organic insulating layer or an inorganic insulating layer can be used.

For the organic insulating layer, resist, acrylic, polyimide, or the like can be used, but the present invention is not limited to these materials.

For the inorganic insulating layer, diamond-like carbon, silicon nitride, silicon oxynitride, silicon nitride oxide, silicon oxide, aluminum nitride, aluminum oxynitride, aluminum nitride oxide, or the like can be used, but the present invention is not limited to these materials.

For the semiconductor layer, silicon, silicon germanium, germanium, an oxide semiconductor, or the like can be used, but the present invention is not limited to these materials.

Examples of the oxide semiconductor include, but not limited to, In—Ga—Zn—O-based oxide (containing indium, gallium, zinc, and oxygen as the main components), In—Sn—Zn—O-based oxide (containing indium, tin, zinc, and oxygen as the main components), In—Al—Zn—O-based oxide (containing indium, aluminum, zinc, and oxygen as the main components), Sn—Ga—Zn—O-based oxide (containing tin, gallium, zinc, and oxygen as the main components), Al—Ga—Zn—O-based oxide (containing aluminum, gallium, zinc, and oxygen as the main components), Sn—Al—Zn—O-based oxide (containing tin, aluminum, zinc, and oxygen as the main components), In—Zn—O-based oxide (containing indium, zinc, and oxygen as the main components), Sn—Zn—O-based oxide (containing tin, zinc, and oxygen as the main components), Al—Zn—O-based oxide (containing aluminum, zinc, and oxygen as the main components), In—O-based oxide (oxide of indium (indium oxide)), Sn—O-based oxide (oxide of tin (tin oxide)), Zn—O-based oxide (oxide of zinc (zinc oxide)), and the like.

The oxide semiconductor has a light-transmitting property higher than that of an organic insulating layer, an inorganic insulating layer, silicon, silicon germanium, germanium, and the like. Therefore, the use of the oxide semiconductor as the nonconductive layer can improve the efficiency of the light extraction.

Note that the carrier (hydrogen or oxygen deficiencies) density of the oxide semiconductor is preferably low because electric resistance increases.

The carrier density is preferably $1\times10^{19}$ $cm^{-3}$ or less (more preferably $1\times10^{16}$ $cm^{-3}$ or less, further preferably $1\times10^{14}$ $cm^{-3}$ or less, still further preferably $1\times10^{12}$ $cm^{-3}$ or less).

It is preferred that the nonconductive layer be, but not limited to, an amorphous semiconductor layer because the nonconductive layer preferably has high resistance.

The nonconductive layer may be a single layer or a stacked layer.

In particular, the nonconductive layer preferably has a stack structure in which a metal layer is interposed between a pair of insulating layers.

Metal has a high thermal conductivity and thus serves as a heat-radiation material.

Since the light-emitting body layer is sensitive to heat, by providing a heat-radiation material, deterioration of the light-emitting body layer can be prevented.

In the stack structure of the nonconductive layer in which the metal layer is interposed between the pair of insulating layers, heat conducted from the light-emitting body layer to the electrode can be conducted to the metal through the insulating layer and radiated.

Note that in the stack structure in which the metal layer is interposed between the pair of insulating layers, the problem of a short circuit does not occur because the metal layer is in a floating state.

Thus, it is preferable to form a state in which a sidewall of the metal layer is in contact with part of the island-shaped light-emitting body layer by forming the opening portions in the pair of insulating layers and the metal layer at a single time, because heat can be directly radiated in this state.

By forming the opening portion that is larger in the metal layer than in the pair of insulating layers, it is also possible to form a state in which the sidewall of the metal layer is not in contact with the island-shaped light-emitting body layer.

Furthermore, when the pair of nonconductive layers is formed using silicon nitride, diamond-like carbon, aluminum nitride oxide, aluminum nitride, or the like, which are known as heat-radiation insulating layers, the effect of heat radiation can be improved.

In particular, aluminum nitride oxide, aluminum nitride, and the like are preferable.

Note that the same effect can be gained even by use of a single layer of the heat-radiation insulating layer.

Note also that the thermal conductivity of aluminum nitride is 170 W/m·K to 180 W/m·K, that of silver is 420 W/m·K, that of copper is 398 W/m·K, that of gold is 320 W/m·K, and that of aluminum is 236 W/m·K. For this reason, the stack structure in which the metal layer is interposed between the pair of insulating layers can be said to be preferred.

For the metal layer, any material such as gold, silver, copper, platinum, aluminum, molybdenum, tungsten, or an alloy may be used as long as the material is a kind of metal.

Gold, silver, copper, aluminum, and the like are particularly preferable because they each have a high thermal conductivity.

Since the thermal conductivity of silicon is 168 W/m·K, silicon is preferable as a heat-radiation material. (The thermal conductivity of an insulator is generally 10 W/m·K or less in many cases.)

Therefore, it is also preferable to use a structure in which the metal layer is interposed between a pair of silicon layers.

Note that the pair of nonconductive layers may be a combination of different materials.

In other words, between a first nonconductive layer and a second nonconductive layer, a layer having a thermal conductivity higher than those of the first and second nonconductive layers may be interposed.

Thus, an insulating layer may be interposed between the pair of insulating layers, or a semiconductor layer may be interposed between the pair of insulating layers.

Note that the thermal conductivity of a diamond-like carbon film is 400 W/m·K to 1800 W/m·K (varying depending on the film formation method).

When the first and second electrodes are each made to have a light-transmitting property to fabricate the dual-emission lighting device, a background can be kept out of sight by using the stack structure in which the metal layer is interposed between the pair of nonconductive layers.

For instance, when the dual-emission lighting device is provided on a wall so as to illuminate two adjacent rooms, the background that can be seen allows one room to be glanced at from the other room. Therefore, in the case where one room is not desired to be glanced at from the other room, for example, keeping the background out of sight is effective.

Note that when the background is merely kept out of sight, the nonconductive layer may preferably be formed of a material having a light-shielding property, such as black resin.

In a dual-emission lighting device in which a reflective electrode is not used, utilization of reflected light has been precluded. However, by employing the stack structure in which the metal layer is interposed between the pair of nonconductive layers, the metal layer reflects part of electroluminescence that is emitted in every direction, enabling the utilization of reflected light.

It is needless to say that, a one-side emission lighting device can also have improved reflection efficiency by having the stack structure in which the metal layer is interposed between the pair of nonconductive layers.

This embodiment can be implemented in combination with any of the other embodiments as appropriate.

This application is based on Japanese Patent Application serial no. 2011-012554 filed with Japan Patent Office on Jan. 25, 2011, the entire contents of which are hereby incorporated by reference.

What is claimed is:

1. A light-emitting device comprising:

a circuit comprising at least a first unit and a second unit connected in parallel, each of the first unit and the second unit comprising at least a first light emitting element and a second light emitting element connected in series, wherein each of the first light emitting element and the second light emitting element includes a lower electrode in contact with an insulating surface, a light-emitting body layer over the lower electrode, and an upper electrode over the light-emitting body layer, wherein the first unit comprises a first wiring between the first light emitting element and the second light emitting element of the first unit, and the second unit comprises a second wiring between the first light emitting element and the second light emitting element of the second unit, and wherein the first wiring and the second wiring are electrically connected with a third wiring comprising the same material as the lower electrode and in contact with the insulating surface.

2. The light-emitting device according to claim 1, wherein a fourth wiring is provided over the upper electrode.

3. The light-emitting device according to claim 2, wherein the fourth wiring includes a conductive layer formed by a wet method.

4. The light-emitting device according to claim 2, wherein the fourth wiring has a stack structure of a conductive layer formed by a wet method and an auxiliary wiring over the conductive layer.

5. A light-emitting device comprising:

a circuit comprising at least a first unit, a second unit, and a third unit connected in parallel in a column direction, each of the first unit, the second unit, and the third unit comprising a first light emitting element and a second light emitting element connected in series in a row direction, wherein each of the first light emitting element and the second light emitting element includes a lower electrode in contact with an insulating surface, a light-emitting body layer over the lower electrode, and an upper electrode over the light-emitting body layer, wherein the first unit comprises a first wiring, the second unit comprises a second wiring, and the third unit comprises a third wiring, and wherein the first wiring, the second wiring, and the third wiring are electrically connected with a fourth wiring group each comprising the same material as the lower electrode and in contact with the insulating surface in every column.

6. The light-emitting device according to claim 5, wherein a fifth wiring is provided over the upper electrode.

7. The light-emitting device according to claim 6, wherein the fifth wiring includes a conductive layer formed by a wet method.

8. The light-emitting device according to claim 6, wherein the fifth wiring has a stack structure of a conductive layer formed by a wet method and an auxiliary wiring over the conductive layer.

9. A light-emitting device comprising:

a circuit comprising at least a first unit and a second unit connected in parallel, each of the first unit and the second unit comprising at least a first light emitting element and a second light emitting element connected in series, wherein each of the first light emitting element and the second light emitting element includes a lower electrode in contact with an insulating surface, a light-emitting body layer over the lower electrode, and an upper electrode over the light-emitting body layer, wherein the first unit comprises a first wiring, and the second unit comprises a second wiring, and wherein the first wiring and the second wiring are electrically connected with a third wiring comprising the same material as the lower electrode and in contact with the insulating surface and a fourth wiring comprising the same material as the upper electrode.

10. The light-emitting device according to claim 9, wherein a fifth wiring is provided over the upper electrode.

11. The light-emitting device according to claim 10, wherein the fifth wiring includes a conductive layer formed by a wet method.

12. The light-emitting device according to claim 10, wherein the fifth wiring has a stack structure of a conductive layer formed by a wet method and an auxiliary wiring over the conductive layer.

13. A light-emitting device comprising:

a circuit comprising at least a first unit, a second unit, and a third unit connected in parallel in a column direction, each of the first unit, the second unit, and the third unit comprising a first light emitting element and a second light emitting element connected in series in a row direction, wherein each of the first light emitting element and the second light emitting element includes a lower electrode in contact with an insulating surface, a light-emitting body layer over the lower electrode, and an upper electrode over the light-emitting body layer, wherein the first unit comprises a first wiring, the second unit comprises a second wiring, and the third unit comprises a third wiring, and wherein the first wiring, the second wiring, and the third wiring are electrically connected with a fourth wiring group each comprising the same material as the lower electrode and in contact with the insulating surface and a fifth wiring group each comprising the same material as the upper electrode in every column.

14. The light-emitting device according to claim 13, wherein a sixth wiring is provided over the upper electrode.

15. The light-emitting device according to claim 14, wherein the sixth wiring includes a conductive layer formed by a wet method.

16. The light-emitting device according to claim 14, wherein the sixth wiring has a stack structure of a conductive layer formed by a wet method and an auxiliary wiring over the conductive layer.

* * * * *